US010450780B2

(12) United States Patent
Tomaszewski

(10) Patent No.: US 10,450,780 B2
(45) Date of Patent: Oct. 22, 2019

(54) CLOSURE LATCH ASSEMBLY FOR MOTOR VEHICLE DOOR HAVING GEAR ARRANGEMENT FOR DOUBLE PULL RELEASE

(71) Applicant: Magna Closures Inc., Newmarket (CA)

(72) Inventor: Kris Tomaszewski, Newmarket (CA)

(73) Assignee: Magna Closures, Inc., Newmarket (CA)

( * ) Notice: Subject to any disclaimer, the term of this patent is extended or adjusted under 35 U.S.C. 154(b) by 0 days.

(21) Appl. No.: 15/497,456

(22) Filed: Apr. 26, 2017

(65) Prior Publication Data

US 2017/0314298 A1 Nov. 2, 2017

Related U.S. Application Data

(60) Provisional application No. 62/333,515, filed on May 9, 2016, provisional application No. 62/330,530, filed on May 2, 2016.

(51) Int. Cl.

| | |
|---|---|
| ***E05B 77/26*** | (2014.01) |
| ***E05B 77/30*** | (2014.01) |
| ***E05B 81/06*** | (2014.01) |
| ***E05B 81/16*** | (2014.01) |

(52) U.S. Cl.

CPC ..... *E05B 77/26* (2013.01); *E05B 77/30* (2013.01); *E05B 81/06* (2013.01); *E05B 81/16* (2013.01)

(58) Field of Classification Search

CPC ..... E05B 77/26; E05B 77/30; E05B 81/06; E05B 81/16; E05B 81/42; Y10S 292/23; Y10T 292/1047; Y10T 292/1082

USPC ..... 292/216, 201, DIG. 23

See application file for complete search history.

(56) References Cited

U.S. PATENT DOCUMENTS

| | | | | |
|---|---|---|---|---|
| 6,082,158 | A * | 7/2000 | Wegner | E05B 81/06 292/201 |
| 6,102,453 | A * | 8/2000 | Cetnar | E05B 77/28 292/199 |
| 6,290,269 | B1 * | 9/2001 | Bodley-Scott | E05B 81/25 292/216 |
| 6,764,113 | B1 * | 7/2004 | Cetnar | E05B 81/06 292/201 |
| 7,926,857 | B2 * | 4/2011 | Akizuki | E05B 77/26 292/201 |
| 8,256,805 | B2 * | 9/2012 | Ishiguro | E05B 77/26 292/201 |
| 8,267,444 | B2 * | 9/2012 | Akizuki | E05B 77/26 292/201 |

(Continued)

FOREIGN PATENT DOCUMENTS

| | | | | |
|---|---|---|---|---|
| CA | 2382487 | A1 * | 3/2001 | E05B 81/06 |
| GB | 2452373 | A * | 3/2009 | E05B 77/26 |
| GB | 2458549 | A * | 9/2009 | E05B 77/26 |

*Primary Examiner* — Christine M Mills

(74) *Attorney, Agent, or Firm* — Dickinson Wright PLLC

(57) ABSTRACT

A closure latch assembly for a vehicle door includes a latch mechanism and a lock mechanism. The lock mechanism includes a lock link pivotable between unlock and lock positions, and dual cam arrangement which functions in coordination with rotation of a power lock gear to establish a first locked state where a first cam holds the lock link its lock position and a second locked state where a second cam holds the lock link in its lock position. An unlocked state is established when neither of the first and second cams engage the lock link in its unlock position.

15 Claims, 32 Drawing Sheets

(56) References Cited

U.S. PATENT DOCUMENTS

| | | | | |
|---|---|---|---|---|
| 8,388,030 | B2 * | 3/2013 | Takahashi | E05B 81/16 292/201 |
| 8,474,888 | B2 * | 7/2013 | Tomaszewski | E05B 77/26 292/201 |
| 2016/0017645 | A1 | 1/2016 | Tomaszewski et al. | |

* cited by examiner

CLOSURE LATCH ASSEMBLY FOR MOTOR VEHICLE DOOR HAVING GEAR ARRANGEMENT FOR DOUBLE PULL RELEASE

CROSS-REFERENCE TO RELATED APPLICATIONS

This application claims the benefit of U.S. Provisional Application No. 62/330,530 filed May 2, 2016 and U.S. Provisional Application No. 62/333,515 filed on May 9, 2016. The entire disclosure of each of the above applications is incorporated herein by reference.

FIELD

The present disclosure relates generally to closure latch assemblies for motor vehicle closure systems. More particularly, the present disclosure relates to closure latch assemblies for a vehicle door providing at least one of a power lock feature, a power child lock feature, and a double lock feature, each including a gear and cam arrangement for a double pull mechanical release feature.

BACKGROUND

This section provides background information related to the present disclosure which is not necessarily prior art.

Passive entry systems for vehicles are provided on some vehicles to permit a vehicle user who is in possession of the vehicle key to simply pull the door handle and open the door without the need to introduce the key into a keyhole in the door. The key fob is typically equipped with an electronic device that communicates with the vehicle's on-board control system to authenticate the user. When the user pulls the outside door handle to indicate that he/she wishes entry into the vehicle, an electric actuator associated with a door-mounted closure latch assembly is actuated to release a latch mechanism so as to open the door. The outside door handle may also be equipped with a switch that triggers the electric actuator. The latch mechanism may also be mechanically released from inside the vehicle since the inside door handle is connected to an inside release mechanism associated with the closure latch assembly. In some jurisdictions, however, there are regulations that govern the degree of connection provided by the inside release mechanism between the inside door handle and the latch mechanism (particularly for a rear door, where children may be the occupants).

Many modern closure latch assemblies provide various power-operated features including power release, power lock, power child lock as well as double pull inside release arrangements. While commercially-available closure latch assemblies are satisfactory to meet operational and regulatory requirements, a need still exists to advance the technology to provide closure latch assemblies having reduced complexity and packaging while providing the desired power-operated features previously mentioned.

SUMMARY

This section provides a general summary of the disclosure, and is not a comprehensive disclosure of its full scope or all of its features.

In a first aspect, the disclosure is directed to a closure latch assembly for a vehicle door. The closure latch assembly has a latch mechanism and a lock mechanism configured to include a double pull override feature operable such that, when the lock mechanism is in a locked state, the inside door release lever can be actuated once to unlock the lock mechanism and a second time to release the latch mechanism and open the vehicle door.

It is another aspect to provide a double pull release arrangement for a power lock mechanism that functions to keep the closure latch assembly locked during a transition between a child locked state and a locked state. The power lock mechanism of the present disclosure uses only one motor to provide both the lock function and the child lock function.

In a particular embodiment, the closure latch assembly includes a latch mechanism having a ratchet and a pawl. The ratchet is movable between an open position and a closed position and is biased toward the open position. The pawl is movable between a ratchet holding position whereat the pawl holds the ratchet in the closed position and a ratchet releasing position whereat the pawl permits the ratchet to move to the open position, the pawl being biased toward the ratchet locking position. An inside release lever is operatively connectable to the pawl. A lock mechanism includes a lock link pivotable between an unlock position whereat the lock link operatively connects the inside release lever to the pawl and a lock position whereat the inside release lever operatively disconnects the inside door release lever from the pawl, the lock link being biased toward the unlock position. The lock mechanism further includes a cam arrangement having a lock cam rotatable between an unlocking position whereat the lock cam permits the lock link to pivot to the unlock position and a locking position whereat the lock cam pivots the lock link to the lock position. The lock mechanism further includes an override member connected with the lock cam and rotatable between an actuatable position whereat the inside release lever is engageable with the override member to move the lock cam to the unlocking position and a non-actuatable position wherein the inside release lever is operatively disconnected from the override member. The lock mechanism is operable in an unlocked state when the lock link is in the unlock position; is operable in a first locked state when the lock link is in the lock position, the lock cam is in the locking position and the override member is in the actuatable position; and is operable in a second locked state when the lock link is in the lock position, the lock cam is in the locking position and the override member is in the non-actuatable position.

The lock mechanism of the closure latch assembly includes a power lock actuator having a PL motor for driving a PL gear between a first locked position and a second locked position. Rotation of the PL gear to its first locked position acts to locate the lock cam in its locking position with the override member in its actuatable position so as to establish the first locked state. Rotation of the PL gear to its second locked position acts to locate the lock cam in its locking position with the override member in its non-actuatable position so as to establish the second locked state. The unlock state is established when the inside release lever engages the override member in its actuatable position and moves the lock cam to its unlocking position which in turn rotates the PL gear to an intermediate unlocked position.

In one embodiment of the lock mechanism, the cam arrangement includes a single cam fixed for common rotation with the PL gear between its three distinct gear positions. In an alternative embodiment, the cam arrangement includes a first cam moveable between a lock position and an unlock position and a second cam fixed for rotation with the PL gear. In the first locked state, the first cam is located in its lock position for pivoting the lock link to its lock position and the second cam is located in its unlocking position. In the unlocked state, the override member moves the first cam to its unlock position while the second cam is maintained in its unlocking position so as to permit the lock link to pivot to its unlock position. In the second locked state, the second cam is located in its locking position for pivoting the lock link to its lock position while the first cam is maintained in one of its lock and unlock positions. A toggle spring is provided for locating the first cam in one of its lock and unlock positions.

In accordance with another embodiment, the cam arrangement includes a first or lock cam and a second or child-lock cam, both of which are operatively connected to the PL gear. The child-lock cam is moveable between a child-lock ON position and a child-lock OFF position and a child-lock cam toggle spring functions to positively locate the child-lock cam in one of its two distinct positions. The lock cam is moveable between lock and unlock positions and a lock cam toggle spring functions to positively locate the lock cam in one of its two distinct positions. To establish the first locked state, the PL gear is rotated to its first locked position which functions to locate the lock cam in its lock position and to locate the child-lock cam in its child-lock OFF position such that the lock cam holds the lock link in the lock position. To establish the unlocked state, the override member is driven by the inside release lever to locate the lock cam in its unlock position while the child-lock cam is maintained in its child-lock OFF position. Movement of the lock cam from its lock position to its unlock position functions to drive the PL gear from its first-locked position into its unlocked position. To establish the second locked mode, the PL gear is rotated to its second locked position which functions to locate child-lock cam in its child-lock ON position such that the child-lock cam holds the lock link its lock position while the lock cam is maintained in either of its unlock or lock positions. The orientation of the child-lock cam and the lock cam is configured to maintain the lock link in its lock position during rotation of PL gear between its first and second locked positions.

In yet another aspect, the disclosure is directed to a closure latch assembly for a vehicle door, that provides a power release function having electric actuation to release the latch mechanism and provides a power lock function having electric actuation of a lock mechanism to establish at least two lock states including a first locked state wherein the lock mechanism is unlocked and at least a second locked state selected from the group consisting of: a locked state with a double pull override feature; a child-locked state; and a double-locked state. In some embodiments, the closure latch assembly can have a power lock function providing all of these states.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

The present disclosure will now be described by way of example only with reference to the attached drawings, in which.

Corresponding reference numerals indicate corresponding parts throughout the several views of the drawings.

DETAILED DESCRIPTION

Example embodiments of closure latch assemblies for use in motor vehicle door closure systems are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 11:
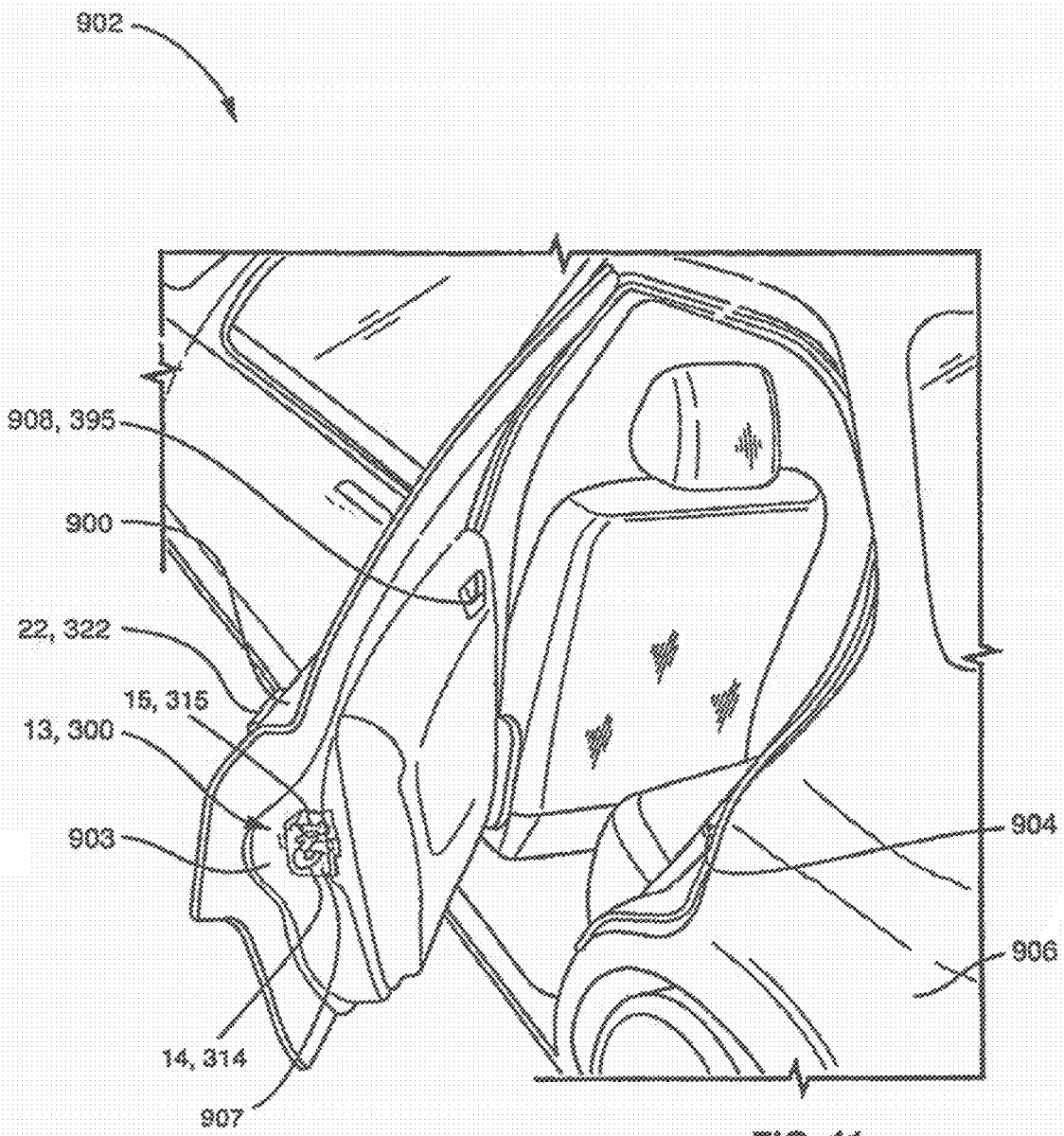
FIG. 11 is a perspective view of a motor vehicle with a rear passenger door equipped with one of the closure latch assemblies of the present disclosure.

Reference is made initially to FIG. 11 which shows an embodiment of a closure latch assembly 13 for a vehicle door 900 of a motor vehicle 902. The closure latch assembly 13 is positioned on a rear edge face 903 of the vehicle door 900 and is arranged in a suitable orientation to engage a striker 904 mounted on the vehicle body 906 when the door 902 is closed.

Figure 1:
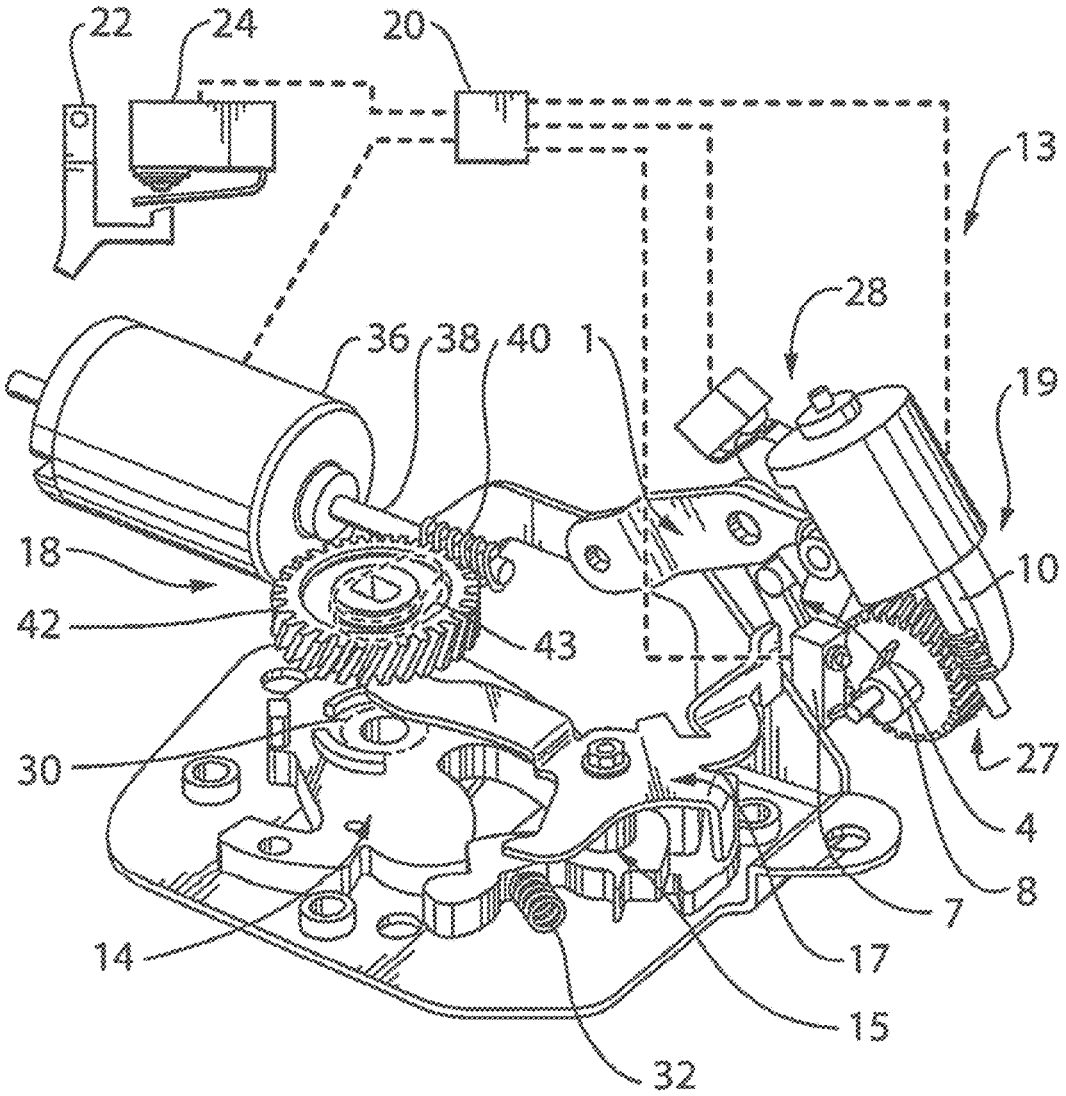
FIG. 1 is an elevation view of a first embodiment of a closure latch assembly.

Referring now to FIG. 1, a first non-limiting embodiment of the closure latch assembly 13 generally includes a latch mechanism, a latch release mechanism, a power release mechanism, an inside door release mechanism, and a power lock mechanism with a double pull manual release function. The latch mechanism includes a ratchet 14 and a pawl 15. Ratchet 14 is moveable between a closed or striker capture position (FIG. 1) whereat the ratchet 14 retains the striker 904 and an open or striker release position whereat the ratchet 14 permits release of the striker 904. A ratchet biasing member 30, such as a torsion spring, biases ratchet 14 toward the open position. The pawl 15 is pivotably moveable relative to ratchet 14 between a ratchet holding position (FIG. 1) whereat the pawl 15 holds the ratchet 14 in its closed position and a ratchet releasing position whereat the pawl 15 permits the ratchet 14 to move to its open position. A pawl biasing member 32, such as a coil spring, biases pawl 15 toward its ratchet holding position.

The latch release mechanism includes a pawl release lever 17 operatively connected to the pawl 15 and which is movable between a pawl release position whereat the pawl release lever 17 causes the pawl 15 to move to the ratchet releasing position and a home position (FIG. 1) whereat the pawl release lever 17 permits the pawl 15 to be maintained in the ratchet holding position. A release lever biasing member 34, such as a suitable spring, is provided to bias the pawl release lever 17 to the home position. The pawl release lever 17 may be moved from the home position to the pawl release position by several components, such as, for example, the power release mechanism, the outside door release mechanism, or the inside door release mechanism.

The power release mechanism 18 includes a power release motor 36 having a motor output shaft 38, a power release worm gear 40 secured to the output shaft 38, a power release (PR) gear 42, and a power release (PR) cam 43. The PR cam 43 is connected for common rotation with the PR gear 42 and is rotatable between a pawl release range of positions and a pawl non-release range of positions. In FIG. 1, the PR cam 43 is in a position that is within the pawl non-release range. The PR gear 42 is driven by the worm gear 40 and in turn drives the PR cam 43 which drives the pivoting movement of the pawl release lever 17 between its home and pawl release positions.

The power release mechanism 18 may be used as part of a passive entry feature. When a person approaches the vehicle with an electronic key fob and opens the outside door handle 22, the vehicle senses both the presence of the key fob and that the outside door handle 22 has been actuated (e.g. via communication between a switch 24 and an electronic control unit (ECU) shown at 20 that at least partially controls the operation of the closure latch assembly 13). In turn, the ECU 20 actuates the power release mechanism 18 to release the latch mechanism and unlatch the closure latch assembly 13 so as to open the vehicle door.

The power lock mechanism 27 controls the operative connection between an inside release lever 1 associated with the inside door release mechanism and the pawl release lever 17. The power lock mechanism 27 includes a power lock actuator 19 and a lock mechanism 28. The lock mechanism 28 is shown to include an auxiliary release lever 4, a lock link 2 and a lock lever 3. The auxiliary release lever 4 is operatively connected to the pawl release lever 17 and is movable between a home position (shown in FIG. 2A) whereat the auxiliary release lever 4 permits the pawl release lever 17 to be in the home position and an actuated position whereat the auxiliary release lever 4 forcibly moves the pawl release lever 17 to the pawl release position.

Figure 2A:
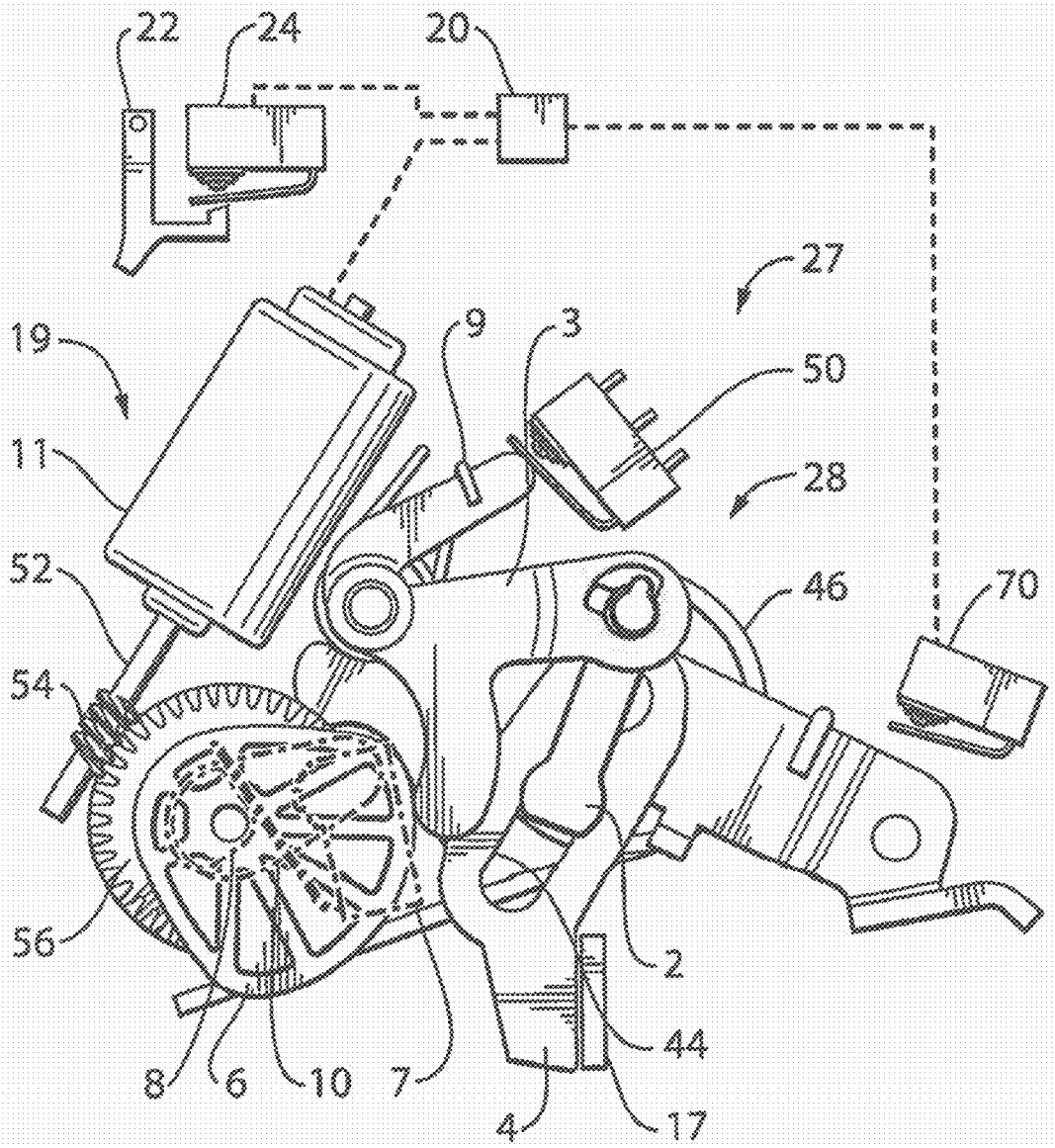
FIG. 2A is a plan view of a power-operated lock mechanism associated with the closure latch assembly shown in FIG. 1 in a locked state.
Figure 2B:
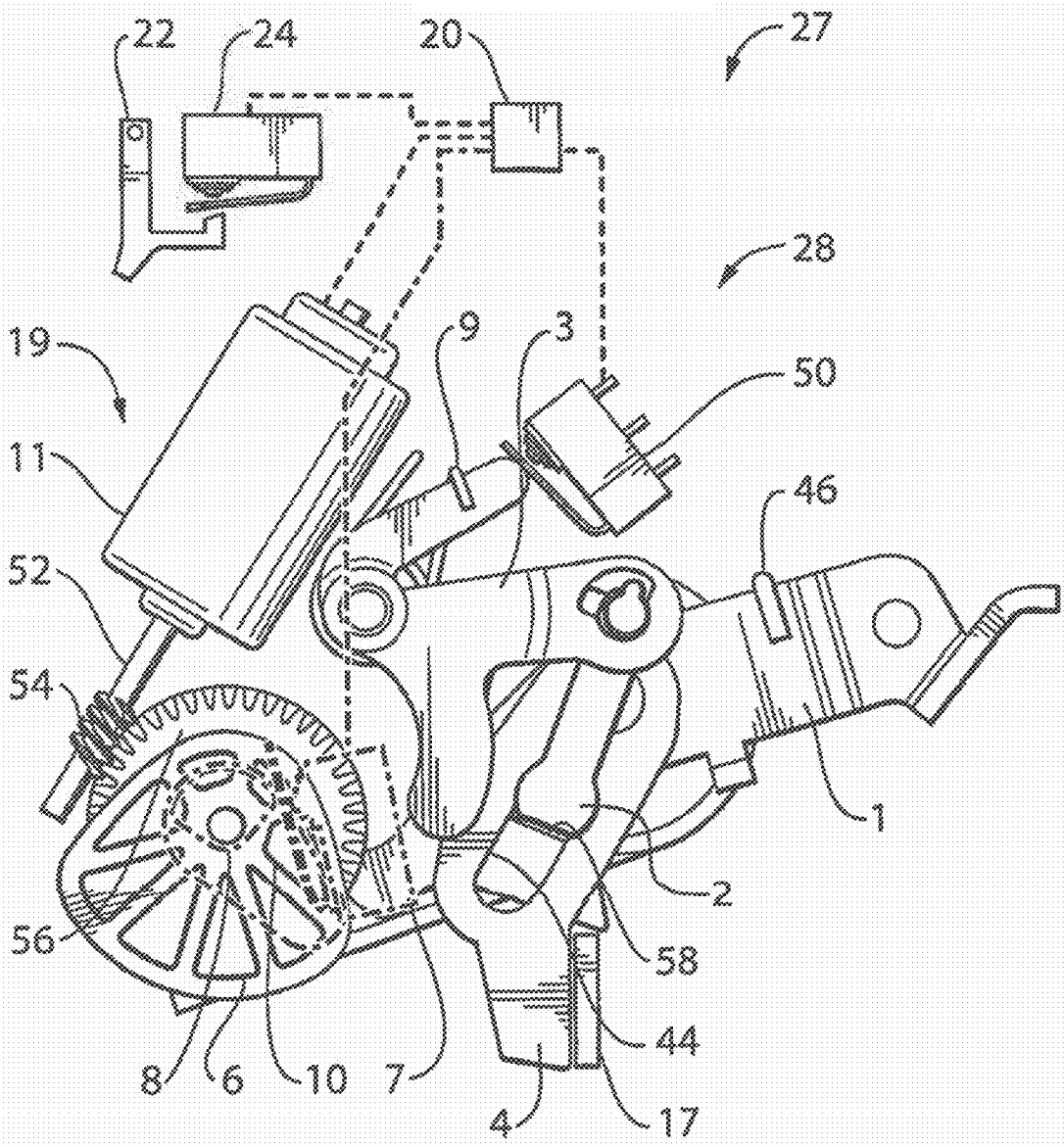
FIG. 2B is a plan view of the lock mechanism in an override state.
Figure 2C:
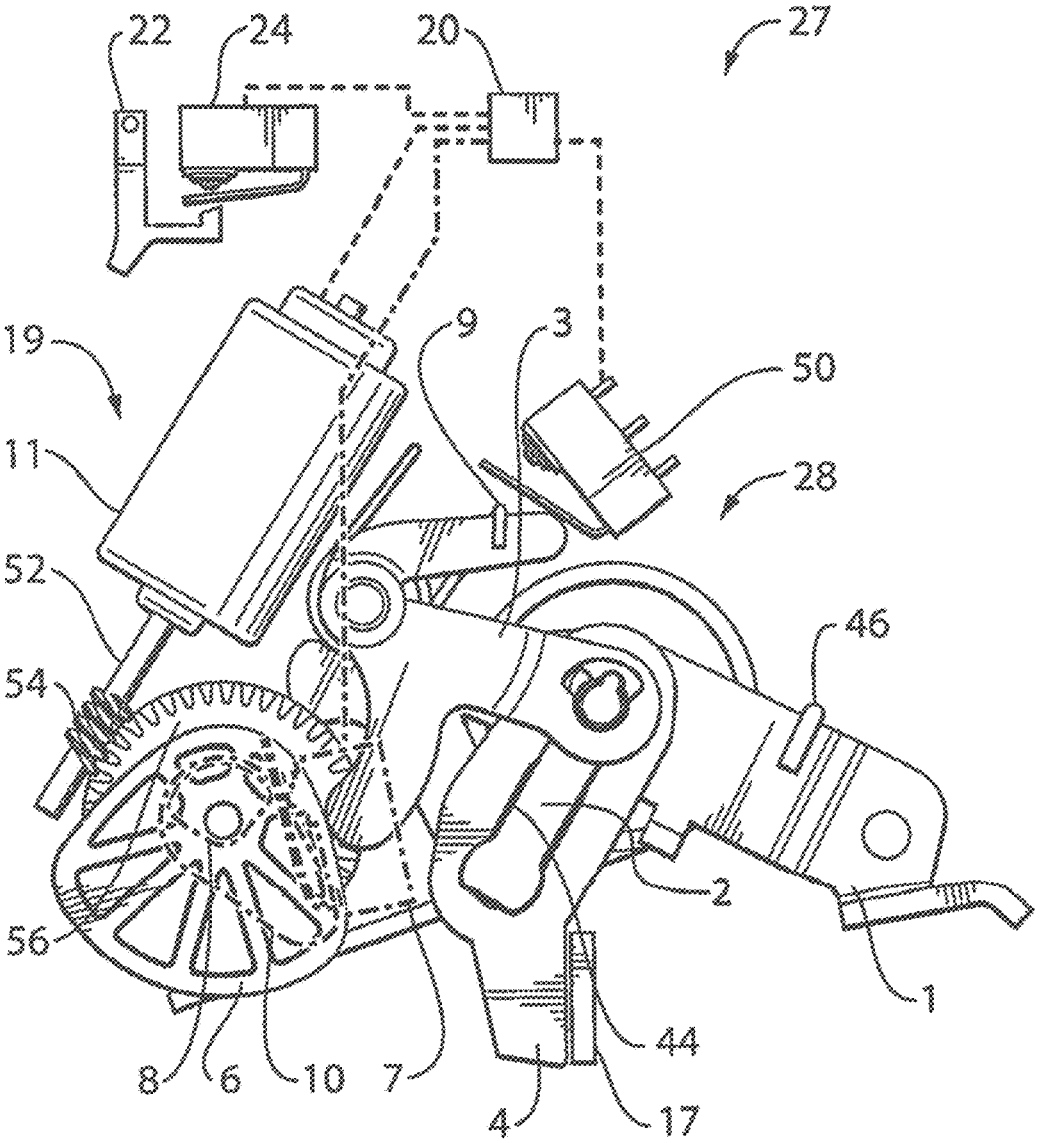
FIG. 2C is a plan view of the lock mechanism in an unlocked state.

The lock link 2 is slidable within an elongated slot 44 formed in the auxiliary release lever 4 and controls the connection between the inside release lever 1 and the auxiliary release lever 4. The lock link 2 is movable between a lock position (FIG. 2A) and an unlock position (FIG. 2C). When the lock link 2 is in the unlock position, the lock link 2 is positioned in the path of the inside release lever 1 which is pivotably moveable between a home position (FIG. 2A) to an actuated position (FIG. 2B). As a result, when the inside release lever 1 is moved from the home position to the actuated position, the inside release lever 1 engages and moves the lock link 2 and, as a result, this movement causes the auxiliary release lever 4 to rotate from the home position to the actuated position. In contrast, when the lock link 2 is in the lock position (FIG. 2A), the lock link 2 is not in the path of the inside release lever 1. As a result, movement of the inside release lever 1 from the home position to the actuated position does not result in any corresponding movement of the auxiliary release lever 4 away from the home position. The lock lever 3 is operatively connected to the lock link 2 and is movable between a locked position (FIG. 2A) whereat the lock lever 3 positions the lock link 2 in the lock position and an unlocked position (FIG. 2C) whereat the lock lever 3 positions the lock link 2 in the unlock position. An inside release lever biasing member 46, such as a suitable torsion spring, is provided to bias the inside release lever 1 to the home position. A lock lever biasing member 9, such as a suitable torsion spring, is provided to bias the lock lever 3 to the unlocked position.

The power lock actuator 19 controls the position and operation of the lock mechanism 28. The power lock actuator 19 includes a lock motor 11 which has an output shaft 52 with a worm gear 54 thereon, a power lock (PL) gear 56 meshed with worm gear 54, a lock lever cam 6, an override member 10, a lock lever cam state switch cam 8, and a lock lever cam state switch 7. The lock lever cam 6, the override member 10 and the lock lever cam state switch cam 8 are all fixed together and rotatable with the PL gear 56. The override member 10, the switch cam 8 and the switch 7 are shown in dashed outline in FIGS. 2A-2D as a result of being obstructed from view by lock lever cam 6. The cam 8 and switch 7 are shown in FIG. 1, however.

Figure 2D:
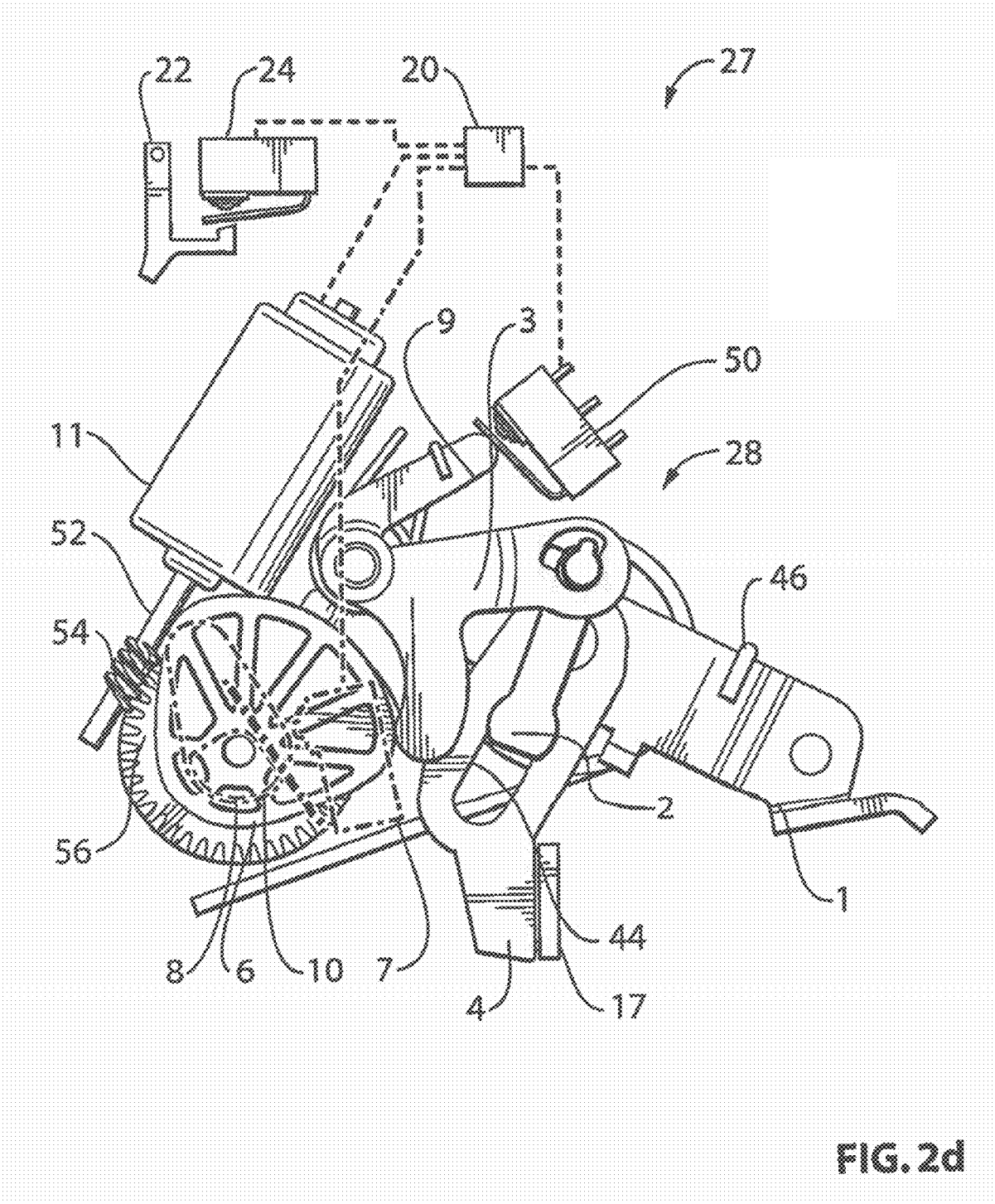
FIG. 2D is a plan view of the lock mechanism in a child-locked state.

The lock lever cam 6 is operatively connected to the lock lever 3, and is rotatable between a locking range of positions and an unlocking range of positions. When in a position that is within the locking range of positions (examples of which are shown in FIGS. 2A and 2D), the lock lever cam 6 holds the lock lever 3 in the locked position. When in a position that is within the unlocking range of positions (an example of which is shown in FIG. 2C), the lock lever cam 6 permits the lock lever 3 to move to the unlocked position.

The lock lever cam state switch cam 8 is movable between an unlocking range of positions (an example of which is shown in FIG. 2C), and a locking range of positions (an example of which is shown in FIG. 2A). Movement of the lock lever cam state switch cam 8 between the unlocking and locking ranges changes the state of the lock lever cam state switch 7. For example, the switch 7 may be open when the lock lever cam state switch cam 8 is in the locking range and may be closed when the lock lever cam state switch cam 8 is in the unlocking range, or vice versa. The state of the lock lever cam state switch 7 may be used by the ECU 20 to determine whether or not to permit the outside door handle 22 to be operatively connected to the pawl release lever 17 (via the power release actuator 18 shown in FIG. 1). It will be noted that it is alternatively possible for the operation of the switch 7 to be reversed and for the profile of the lock lever cam state switch cam 8 to be reversed, such that opening of the switch 7 would indicate to the ECU 20 that the power lock mechanism 27 was unlocked, and closing of the switch 7 would indicate to the ECU 20 that the power lock mechanism 27 was locked.

A lock lever state switch 50 can be used to indicate to the ECU 20, the state of the lock lever 3 (i.e. whether the lock lever 3 is in the locked or unlocked position). It will be understood that the lock lever state switch 50 is an alternative switch that can be provided instead of the switch 7 and switch cam 8. In other words, if the switch 50 is provided, the switch 7 and cam 8 may be omitted. Alternatively if the switch 7 and cam 8 are provided, the switch 50 may be omitted.

The override member 10 is movable between an actuatable range of positions (an example of which is shown in FIG. 2A), and a non-actuatable range of positions (examples of which are shown in FIGS. 2C and 2D). The operation of the override member 10 is described further below.

Rotation of the lock motor 11 drives the rotation of the PL gear 56 (through the worm gear 54) and therefore concurrently drives the movement of the lock lever cam 6, the lock lever cam state switch cam 8 and the override member 10.

For a rear door application, the power lock mechanism 27 may establish three states: a locked state (FIG. 2A), an unlocked state (FIG. 2C), and a child-locked state (FIG. 2D). Referring to FIG. 2C, when the power lock mechanism 27 is in the unlocked state, the lock lever cam 6 is within the unlocking range and, as a result, the lock lever 3 and the lock link 2 are in their unlocked positions. As a result, the inside release lever 1 is operatively connected to the pawl release lever 17 (and therefore to the pawl 15 shown in FIG. 1) through the lock link 2 and the auxiliary release lever 4. Thus, actuation of the inside release lever 1 to the actuated position results in the actuation of pawl release lever 17 and thus movement of the pawl 15 to the ratchet releasing position, thereby releasing the ratchet 14 for movement to its open position. Additionally, referring to FIG. 2C, the lock lever cam state switch cam 8 is in the unlocking range so as to indicate to the ECU 20 to consider the outside door handle 22 as unlocked. As a result, if the outside door handle 22 were pulled by a person outside the vehicle even if the person does not possess the electronic key fob or a key, the power release actuator 18 actuates the pawl release lever 17 so as to open the vehicle door.

The power lock mechanism 27 shown in FIGS. 2A-2D includes a double pull override feature that permits the inside release lever 1 to open the vehicle door even if the power lock mechanism 27 is in the locked state. Referring to FIG. 2A, when the power lock mechanism 27 in the locked state the lock lever cam 6 is in the locking range and thus holds the lock lever 3 in the locked position against the urging of the lock lever biasing member 9. Furthermore, the lock lever cam state switch cam 8 is in the locking range and as a result, the lock lever cam state switch 7 indicates to the ECU 20 that the power lock mechanism 27 is locked so that the ECU 20 operatively disconnects the outside door handle 22 from the pawl release lever 17. Furthermore, the override member 10 is in the actuatable range.

When the inside release lever 1 is actuated (i.e. moved to the actuated position) while the power lock mechanism 27 is in the locked state (see FIG. 2B), the inside release lever 1 does not move the auxiliary release lever 4 to the actuated position. The movement of the inside release lever 1 does, however, drive the override member 10 to move from a first position which is an actuatable position, to a second position which is in the non-actuatable range. Because the lock lever cam 6, the lock lever cam state switch cam 8, and the override member 10 are all connected together, the movement of the override member 10 to the second position (FIG. 2B) results in movement of the lock lever cam 6 to a position within the unlocking range and results in movement of the lock lever cam state switch cam 8 to a position within the unlocking range. The movement of the lock lever cam state switch cam 8 to within the unlocking range closes the lock lever cam state switch 7 so as to signal to the ECU 20 to permit operative control between the outside door handle 22 and the pawl release lever 17.

While the inside release lever 1 is still actuated, a lock link keeper surface 58 provided thereon holds the lock link 2 in the lock position. As a result, the lock lever 3 remains in the locked position even though the lock lever cam 6 no longer obstructs the movement of the lock lever 3 to the unlocked position. The respective states of the lock lever cam state switch 7 and the lock lever state switch 50 can be used to indicate to the ECU 20 that the power lock mechanism 27 is in an 'override' state.

When the inside release lever 1 is released from the actuated position and moves back to the home position (see FIG. 2C), the keeper surface 58 moves out of the way of the lock link 2, and so the lock link 2 and the lock lever 3 move to their unlocked positions under the urging of the lock lever biasing member 9 (FIG. 2*c*). As a result, the power lock mechanism 27 is in the unlocked state. Thus, when the power lock mechanism 27 was in the locked state, actuation and return to the home position of the inside release lever 1 has moved the power lock mechanism 27 to the unlocked state shown in FIG. 2C, whereat the inside release lever 1 is operatively connected to the pawl release lever 17 through the lock link 2 and the auxiliary release lever 4. As a result, a second actuation of the inside release lever 1 from its home position to its actuated position functions to move the pawl release lever 17 to its pawl release position so as to move the pawl 15 to its ratchet releasing position so as to release the latch mechanism and open the vehicle door.

When the power lock mechanism 27 is in the child-locked state, shown in FIG. 2D, the lock lever cam 6 is in the locking range and, as a result, the lock link 2 and lock lever 3 are in their locked positions. Furthermore, the override member 10 is in a third position, which is in the non-actuatable range. As a result, the inside release lever 1 is prevented from overriding the power lock mechanism 27 and opening the vehicle door regardless of how many times the release lever 1 is actuated. Furthermore, the lock lever cam state switch cam 8 may be in the locking range, thereby resulting in the operative disconnection between the outside door handle 22 and the pawl release lever 17.

The power lock mechanism 27 may be shifted between its unlocked, locked and child-locked states by the lock actuator 19 rotating the PL gear 56. More specifically, to shift the power lock mechanism 27 from the locked state (FIG. 2A) to the unlocked state (FIG. 2C), the lock motor 11 is actuated to rotate the PL gear 56 in a first direction (clockwise in the view shown in FIG. 2A) until the ECU 20 senses that the lock lever cam state switch cam 8 has moved to the unlocking range based on the state of the switch 7 and that the lock lever cam 6 has moved to the unlocking range based on the state of the switch 50. To shift the power lock mechanism 27 from the unlocked state (FIG. 2C) into the child-locked state (FIG. 2D), the lock motor 11 is actuated to rotate the PL gear 56 in the first direction (clockwise in the view shown in FIG. 2C) until the lock motor 11 stalls as a result of engagement with a component connected to the PL gear 56 with a corresponding stationary limit surface. To move the power lock mechanism 27 from the locked state (FIG. 2A) to the child-locked state (FIG. 2D), the lock motor 11 may be actuated to rotate the PL gear 56 in the first direction (clockwise in the view shown in FIG. 2A) until the lock motor 11 stalls as a result of engagement with a component connected to the PL gear 56 with a corresponding stationary limit surface.

To shift the power lock mechanism 27 from the child-locked state (FIG. 2D) to the unlocked state (FIG. 2C), the lock motor 11 is actuated to rotate the PL gear 56 in a second direction (counter-clockwise in the view shown in FIG. 2D) until the ECU 20 senses that the lock lever cam state switch cam 8 has moved to the unlocking range based on the state of the switch 7, and that the lock lever cam 6 has moved to the unlocking range based on the state of the switch 50. To shift the power lock mechanism 27 from the unlocked state (FIG. 2C) to the locked state (FIG. 2A), the lock motor 11 is actuated to rotate the PL gear 56 in the second direction (counter-clockwise in the view shown in FIG. 2C) until the lock motor 11 stalls as a result of engagement with a component connected to the PL gear 56 with a corresponding limit surface. To shift the power lock mechanism 27 from the child-locked state (FIG. 2D) to the locked state (FIG. 2A), the lock motor 11 may be actuated to rotate the PL gear 56 in the second direction (counter-clockwise in the view shown in FIG. 2*d*) until the lock motor 11 stalls as a result of engagement with a component connected to the PL gear 56 with a corresponding limit surface.

During the aforementioned movements of the lock components, the lock state can be indicated to the ECU 20 by state of the lock lever cam state switch 7 and additionally in some cases by the most recent command issued by the ECU 20 to the lock motor 11. More specifically, if the switch 7 indicates a locked state, and the most recent command by the ECU 20 was to rotate the lock motor 11 in the first direction, then the power lock mechanism 27 is in the child-locked state. If the switch 7 indicates a locked state and the most recent command by the ECU 20 was to rotate the lock motor 11 in the second direction, then the power lock mechanism 27 is in the locked state. If the switch 7 is indicates an unlocked state, then the power lock mechanism 27 is in the unlocked state regardless of the most recent command issued by the ECU 20 to the lock motor 11. It will be noted that the lock state of the power lock mechanism 27 could alternatively be determined by the state of the lock lever state switch 50 instead of the state of the switch 7.

The power lock mechanism 27 shown in FIGS. 2A-2D includes a 'panic' feature, which permits the state to be changed from the child-locked state (FIG. 2D) to the unlocked state (FIG. 2C), while the inside release lever 1 is in the actuated position (FIG. 2B). Because the keeper surface 58 on the inside release lever 1 keeps the lock lever 3 in the locked position, the lock lever 3 does not obstruct the movement of the lock lever cam 6 counter-clockwise to the unlocking range. As a result, when the inside release lever 1 is released and moves back to the home position, the lock lever 3 can move to the unlocked position, and the power lock mechanism 27 at that point will be in the unlocked state. Thus, the power lock mechanism 27 permits the closure latch assembly 13 to receive and act upon an instruction to unlock, even when a vehicle occupant has actuated the inside release lever 1 and holds the release lever 1 in the actuated position.

In the child-locked state, the power lock mechanism 27 does not permit the inside release lever 1 to unlatch the closure latch assembly 13, but the power lock mechanism 27 may permit the inside release lever 1 to unlock the outside door handle 22 so that the outside door handle 22 can subsequently be used to unlatch the closure latch assembly 13. To achieve this, an inside release lever state switch shown at 70 may be provided for indicating to the ECU 20 the state of the inside release lever (i.e. for indicating to the ECU 20 whether the inside release lever 1 is in the home position or the actuated position). When the inside release lever 1 is actuated, the ECU 20 can sense the actuation and if the power lock mechanism 27 is in the child-locked state, the ECU 20 can unlock the outside door handle 22. When the inside release lever 1 is actuated while the power lock mechanism 27 is in the second locked state, the ECU 20 would not unlock the lock link 2 or the outside door handle 22.

Instead of the lock motor 11 being capable of rotating the PL gear 56 to a selected position associated with the child-locked state of the power lock mechanism 27, it is alternatively possible for movement of the power lock mechanism 27 into and out of the child-locked state to be manually controlled, (e.g. via a child lock mechanism that includes a lever that protrudes from an edge face of the vehicle door 900. In such an embodiment, the child lock mechanism may include a separate child lock cam that engages a suitable part of the lock lever 3 to control whether the lock lever 3 is movable from the locked position to the unlocked position. The child lock cam may be rotatable between a locking range of positions and a non-locking range of positions. Because the child locking capability is provided from the child lock mechanism, the ECU 20 can operate the motor 11 to rotate the PL gear 56 between two positions instead of three positions. The two positions would correspond to an unlocked state of the outside door handle 22 and, for example, a locked state.

Figure 4:
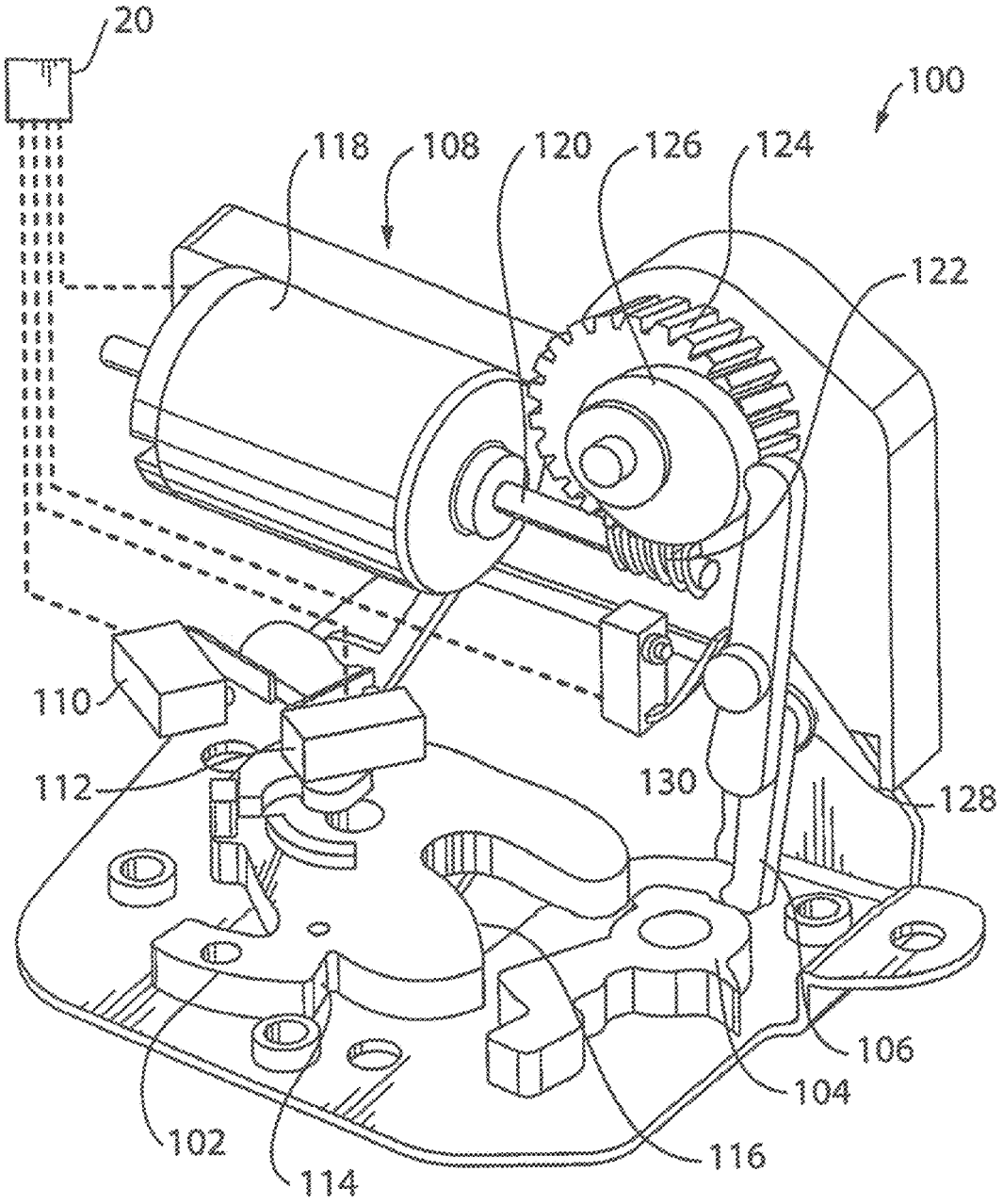
FIG. 4 is a perspective view of a third embodiment of a closure latch assembly.

Reference is now made to FIG. 4, which shows another embodiment of a closure latch assembly 100. The closure latch assembly 100 includes a latch mechanism having a ratchet 102 and a pawl 104 (which may be similar to the ratchet 14 and pawl 15 in FIG. 1) and which may be biased to the open position for the ratchet and to the ratchet holding position for the pawl by suitable biasing members, a latch release mechanism having a pawl release lever 106, and a power release mechanism 108. The ratchet 102 may have structure thereon for tripping two switches, shown at 110 and 112. The first switch 110 may be a door-ajar indicator switch, which is positioned to indicate a condition where the ratchet 102 is in the secondary position (i.e. where the pawl 104 holds the secondary locking surface, shown at 114 of the ratchet 102 instead of holding the primary locking surface 116). The second switch 112 may be used to indicate that the ratchet 102 is open (thereby indicating that the vehicle door is open).

The power release mechanism 108 includes a power release motor 118 with an output shaft 120 having a worm gear 122 which drives a power release (PR) gear 124. The PR gear 124 has a release lever actuation cam 126 connected thereto which pivots the pawl release lever 106 from a home position to a pawl release position (FIG. 4). A release lever biasing member 128 may be provided to bias the pawl release lever 106 towards its home position.

When the power release mechanism 108 is used to release the pawl 104 to open the vehicle door, the ECU 20 may run the power release motor 118 until the ECU 20 receives a signal that the vehicle door is open (from switch 112), or until a selected time period has elapsed, indicating that the vehicle door is stuck (e.g. from snow or ice buildup on the vehicle). Upon receiving a signal from the door state switch that the vehicle door is open, the ECU 20 can send a signal to the motor 118 to reset the ratchet 102 and pawl 104 so that the pawl 104 is ready to lock the ratchet 102 when the vehicle door is closed.

The ECU 20 may receive signals from an inside door handle state switch (not shown in FIG. 4) and from the outside door handle state switch 24 which indicate to the ECU 20 whether either of the inside door handle (shown at 908 in FIG. 11) and the outside door handle 22 is in the home position or is actuated. The ECU 20 can provide any of several lock states including child-locked, unlocked, double-locked and locked, by selectively acting upon or ignoring actuation signals from the inside door handle and/or the outside door handle 22. These lock states may be logical states of the ECU 20. Functions such as double-pull override can be provided, whereby the ECU 20 unlocks the inside door handle upon a first actuation of the inside door handle (while the latch is locked).

A pawl release lever state switch 130 may be provided that senses the position of the pawl release lever 106. The state switch 130 can be used to indicate to the ECU 20 when the pawl release lever 106 has reached the actuated position.

The closure latch assembly 13, 100 described above have been described in the context of being used in a rear door of a vehicle. The closure latch assembly 13, 100 may also be used in a front door of a vehicle having three lock states, including a locked state, an unlocked state and a double-locked state (instead of the child-locked state used in a rear door application). These three lock states may be provided by the similar structure that provided the three lock states (locked, unlocked and child-locked) for the closure latch assembly 13, 100. One difference is that, when the power lock mechanism 27 is in the double-locked state, the ECU 20 would not unlock the outside door handle 22 when the inside door release lever 1 is actuated, whereas the ECU 20 may be programmed to unlock the outside door handle 22 as described above when in the child-locked state in a rear door application. With reference to FIG. 2A, it is optionally possible to provide an additional double lock feature for the closure latch assembly 13. Thus, the power lock mechanism 27 (and therefore the closure latch assembly 13) would have a child-locked state, an unlocked state and a locked state and a double-locked state.

Figure 3:
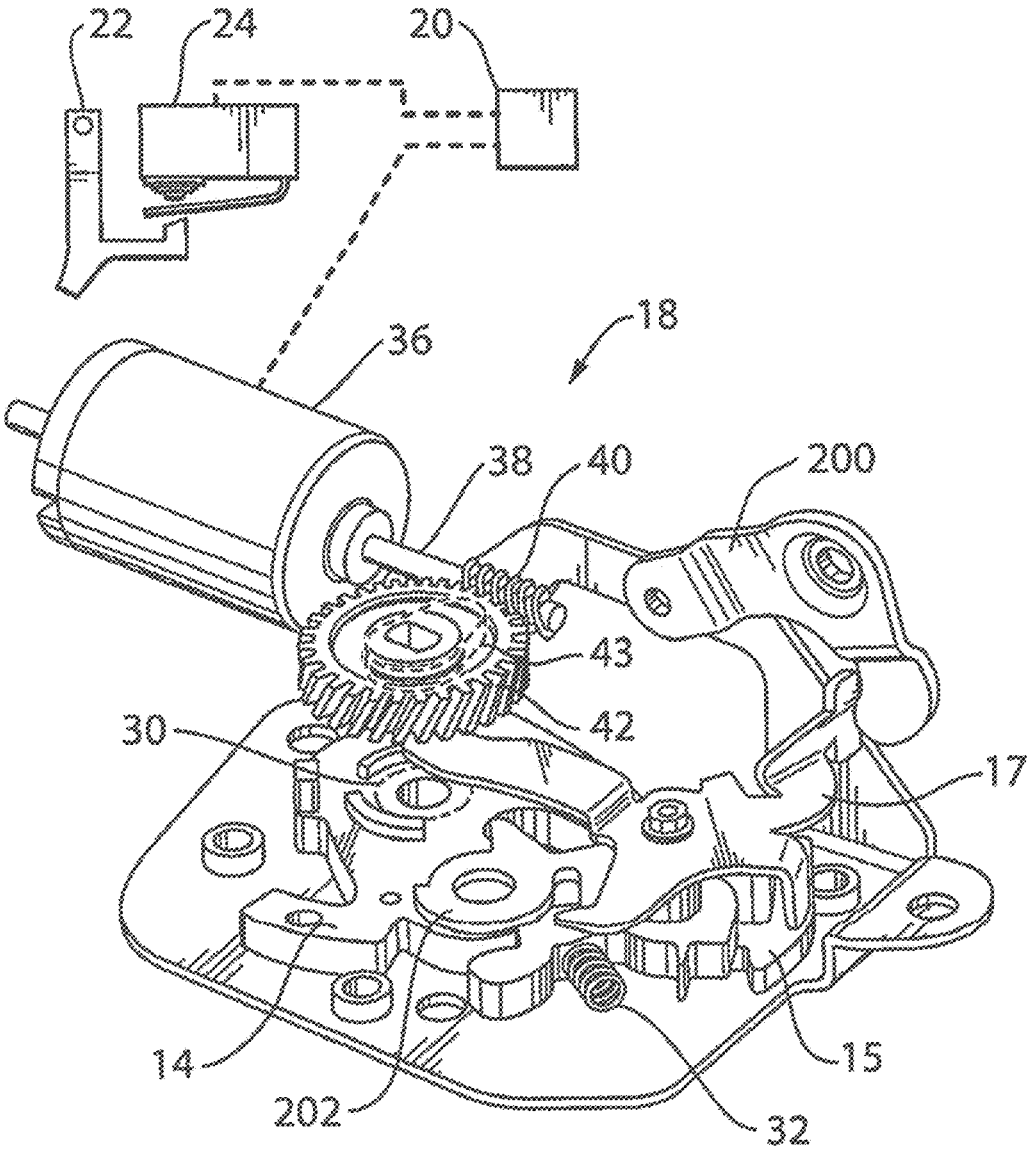
FIG. 3 is a perspective view of a second embodiment of a closure latch assembly.

Another example of a configuration for the closure latch assembly 13 for a front door application is shown in FIG. 3. The closure latch assembly 13 in FIG. 3 may include a power lock mechanism (not shown) that has a locked state and an unlocked state, and that does not have a child-locked state. In the locked state, the power lock mechanism disables the outside door handle 22. In the unlocked state, the power lock mechanism permits actuation of the pawl release lever 17 by the outside door handle 22 through the power release actuator 18. The closure latch assembly 13 in FIG. 3 may lack a double-pull override feature, permitting instead the direct actuation of the pawl release lever 17 by the inside release lever, shown at 200, without regard as to whether or not the lock (not shown) is in the locked state. Optionally, the vehicle door 900 may include a key lock, which includes a key cylinder that is rotated using a key. In such an instance, an outside door release lever 202 may be provided, which is mechanically connected to the pawl release lever 17 and which is itself mechanically actuated by rotation of the key cylinder.

The closure latch assembly 13 can be configured to provide two lock states instead of three. For example, in a front door application, the closure latch assembly may have a double-locked state and an unlocked state. In such a configuration, the override member 10 is not needed and may be omitted, because in the double-locked state, the inside door release lever 1 cannot be used to override the power lock mechanism 27. Furthermore, the closure latch assembly 13 may be configured so that the unlocked state represents a limit of travel for the PL gear 56 instead of corresponding to an intermediate position between two travel limits. As a result, the lock motor 11 can be rotated in a first direction until the lock motor 11 stalls to move the lock to the double-locked state, and can be rotated in a second direction until the motor 11 stalls to move the lock to the unlocked state.

In yet another variation, the closure latch assembly 13 may be used in a front door application with two lock states: locked and unlocked, wherein the double pull override feature is provided as a way of moving the power lock mechanism 27 out of the locked state. In this variation, the override member 10 is provided and can is engageable by the inside release lever 1 to bring the closure latch assembly 13 to the unlocked state, so that a subsequent actuation of the inside release lever 1 will open the closure latch assembly 13. The unlocked state can, in this variation, be at one limit of travel for the PL gear 56, while the locked state can be at the other limit of travel for the PL gear 56, so that when the lock motor 11 is used to change the lock state, the PL gear 56 is moved in one direction or the other until the motor 11 stalls.

Reference is now made to FIGS. 5 through 10, which show another embodiment of a closure latch assembly 300. In this embodiment, elements that are similar to elements shown in FIGS. 1-4 are provided with similar reference numbers. For example, element 301 is similar to element 1 in FIGS. 1-4; element 302 is similar to element 2 in FIGS. 1-4; element 311 is similar to element 11 in FIGS. 1-4, and so on. The closure latch assembly 300 is similar to the closure latch assembly 13, but incorporates fewer components which may provide reduced complexity and cost and increased reliability. The closure latch assembly 300 generally includes a latch mechanism, a latch release mechanism, a power release mechanism, an inside door release mechanism, and a power lock mechanism with a double pull manual release function. The latch mechanism includes a ratchet 314 and a pawl 315 which may be similar to the ratchet 14 and pawl 15 (FIG. 1), and which may be biased by a ratchet biasing member and a pawl biasing member respectively, which may be similar to the ratchet and pawl biasing members in FIGS. 1-4. The ratchet biasing member is obscured from view in FIGS. 5A and 5B, however, the pawl biasing member is shown at 322 in FIG. 5B.

Figure 5A:
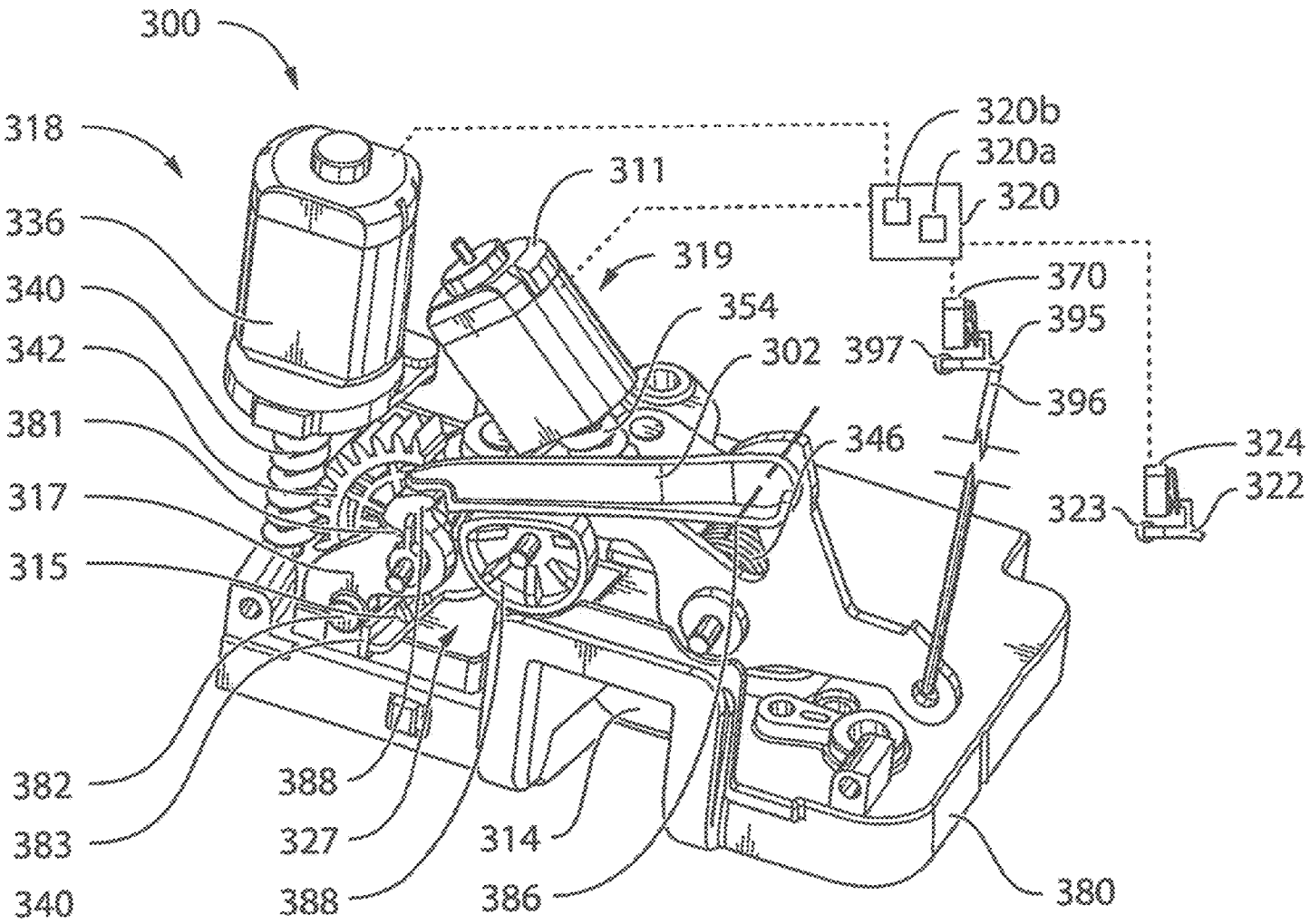
FIGS. 5A and 5B are perspective views of a fourth embodiment of a closure latch assembly and FIGS. 5C and 5D are partial perspective views of the closure latch assembly shown in FIG. 5B.
Figure 5B:
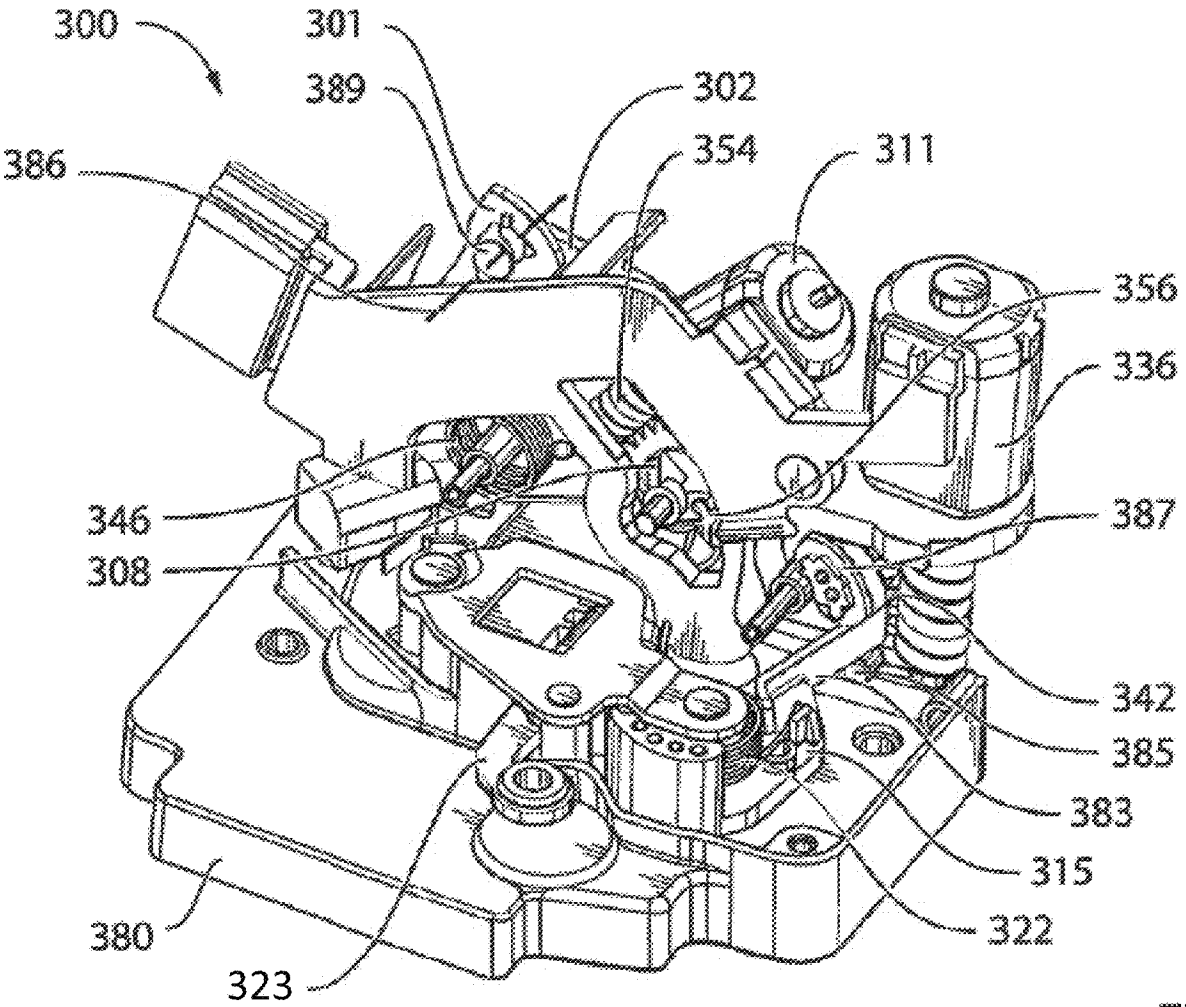
Figure 5C:
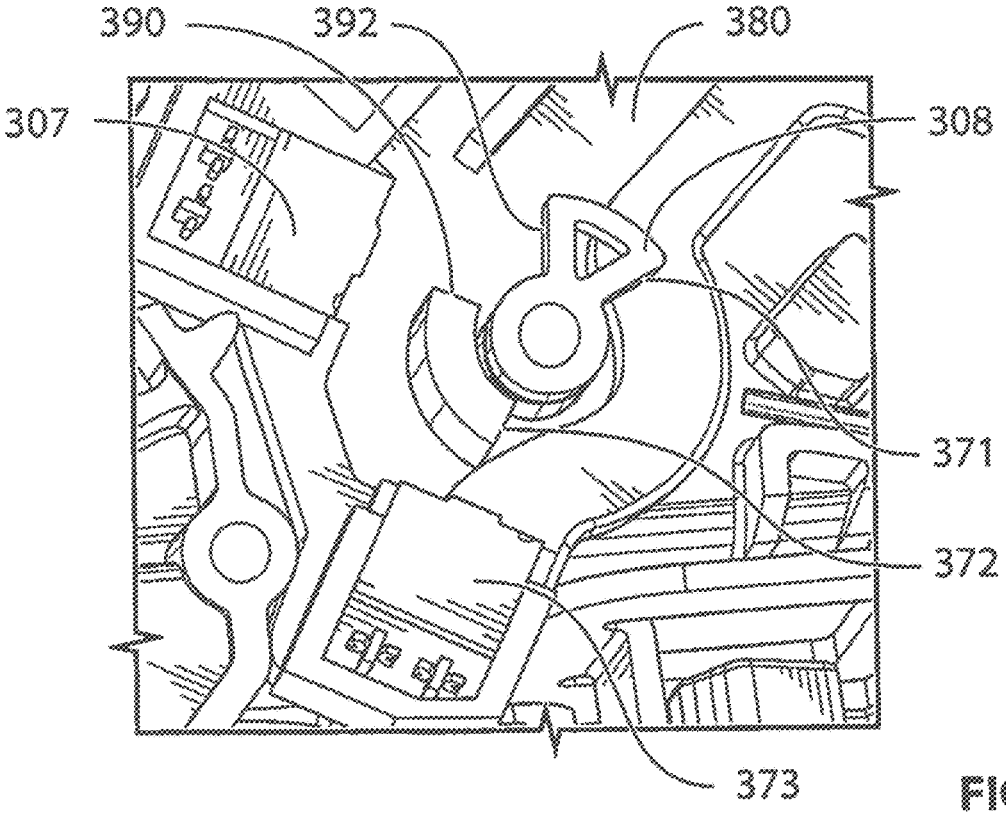
Figure 5D:
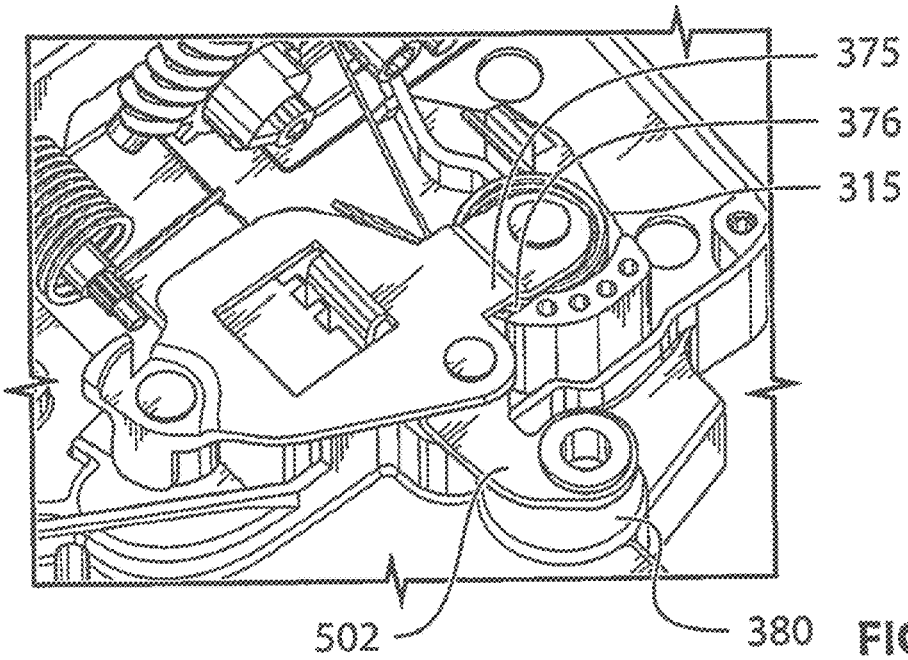

The latch release mechanism includes a pawl release lever 317 which is generally similar to pawl release lever 17 (FIG. 1). The pawl release lever 317 is pivotable between a home position and a pawl release position (FIG. 9) by any one of several elements, including an inside release lever 301 associated with the inside door release mechanism via a lock link 302 associated with the power lock mechanism, a power release mechanism 318, and an outside door release lever 502 (FIG. 5B). Pivoting of the pawl release lever 317 from its home position (FIG. 6) to its pawl release position (FIG. 9) causes a pawl release arm 382 on lever 317 to engage a lever receiving arm 383 on the pawl 315 and to drive the pawl 315 to the ratchet releasing position. In the views shown in FIGS. 6-10, the pawl release lever 317 pivots counterclockwise to reach the pawl release position. The pawl release lever 317 is biased towards the home position by a pawl release lever biasing member 381.

In a similar manner to the power release mechanism 18 in FIG. 1, the power release mechanism 318 (FIGS. 5A and 5B) includes a power release motor 336 with an output shaft having a worm 340 thereon. The worm 340 rotates a worm gear 342 (hereinafter referred to as a PR gear) which has a pawl drive surface 385 (FIG. 5B) thereon that is engageable with the lever receiving arm 383 on the pawl 315. The PR gear 342 is rotatable by the motor 336 (via the worm 340) between a home position (FIG. 6) and a pawl release position in which the PR gear 342 drives the pawl 315 to the ratchet releasing position. An ECU 320 controls the operation of the motor 336. The PR gear 342 is biased toward the home position by a PR gear biasing member 387 (FIG. 5B). It will be noted that during this movement, the PR gear 342 backdrives the worm 340. To permit this, the worm 340 has a thread angle that makes the worm 340 backdrivable.

As noted, the inside door release mechanism includes the inside release lever 301. The inside release lever 301 is movable (e.g. by a counterclockwise pivoting movement in the view shown in FIG. 6) from a home position (FIG. 6) to an actuated position (FIG. 7), and is biased towards the home position by an inside release lever biasing member 346. The inside release lever 301 is actuated by an inside door handle 395 (e.g. via a cable 396) as shown in FIGS. 5A and 7. The inside door handle 395 is movable (e.g. pivotable) between a home position (FIG. 5A) and an actuated position (FIG. 7) wherein the door handle 395 brings the inside release lever 301 to the actuated position. The door handle 395 may be biased towards the home position by an inside door handle biasing member 397.

The inside door handle 395 has an inside door handle state switch 370 associated therewith. The state switch 370 has a first state, (e.g. off) when the inside door handle 395, and therefore the inside release lever 301, is in the home position. The state switch 370 has a second state, (e.g. on) when the inside door handle 395, and therefore the inside release lever 301, is in the actuated position. Thus the state of the state switch 370 is indicative of the position of both the inside handle 395 and of the inside release lever 301. As such, the inside handle state switch 370 may also be referred to as an inside door release lever state switch 370. In an alternative embodiment, the state switch 370 may be positioned so as to be engaged by the door release lever 301 instead of being engaged by the inside door handle 395.

An outside door handle 322 is provided and is movable (e.g. by a counterclockwise pivoting movement) from a home position (FIG. 5A) to an actuated position, and is biased towards the home position by an outside door handle biasing member 323. The outside door handle 322 has an outside door handle state switch 324 associated therewith. The state switch 324 has a first state, (e.g. off) when the outside door handle 322 is in the home position, and a second state, (e.g. on) when the outside door handle 322 is in the actuated position. Thus the state of the state switch 324 is indicative of the position of the outside door handle 322.

The ECU 320 (FIG. 5A) includes a processor 320*a* and a memory 320*b* that stores data used by the processor 320*a* during operation of the latch 300. The ECU 320 may be programmed in any suitable way to carry out operation of the latch 300 as described herein. The ECU 320 receives signals from the outside door handle state switch 324 and from the inside door handle state switch 370 and uses these signals to control the operation of the power release motor 336, depending on what mode the ECU 320 is in. The ECU 320 is operable to be in a locked state (which may be referred to as a 'single-locked' state, or a first locked state, an unlocked state, and a second locked state. In the unlocked state, the ECU 320 causes actuation of the power release motor 336 upon receipt of an indication that either of the inside or outside door handles 395 or 322 has been actuated.

In the locked state, the ECU 320 ignores signals from both the inside and outside door handle state switches 370 and 324 and as a result actuation of the inside or outside door handles 395 or 322 does not result in opening of the vehicle door 900. In some embodiments, actuation of the inside door handle 395 a first time may signal the ECU 320 to change states from a locked state to an unlocked state. Alternatively, actuation of the inside door handle 395 a first time may signal the ECU 320 to change states from a locked state to an inside door handle unlocked state, wherein the ECU 320 continues to ignore signals from the outside door handle 322 but would actuate the power release motor 336 upon a second actuation of the inside door handle 395. In yet another alternative, actuation of the inside door handle 395 may not cause the ECU 320 to leave the locked state and thus the ECU 320 when in the locked mode may continue to ignore signals indicative of actuation of both the inside and outside door handles 395 and 322.

The second locked state may correspond for example, to a double locked state in embodiments wherein the closure latch assembly 300 is installed in a front door of a vehicle, or for example, to a child locked state in embodiments wherein the closure latch assembly 300 is installed in a rear door of a vehicle. If the ECU 320 is in a double locked state, the ECU 320 ignores signals from the state switches 370 and 324 that are indicative of the actuation of the inside and outside door handles 395 and 322 and may continue to do so until the ECU 320 changes to a different state. If the ECU 320 is in a child locked state, an initial actuation of the inside and outside door handles 395 and 322 does not result in the actuation of the power release motor 336. However, ECU 320 may be programmed such that, upon receipt of an initial actuation of the inside door handle 395, the ECU 320 may change to an outside unlocked state whereby actuation of the inside door handle 395 would not result in actuation of the motor 336, but actuation of the outside door handle 322 would result in the actuation of the motor 336 thereby opening the closure latch assembly 300 and the vehicle door 900.

A power lock mechanism 327 is provided and is operable to prevent or permit mechanical actuation of the pawl release lever 317. The power lock mechanism 327 includes, among other things, a lock link 302, a single cam arrangement having a lock link cam 306, and a power lock actuator 319. The lock link 302 is movable between an unlock position shown in FIG. 8 and a lock position shown in FIG. 6. In the unlock position, the lock link 302 operatively connects the inside release lever 301 to the pawl 315 (via the pawl release lever 317). In the lock position, the lock link 302 operatively disconnects the inside release lever 301 from the pawl 315. The movement of the lock link 302 may be a pivoting movement about a pivot axis about which the lock link 302 may be pivotally connected to the inside release lever 301. The lock link 302 is biased towards the unlock position by a lock link biasing member which may be a portion 389 (shown in FIG. 5B) of the inside release lever biasing member 346.

Figure 7:
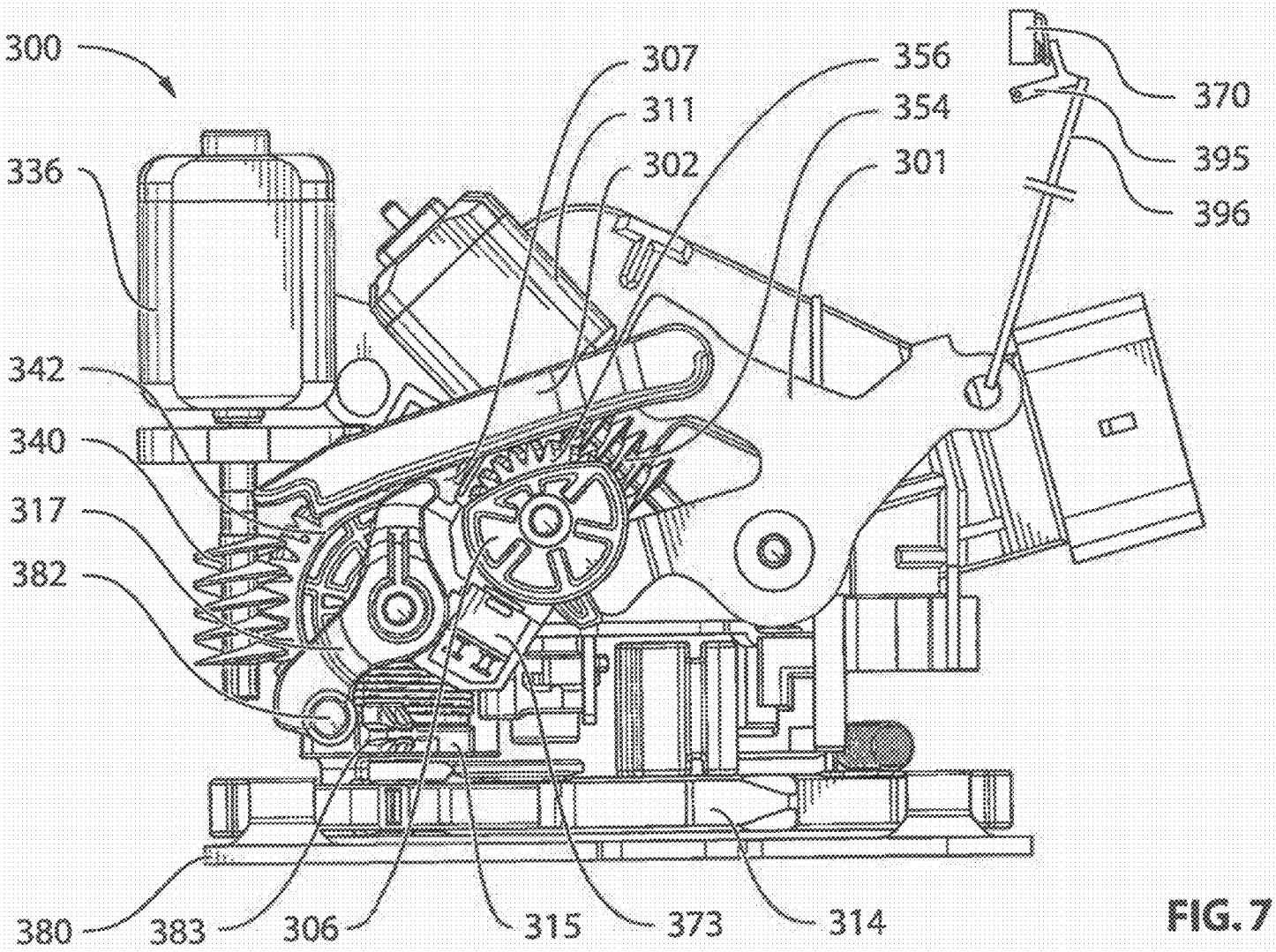
FIG. 7 is an elevation view of the closure latch assembly shown in FIG. 5A, maintained in the locked state as an inside door handle is actuated.
Figure 8:
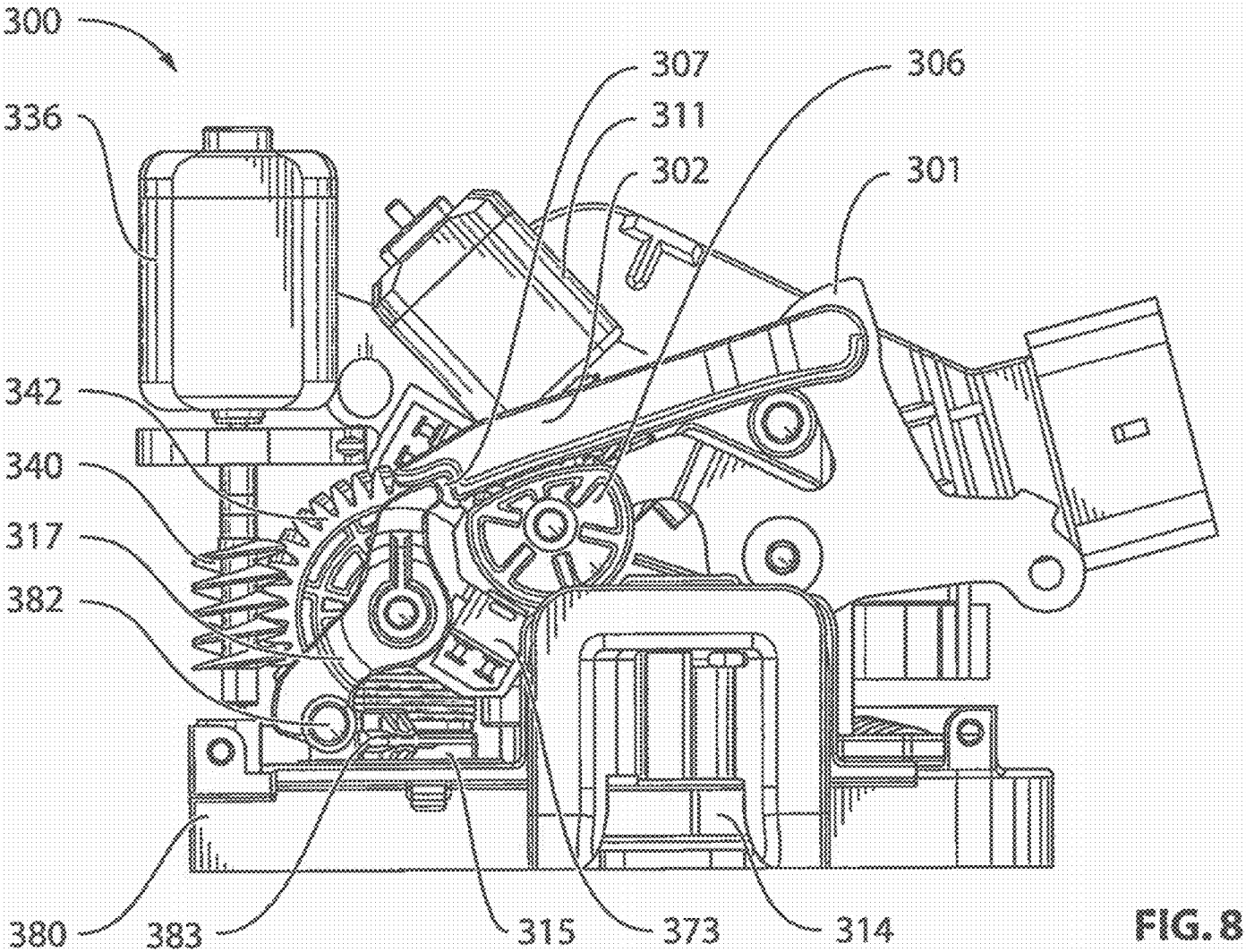
FIG. 8 is an elevation view of the closure latch assembly shown in FIG. 5A in an unlocked state.
Figure 9:
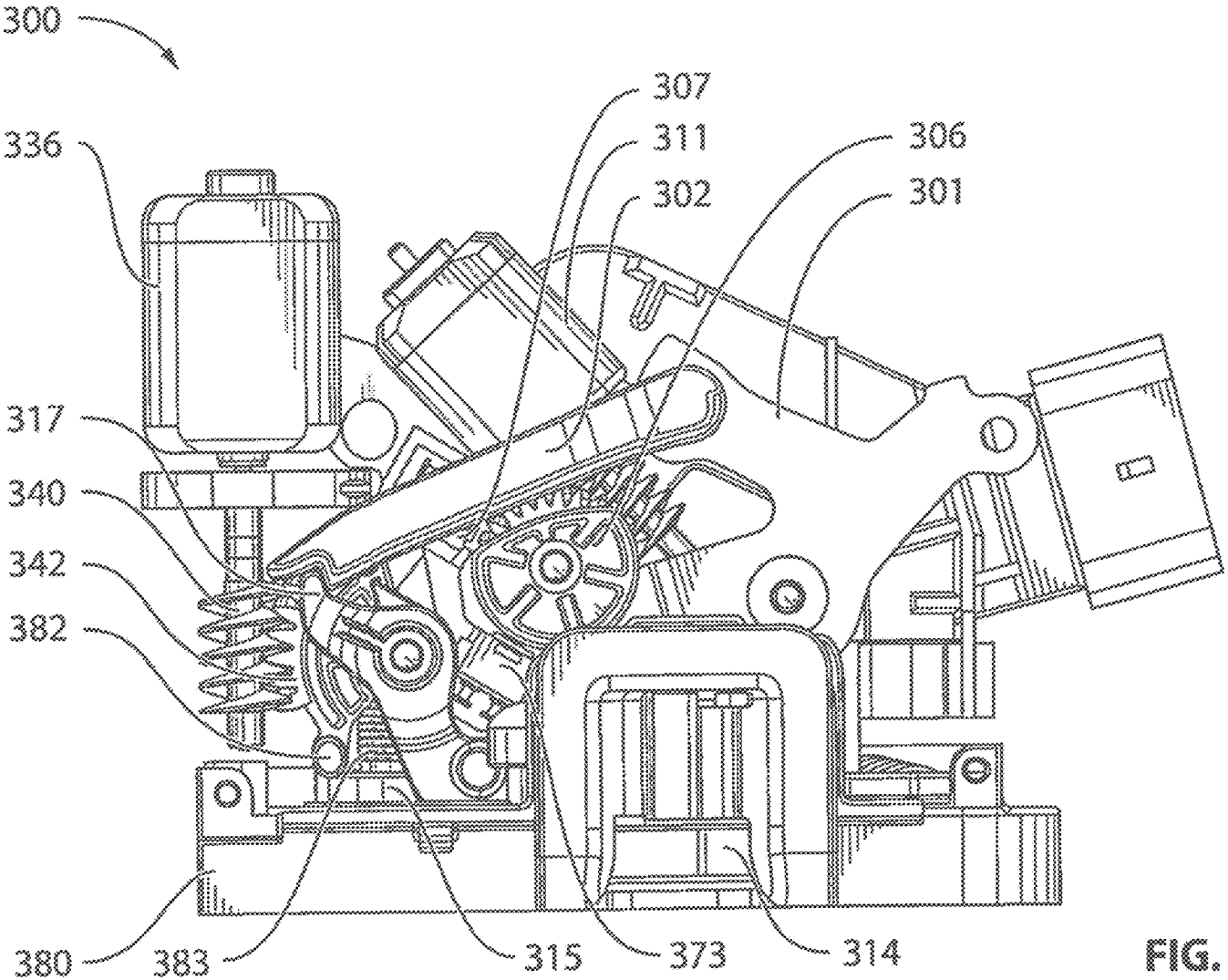
FIG. 9 is an elevation view of the closure latch assembly shown in FIG. 5A in an actuated state so as to permit opening of a vehicle door.

The inside release lever 301 pivots (counterclockwise in the views shown in FIGS. 6-10) from the home position (shown in FIG. 6) to the actuated position, thereby driving the lock link 302 to translate to the left in the views shown in FIGS. 6-10. Specifically, if the lock link 302 is in the unlock position (FIG. 8), actuation of the release lever 301 drives a receiver notch formed on an end of the lock link 302 into a lock link receiving surface 388 formed on the pawl release lever 317, thereby driving the pawl release lever 317 to the pawl release position (FIG. 9). In contrast, if the lock link 302 is in the lock position (FIG. 6), actuation of the release lever 301 drives the lock link 302 to the left in the view shown in FIGS. 6-10, but above the pawl release lever 317 (FIG. 7) such that the lock link 302 does not drive the pawl release lever 317 to the pawl release position.

The lock link cam 306 is provided to control the position of the lock link 302 between the locked and unlocked positions. The lock link control cam 306 is moveable between a first locking position (shown in FIG. 6), an unlocking position (shown in FIG. 8) and a second locking position (shown in FIG. 10). In the unlocking position shown in FIG. 8, the lock link control cam 306 permits the lock link 302 to drive the pawl release lever 317 to the pawl release position as a result of actuation of the inside release lever 301, thereby unlatching and releasing the closure latch assembly 300 so as to allow the vehicle door 900 to be opened. When the lock link control cam 306 is in the unlocking position, the power lock mechanism 327 is in an unlocked state.

When the lock link control cam 306 is in the first locking position, the control cam 306 moves the lock link 302 to the lock position and thereby prevents the lock link 302 from driving the pawl release lever 317 to the pawl release position. However, when the lock link cam 306 is in the first locking position, a cam drive surface 398 on the inside release lever 301 is engageable with an override member 310 that is connected to the lock link control cam 306, thereby operatively connecting the inside release lever 301 with the lock link control cam 306. The override member 310 may be said to be in an actuatable position. As a result, movement of the inside release lever 301 to the actuated position (FIG. 7) drives the lock link control cam 306 to the unlocking position. While the release lever 301 remains actuated, the lock link 302 extends above the pawl release lever 317 and is prevented by the pawl release lever 317 itself from moving to the unlock position under the urging of the lock link biasing member 386. Once the inside release lever 301 is returned to the home position (FIG. 8), the lock link 302 retracts sufficiently that the pawl release lever 317 no longer obstructs pivotal movement of the lock link 302, and thus the lock link biasing member 386 moves the lock link 302 to the unlock position. Thus, as a result of a first or initial actuation of the inside door release lever 301 the power lock mechanism 327 is in the unlocked state. As a result, a subsequent second actuation of the inside door release lever 301 opens the closure latch assembly 300 and the vehicle door 900.

Figure 10:
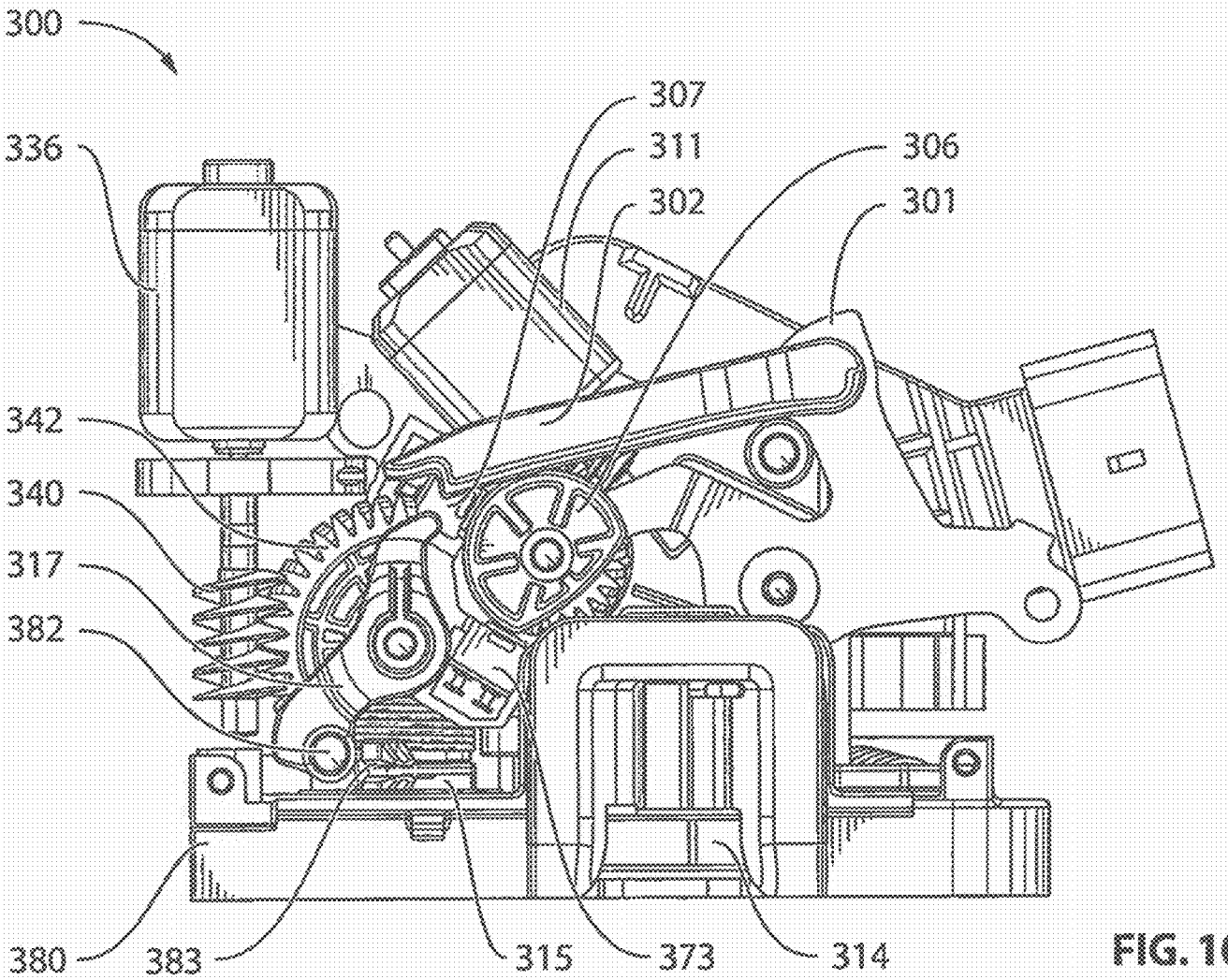
FIG. 10 is an elevation view of the closure latch assembly shown in FIG. 5A in a second locked state.

The second locking position the lock link control cam 306, shown in FIG. 10, may, for example, be a double locking position or a child locking position. When the lock link control cam 306 is in the second locking position, the override member 310 is in a non-actuatable position and so the cam drive surface 398 on the inside release lever 301 cannot actuate the override member 310 and is thus operatively disconnected from the lock link control cam 306. As a result, movement of the inside door release lever 301 to the actuated position produces no effect on the lock link control cam 306.

The power lock actuator 319 includes a lock motor 311 that drives a worm 354 that, in turn, drives a power lock worm gear 356 (hereafter referred to as a PL gear). The PL gear 356, in turn, is directly connected to and drives the lock link control cam 306. To reach the first locking position, the lock motor 311 drives the rotation of the lock link control cam 306 in a first direction (counterclockwise in the view shown in FIG. 6) until the lock motor 311 stalls as a result of engagement of a first limit surface 390 (FIG. 5B) on the lock link control cam 306 with a first limit surface 392 (FIG. 5C) on the housing (shown at 380).

As noted above, movement of the inside release lever 301 to the actuated position (FIG. 7) drives the lock link control cam 306 from the first locking position to the unlocking position. It will be noted that during this movement, the lock link control cam 306 backdrives the PL gear 356 and the worm 354. To permit this, the worm 354 has a thread angle that makes the worm 354 backdrivable.

Figure 6:
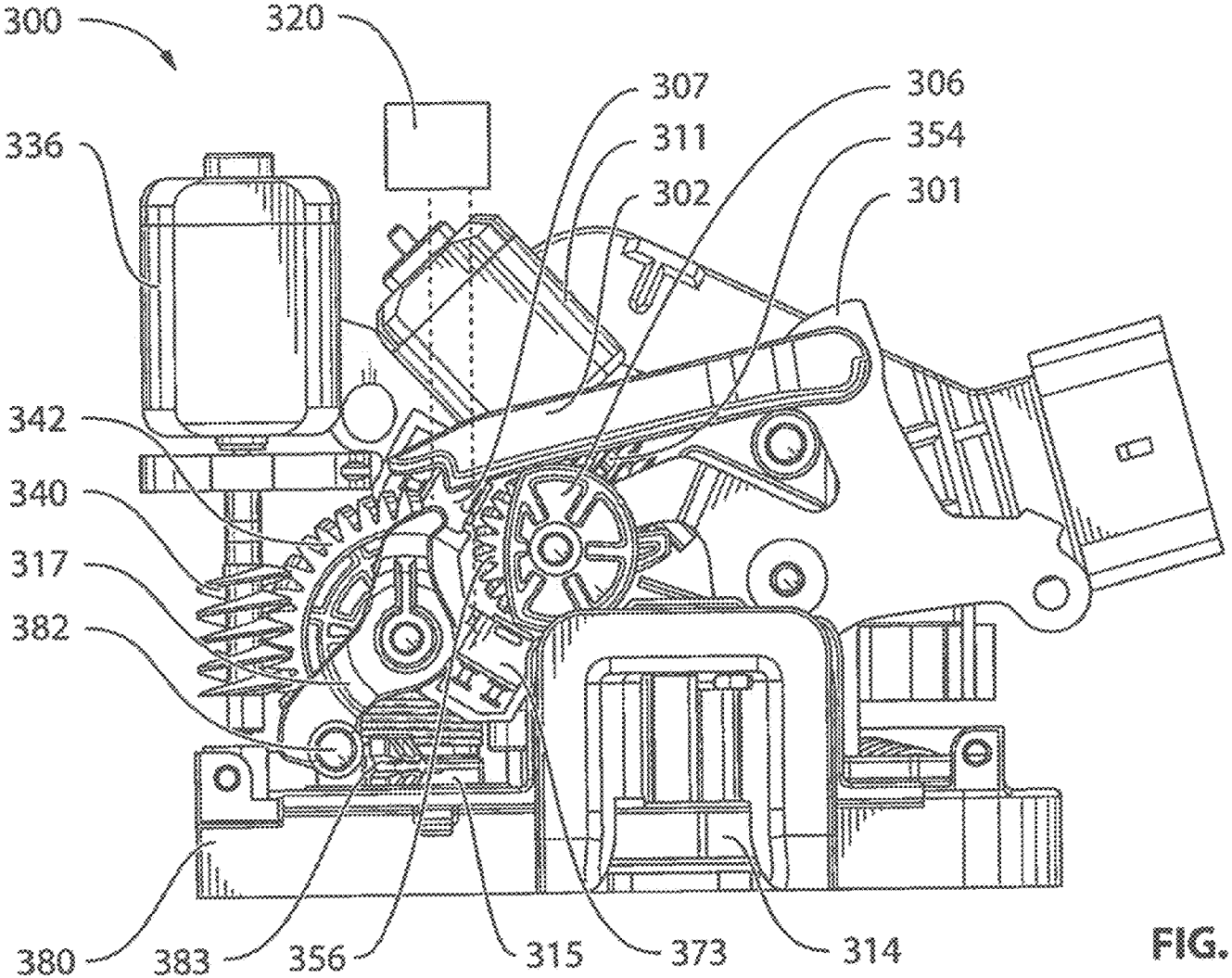
FIG. 6 is an elevation view of the closure latch assembly shown in FIG. 5A in a locked state.

When the lock link control cam 306 is in the first locking position shown in FIG. 6, a first switch 307, which may be a first locking position state switch 307, is closed by engagement with a state switch cam 308 that co-rotates with the control cam 306. The ECU 320 receives signals from the first locking position state switch 307 indicative of the state of the switch 307. The closing of the first locking position state switch 307 by the state switch cam 308 indicates to the ECU 320 that the closure latch assembly 300 is in a locked state, and as a result, the ECU 320 enters the locked state as described above.

As can be seen in FIG. 8, when the lock link control cam 306 is in the unlocking position, the position of the state switch cam 308 is away from the state switch 307 and, as a result, the switch 307 is off (i.e. open). Thus, the ECU 320 determines that the lock link control cam 306 is in the unlocked position, and as noted above, can enter an inside unlocking state, an unlocked state or the ECU 320 can remain in the locked state.

To reach the second locking position, reversal of the current to the lock motor 311 drives PL gear 356 and the lock link control cam 306 in a second direction (clockwise in the view shown in FIG. 6) until the lock motor 311 stalls as a result of engagement of a second limit surface 371 (FIG. 5B) on a cam segment 308 associated with the lock link control cam 306 with a second limit surface 372 (FIG. 5C) on a portion of the housing 380, as shown in FIG. 10. When the lock link control cam 306 is in the second locking position shown in FIG. 10, the first locking position state switch 307 is open since the state switch cam 308 is unengaged with the switch 307. The closure latch assembly 300 further includes a second switch 373, which may be a second locking position state switch, and which may be closed by engagement with the state switch cam 308 thereby indicating to the ECU 320 that the lock link control cam 306 has reached the second locking position. As a result, the ECU 320 enters the second locked state as described above. Thus, during operation of the closure latch assembly 300, the state switches 373 and 370 together have three states: a first state wherein the first state switch 370 is closed and the second state switch 373 is open indicating that that the power lock mechanism 327 is in the locked state, a second state wherein the first state switch 370 is open and the second state switch 373 is open indicating that the power lock mechanism 327 is in an unlocked state, and a third state wherein the first state switch 370 is open and the second state switch 373 is closed indicating that the power lock mechanism 327 is in a second locked state.

In each of the locked, unlocked, and second locked positions, the lock link control cam 306 is held in each position by engagement between the worm 354 and the PL gear 356. There is no need for a biasing member to bias the lock link control cam 306 towards any particular position.

It will be noted that, regardless of the state of the power lock mechanism 327, the ECU 320 can be put into any of several unlocked states such that actuation of the inside and/or outside door handles 395 and 322 can be used to open the closure latch assembly 300 and the vehicle door. Furthermore, actuation of the pawl release lever 317 by the power release motor 336 takes place without requiring or generating any movement of the lock link 302 or other components of the power lock mechanism 327. As a result, the closure latch assembly 300 can include a passive entry feature such that detection by the ECU 320 of a key fob associated with the vehicle can be used to unlock at least the outside door handle 322 of the closure latch assembly 300 essentially instantaneously, since such unlocking amounts to a change of state of the ECU 320 from the locked state to the unlocked state (or to an outside door handle unlocked state). When the user actuates the outside door handle 322, the power release motor 336 is needed only to actuate the pawl release lever 317 and not any of the components of the power lock mechanism 327 thereby reducing the work that needs carried out by the release motor 336 to open the closure latch assembly 300, which in turn reduces the amount of time that is needed to open the closure latch assembly 300. This can result in less of a wait time by the user of the vehicle before the vehicle door opens after the outside door handle 322 has been actuated.

Referring to FIG. 5B, the outside door release lever 323 is a lever that can be used to mechanically actuate the pawl 315 from outside of the vehicle in situations where such actuation is needed (e.g. in the event of a loss of power to the latch, or failure of the release motor 336). The outside door release lever 323 may be pivoted (clockwise in FIGS. 6-10) by inserting a key into and turning the key cylinder (not shown), thereby driving the pawl 315 to the ratchet release position by engagement of a drive surface 375 on the release lever 323 with a receiving surface 376 on the pawl 315.

As can be seen the closure latch assembly 300 operates without using a lock lever, which reduces the number of components as compared to the closure latch assembly 13 in FIGS. 1-4.

The outside door handles 22 and 322 have been shown in the drawings as being pivotable members that engage limit switches shown at 24 and 324 respectively. It will be understood that the door handles 22 and 322 need not be movable at all, and the switches 24 and 324 could be configured to sense the presence of a user's hand on or near the door handle 22 or 322. For example, the switch could be a proximity sensor, or a suitable type of touch sensor (e.g. a resistive, capacitive or projected capacitive touch sensor).

The ECU 320 has been described as having a locked state, an unlocked state and a second locked state, which could be a child locked state or a double locked state. It will be noted that it is possible for the ECU 320 to be capable of having a child locked state and a double locked state. In other words the closure latch assembly 300 may be configured to three different locked states that can be selected by the user, namely, a locked state wherein the inside and outside door handles 395 and 322 are disabled (but in which the lock link control cam 306 is positioned to permit a mechanical override by the inside door handle 395), a child locked mode wherein the inside and outside door handles 395 and 322 are disabled (but in which a first actuation of the inside door handle 395 brings the ECU 320 to an outside door handle unlocked state wherein actuation of the outside door handle 322 causes the ECU 320 to actuate the power release motor 336 to unlatch and release the closure latch assembly 300 and actuation of the inside door handle 395 does not cause actuation of the power release motor 336), and a double locked state wherein the inside and outside door handles 395 and 322 are disabled and cannot be reenabled by actuation of either handle 395 or 322.

While two switches 307 and 373 are shown to assist the ECU 320 in determining whether the lock link control cam 306 is in a locked state, an unlocked state, or a second locked state, it will be noted that it is possible to provide a structure wherein a single three position switch could be used to indicate to the ECU 320 which state the lock link control cam 306 is in.

With particular reference to FIGS. 12 through 18, another embodiment of a closure latch assembly 400 is shown. Closure latch assembly 400 is generally configured as an alternative version of closure latch assembly 300 of FIGS. 5 through 10, but which is now equipped with a modified power lock mechanism 402. Power lock mechanism 402 includes many common components to those previously described in association with power lock mechanism 327 and, as such, provides similar functions to those functions previously described in detail. However, power lock mechanism 402 is now equipped with a dual cam arrangement configured to assure uninterrupted maintenance of closure latch assembly 400 in its locked/latched mode during the transition between operation of power lock mechanism 402 in its locked state and its child-locked state. Reference can be made to FIGS. 5-10 to recognize the components of the latch mechanism and the inside and outside handle release mechanisms that are not specifically shown in FIGS. 12 through 18 but which are disclosed to be associated with closure latch assembly 400.

Figure 12A:
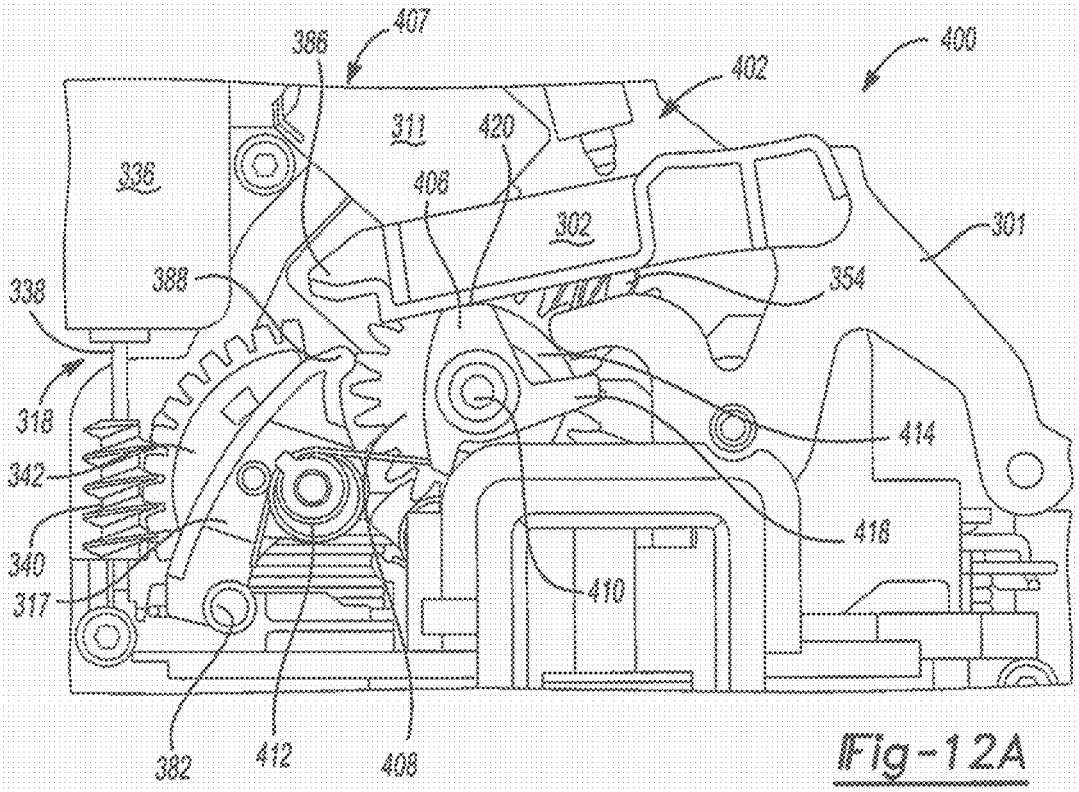
FIGS. 12A is an elevational view of a fifth embodiment of a closure latch assembly equipped with a power-operated lock mechanism having a gear and cam arrangement.

FIG. 12A is an elevational view of the components associated with closure latch assembly 400 and illustrates pawl release lever 317 pivotably moveable between its home position and its pawl release position. As before, pivoting movement of pawl release lever 317 from its home position to its pawl release position causes a pawl release arm 382 on pawl release lever 317 to engage lever receiving arm 383 on pawl 315 so as to forcibly drive pawl 315 from its ratchet holding position into its ratchet releasing position, thereby releasing the latch mechanism. The pawl release lever 317 is biased by pawl release lever spring 381 toward its home position.

Closure latch assembly 400 is again equipped with power release mechanism 318 including power release motor 336 with motor shaft 338 driving worm 340. Worm 340 is meshed with power release (PR) gear 342 which has a drive pawl lug 385 that is engageable with lever receiving arm 383 on pawl 315. PR gear 342 is rotatable by power release motor 336 (via worm 340) between its home position and its pawl release position in which PR gear 342 forcibly drives pawl 315 to move from its ratchet holding position into its ratchet releasing position. ECU 320 controls operation of power release motor 336. PR gear 342 is biased toward its home position by PR gear biasing spring 387.

The inside door release mechanism associated with closure latch assembly 400 also includes inside release lever 301 that is pivotably moveable between its home position and its actuated position. Inside release lever 301 is normally biased toward its home position via an inside release lever spring 346. As previously noted, inside release lever 301 is actuated by inside door handle 395 (FIG. 7) moving from its inside handle home position to its inside handle actuated position, thereby causing corresponding movement of inside release lever 301 from its home position to its actuated position. Inside door handle 395 includes the inside door handle state switch 370 which functions as previously disclosed.

The outside door handle 322 (FIG. 5A) is moveable from its outside handle home position into its outside handle actuated position and is biased toward its outside handle home position via outside handle biasing spring 323. Outside door handle 322 has outside door handle switch 324 associated therewith and which functions as previously disclosed.

Power lock mechanism 402 is shown in FIG. 12A to include, among other things, lock link 302, a dual cam arrangement having a lock cam 406 and a control cam 414, and a power lock actuator 407. Lock link 302 is pivotably mounted to inside release lever 301 and is moveable between its unlock position and its lock position. In the unlock position, lock link 302 operatively connects (i.e. couples) inside release lever 301 to pawl 315 via pawl release lever 317. In the lock position, lock link 302 operatively disconnects (i.e. uncouples) inside release lever 301 from pawl release lever 317. Lock link 302 is biased toward its unlock position via a suitable biasing member, such as for example, tip portion 389 of inside release lever spring 346. When inside release lever 301 pivots in a first direction (i.e. counterclockwise in the drawings) from its home position to its actuated position, lock link 302 is driven to translate to the left in the views shown. With lock link 302 located in its unlock position, actuation of release lever 301 causes a receiver notch 386 formed in the end of lock link 302 to matingly engage a lock link receiving surface 388 formed on pawl release lever 317, thereby driving pawl release lever 317 from its home position into its pawl release position for releasing the latch mechanism. In contrast, if the lock link 302 is located in its lock position, actuation of release lever 301 still drives lock link 302 to the left in the views shown, but lock link 302 is positioned above pawl release lever 317 such that lock link 302 does not engage and drive pawl release lever 317 out of its home position.

Figure 12B:
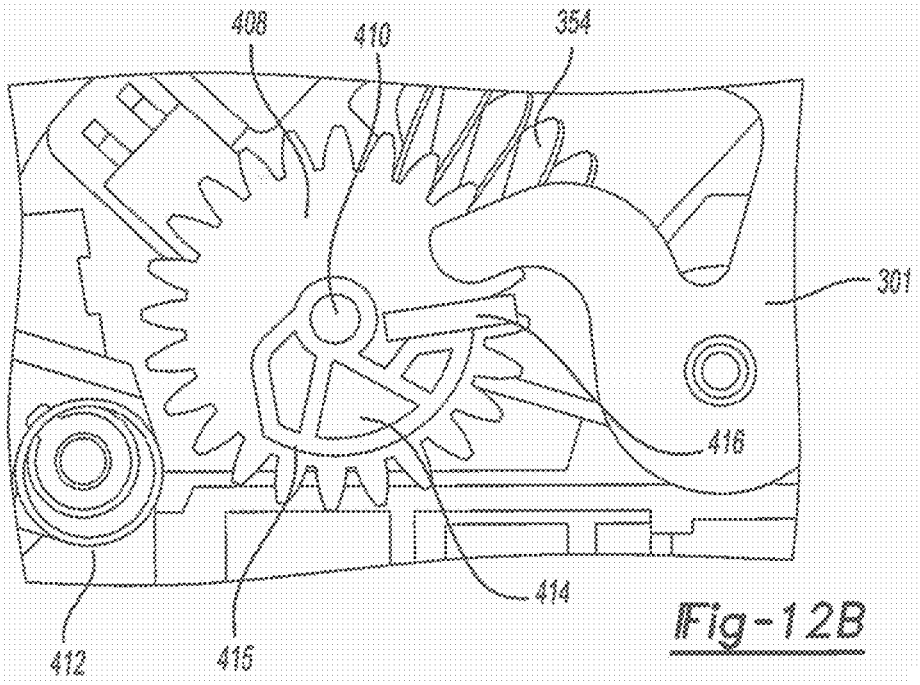
FIG. 12B is a partial elevational view of a lock cam and power lock (PL) gear associated with the gear and cam arrangement.

Power lock actuator 407 is shown in FIG. 12A to generally include an electric lock motor 311 having a motor shaft driving worm 354 that in turn, rotatably drives a power lock (PL) gear 408. PL gear 408 is mounted for rotation about a post 410. As will be detailed, PL gear 408 is rotatable between three (3) distinct gear positions including a first locked position, an intermediate unlocked position, and a second (i.e. child-locked) locked position. PL gear 408 is driven by lock motor 311 between its first and second locked positions. Lock cam 406 is mounted on post 410 for movement between a first or lock position and a second or unlock position. A lock cam toggle spring 412 acts on lock cam 406 and functions to positively locate and retain lock cam 406 in one of its two available positions. Thus, lock cam 406 is moveable relative to PL gear 408. FIG. 12B is a sectioned view illustrating control cam 414 being formed on, or fixed rigidly to, PL gear 408 and its relationship to a drive lug segment 416 formed on an override arm 418 of lock cam 406 and an actuation leg segment 301' formed on inside release lever 301. As will be detailed, control cam 414 is moveable between a child unlock and a child lock position in response to rotation of PL gear 408 between its first and second locked positions.

Figure 13A:
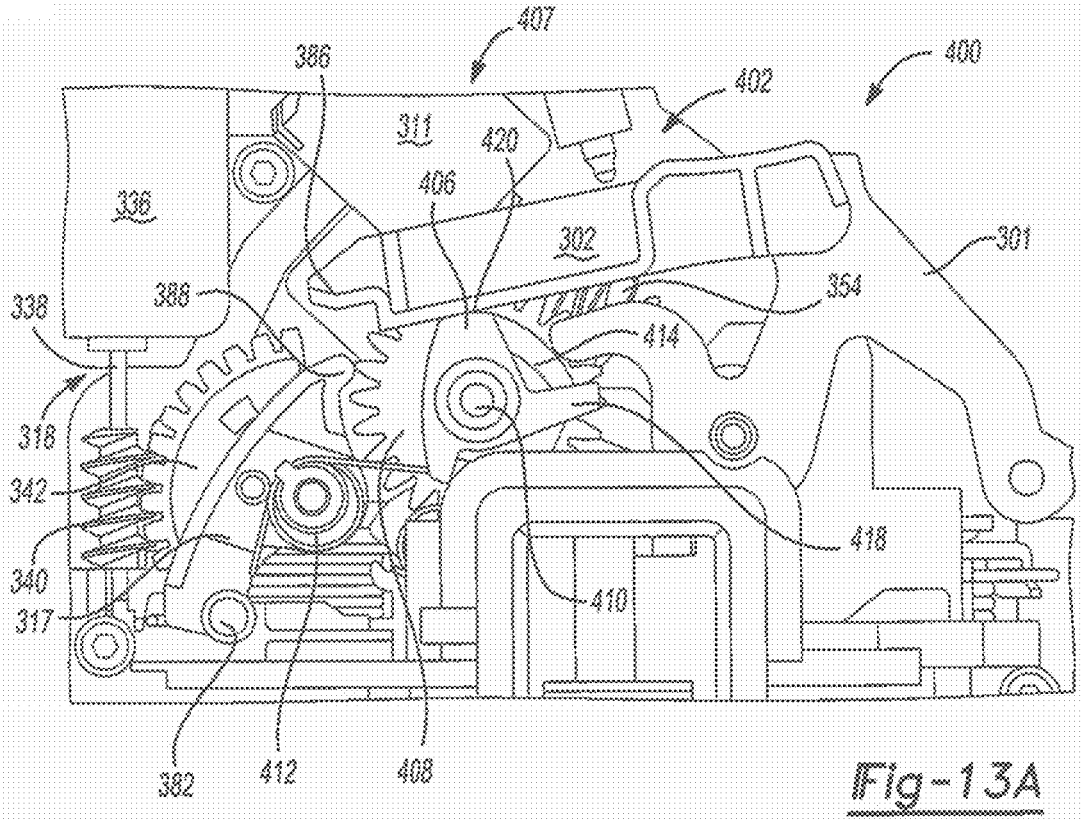
FIGS. 13A and 13B are elevational views of the closure latch assembly shown in FIGS. 12A and 12B operating in a locked state.
Figure 13B:
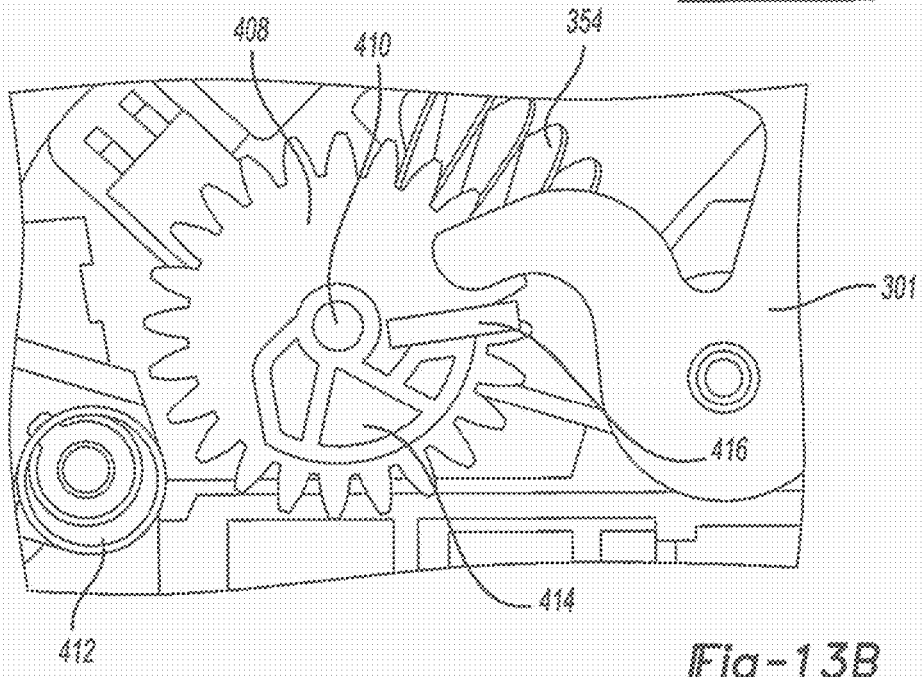

Referring initially to FIGS. 13A and 13B, power lock mechanism 402 is shown operating in its locked state with inside release lever 301 in its home position, pawl release lever 317 in its home position, PL gear 408 located in its first locked position and control cam 414 located in its child unlock position, and lock cam 406 is located in its lock position. With lock cam 406 located in its lock position, its edge profile 420 mechanically engages and holds lock link 302 in its lock position. To locate PL gear 408 in its first locked position from either of its other two positions, PL gear 408 is rotated by PL motor 311 in a first (i.e. counter-clockwise) direction which causes control cam 414 to act on drive lug segment 416 of lock cam 406, thereby rotating lock cam 406 in the first direction into its lock position, as best seen in FIG. 13B.

Figure 14A:
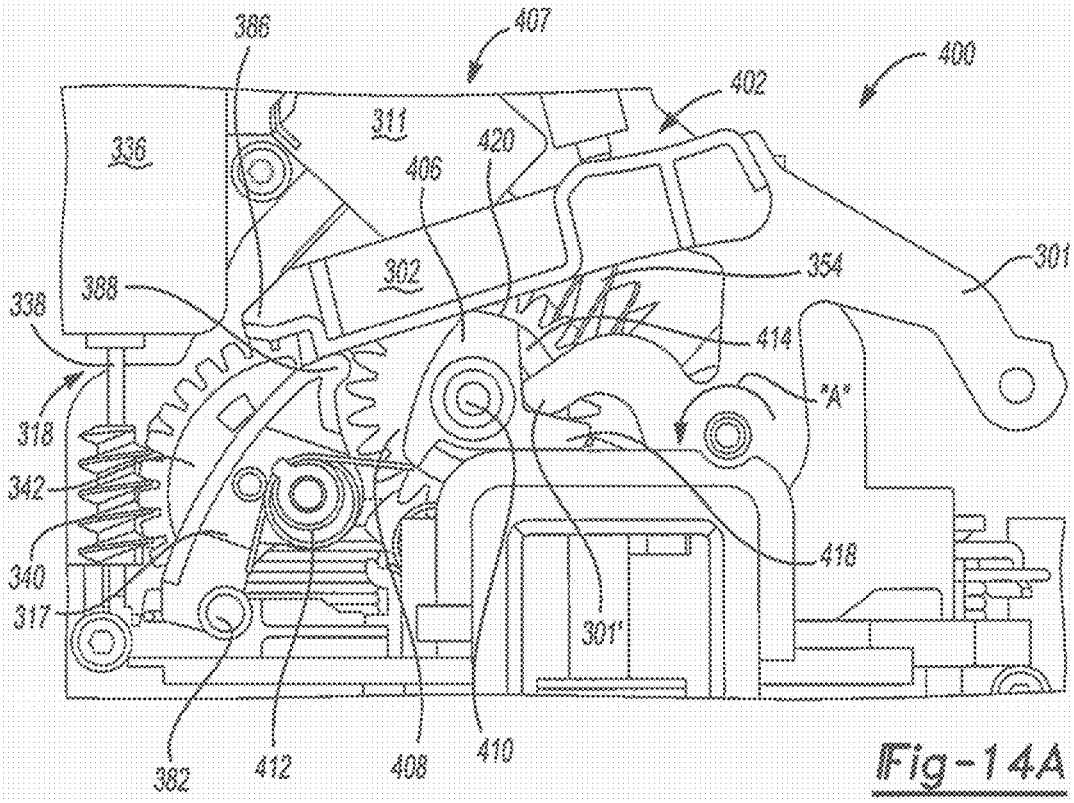
FIGS. 14A and 14B are elevational views of the closure latch assembly shown in FIGS. 12A and 12B maintained in the locked state as an inside door handle is actuated.
Figure 14B:
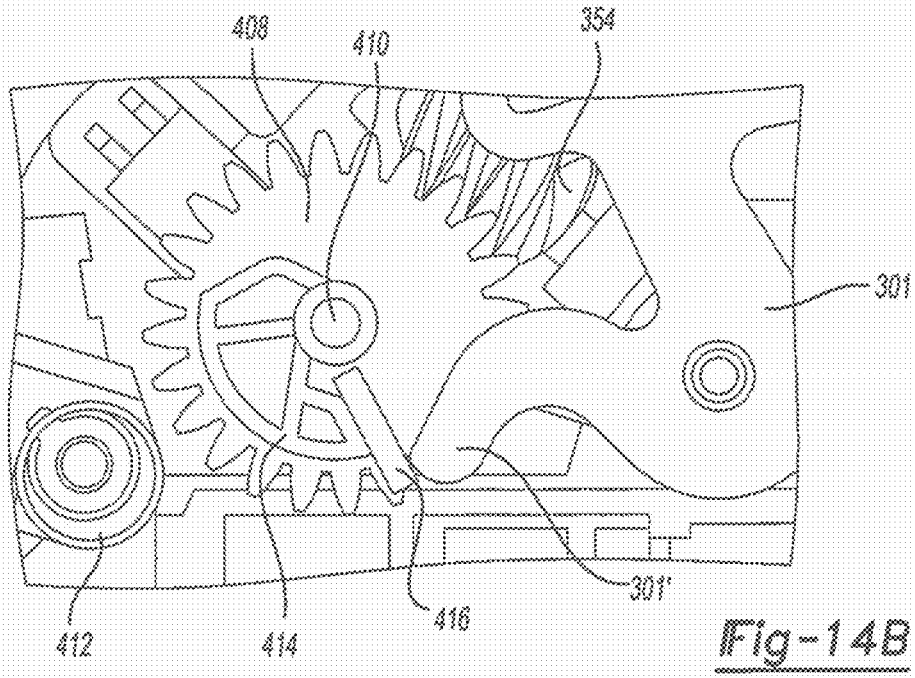

FIGS. 14A and 14B illustrate a first pull of a double pull manual release operation for mechanically shifting power lock mechanism 402 from its locked state into its unlocked state. As seen, inside release lever 301 has been pivoted (via actuation of inside door handle 395) from its home position into its actuated position, as indicated by arrow "A". Since lock link 302 is maintained in its lock position, due to its continued engagement with edge profile 420, movement of inside release lever 301 to its actuated position does not result in lock link 302 engaging and moving pawl release lever 317 which is thereby maintained in its home position. However, this first pull operation causes actuation leg segment 301' on inside release lever 301 to engage override arm 418 such that movement of inside release lever 301 from its home position to its actuated position causes corresponding movement of lock cam 406 from its lock position into its unlock position. Specifically, lock cam 406 rotates about post 410 in a second (i.e. clockwise) direction. Additionally, drive lug segment 416 on override arm 418 acts on an edge portion of control cam 414 so as to also forcibly rotate (i.e. backdrive) PL gear 408 in the second direction from its locked position into its unlocked position while maintaining control cam 414 in its child unlock position, as is best shown in FIG. 14B. Toggle spring 412 acts to hold lock cam 406 in its unlock position.

Figure 15A:
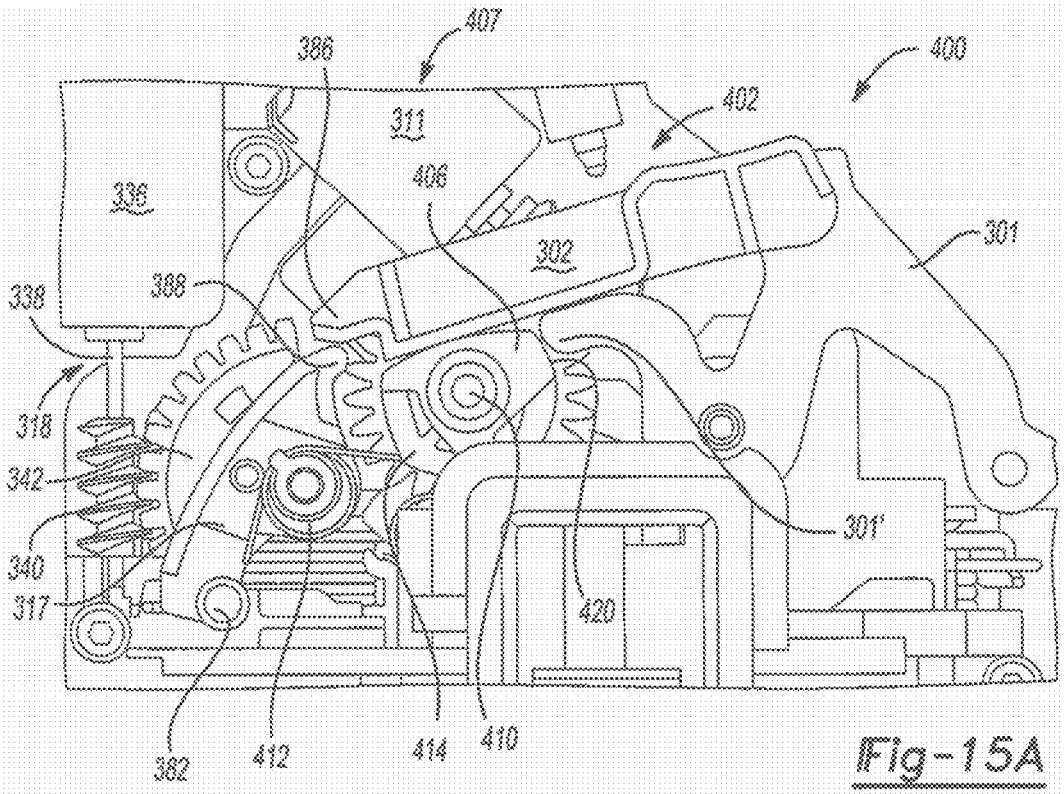
FIGS. 15A and 15B are elevational views of the closure latch assembly shown in FIGS. 12A and 12B operating in an unlocked state.
Figure 15B:
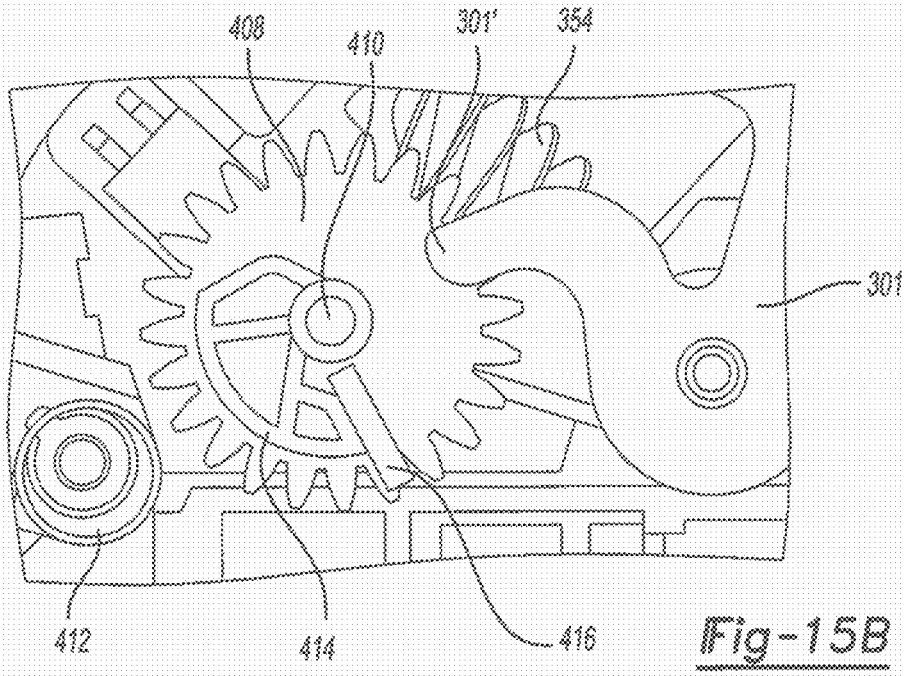

FIGS. 15A and 15B illustrate rotation of inside release lever 301 back to its home position following completion of the first pull operation. As seen, rotation of lock cam 406 to its unlock position permits lock link 302 to pivot into its unlock position upon return of inside release lever 301 to its home position. Note that PL gear 408 is retained in its unlocked position (FIG. 15B). Upon a subsequent second pull associated with the double pull manual release operation, movement of inside release lever 301 to its actuated position causes lock link 302 to engage and forcibly pivot pawl release lever 317 from its home position into its pawl release position, thereby releasing the latching mechanism. To subsequently move PL gear 408 from its unlocked position back to its first locked position, PL gear 408 is rotated in the first direction. Such rotation of PL gear 408 back to its first locked position causes edge portion of control cam 414 to act on drive lug segment 416 of lock cam 406 so as to also move lock cam 406 from its unlock position (FIG. 156B) back into its lock position (FIG. 13B). Again, toggle spring 412 then holds lock cam 406 in its lock position. To subsequently move PL gear 408 from its unlocked position into its second locked position, PL gear 408 is rotated in the second (i.e. clockwise) direction.

Figure 16A:
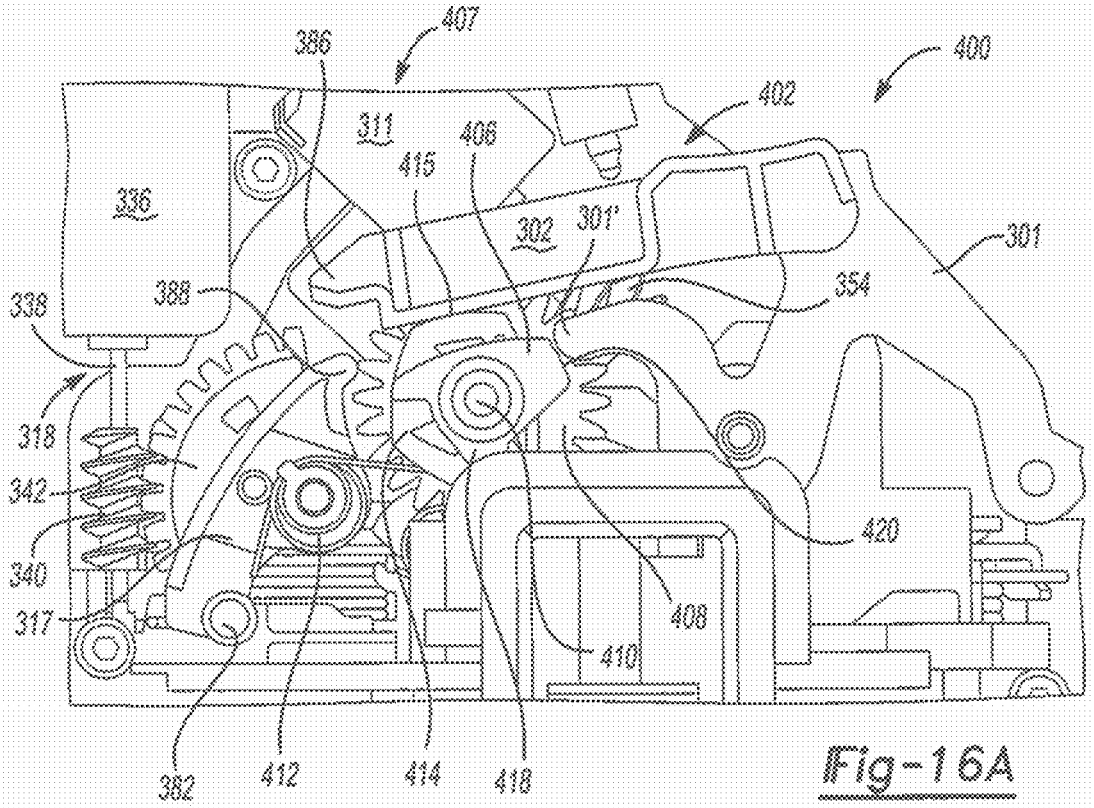
FIGS. 16A and 16B are elevational views of the closure latch assembly of FIGS. 12A and 12B operating in a second or child-locked state with the lock cam located in an unlock position.
Figure 16B:
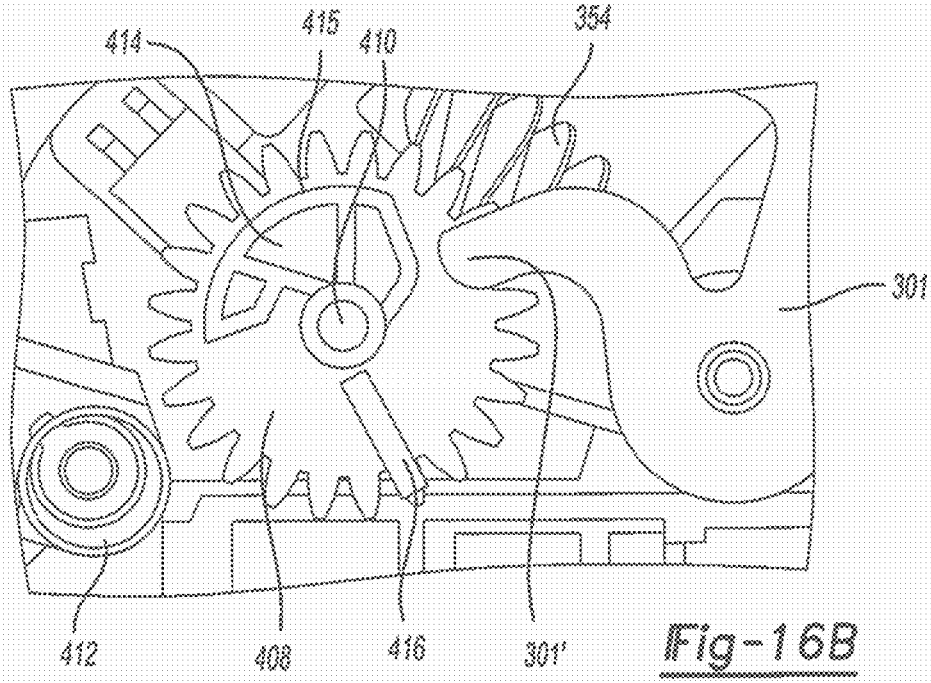
Figure 17A:
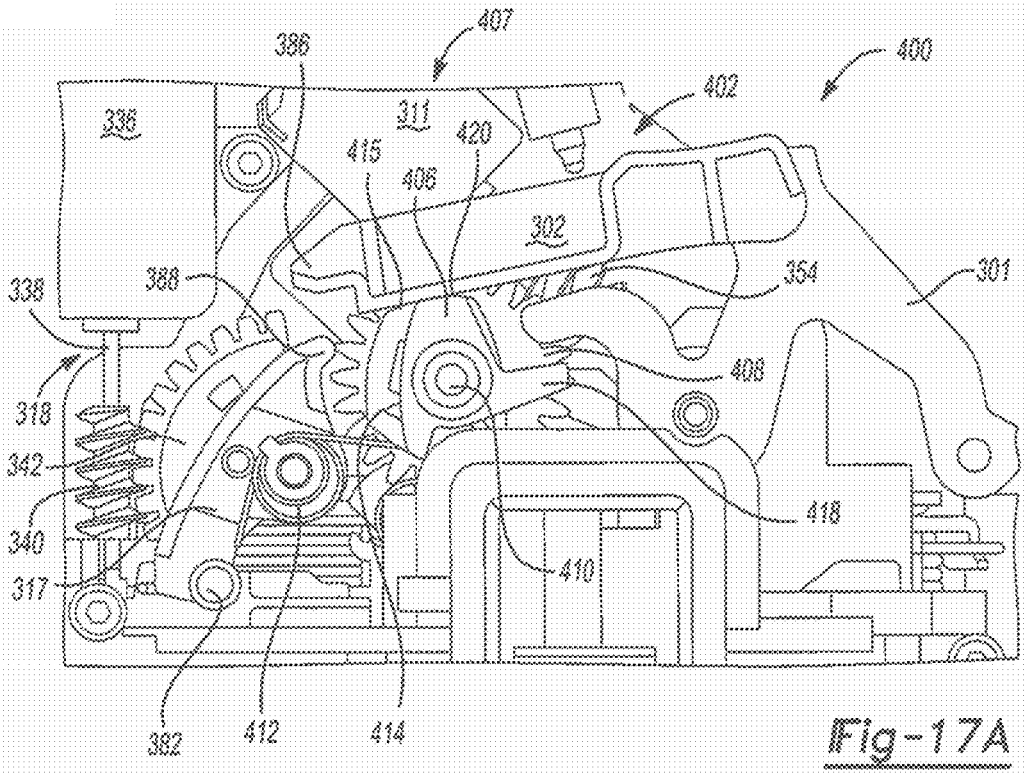
FIGS. 17A and 17B are similar to FIGS. 16A and 16B and illustrate the closure latch assembly operating in the child-locked state with the lock cam located in a lock position.
Figure 17B:
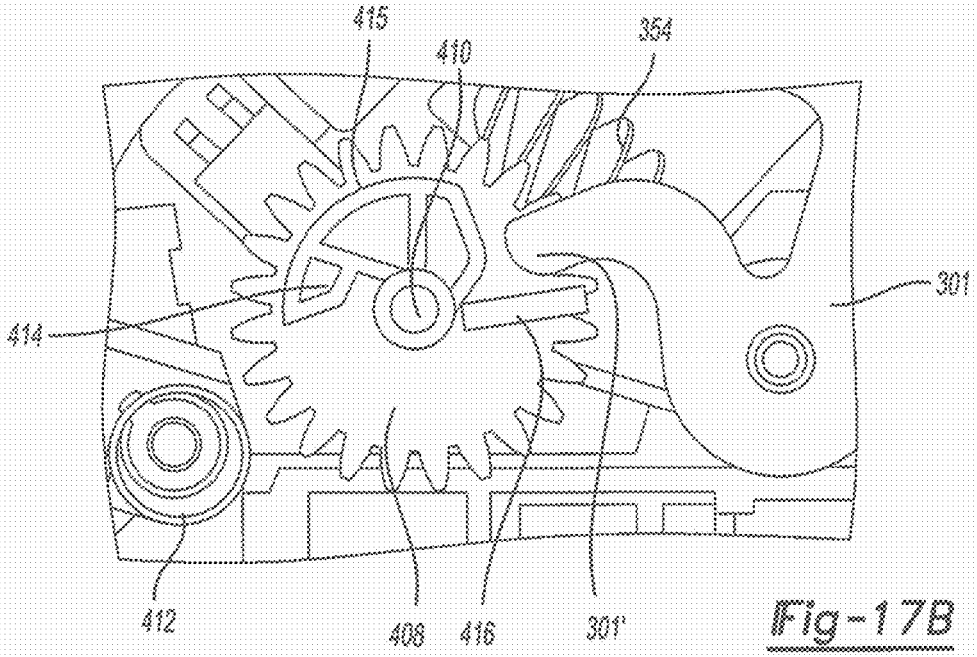
Figure 18:
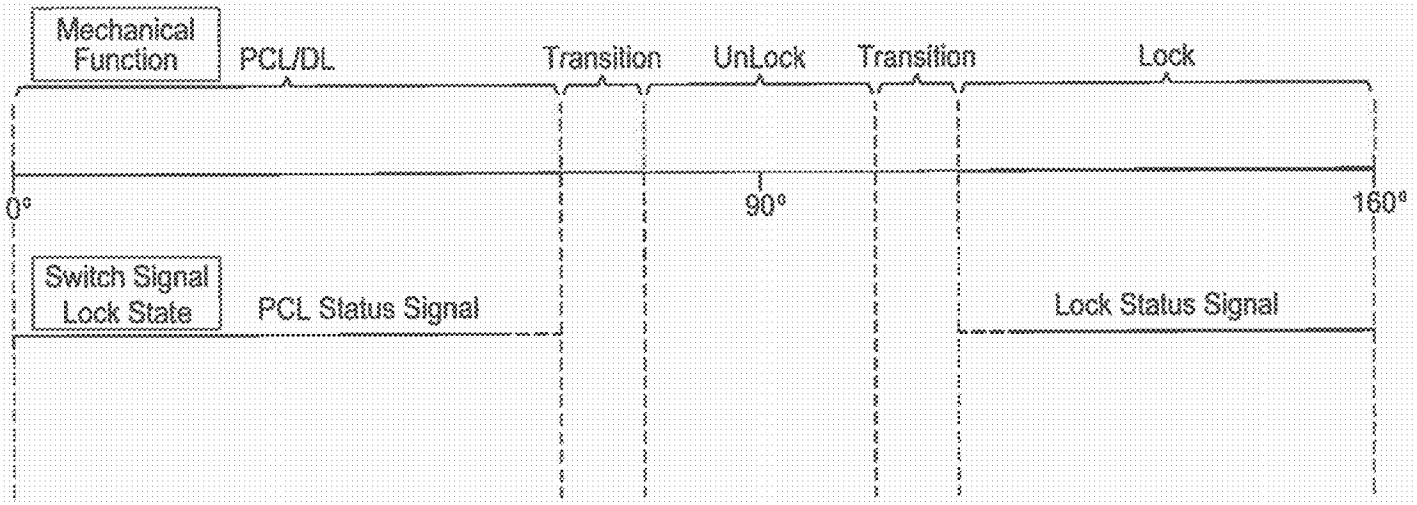
FIG. 18 is a plot of switch states versus function for the three positions of the PL gear associated with the power-operated lock mechanism shown in FIGS. 12A and 12B.

FIGS. 16A and 16B illustrate PL gear 408 rotated in the second direction to its second locked position for locating control cam 414 in its child lock position while lock cam 406 is maintained in its unlock position. Such rotation of PL gear 408 to its second locked position results in movement of lock link 302 to its lock position in response to engagement thereof with a raised cam segment 415 control cam 414. As seen, control cam 414 on PL gear 408 mechanically holds lock link 302 in its lock position such that the double pull manual release operation is not available. To shift from the child-lock state to the locked state, PL gear 408 is rotated in the first direction into its first locked position which will disengage lock link 302 from cam segment 415 on control cam 414 but maintain lock link 302 in its lock position due to coordinated movement of lock cam 406 to its lock position. To shift from the child-locked state into the unlocked state, PL gear 408 is rotated in the first direction into its first locked position to permit subsequent release via the power release mechanism 318 or manually via the double-pull release operation. FIGS. 17A and 17B illustrate PL gear 408 rotated to its second locked position with lock cam 406 located in its lock position. A switch states vs. function plot associated with the three position PL gear 408 arrangement is provided at FIG. 18.

Figure 19:
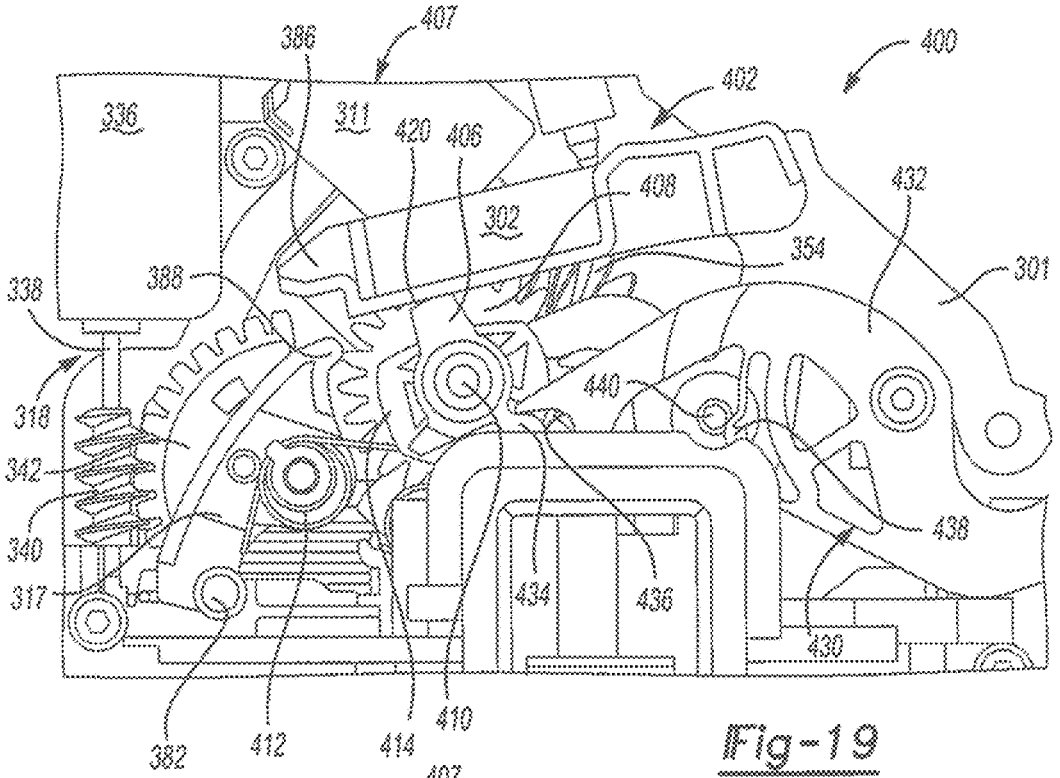
FIG. 19 is an illustration of the components associated with a sixth embodiment of a closure latch assembly equipped with a manual child lock mechanism operating in a child-lock "ON" state.
Figure 20:
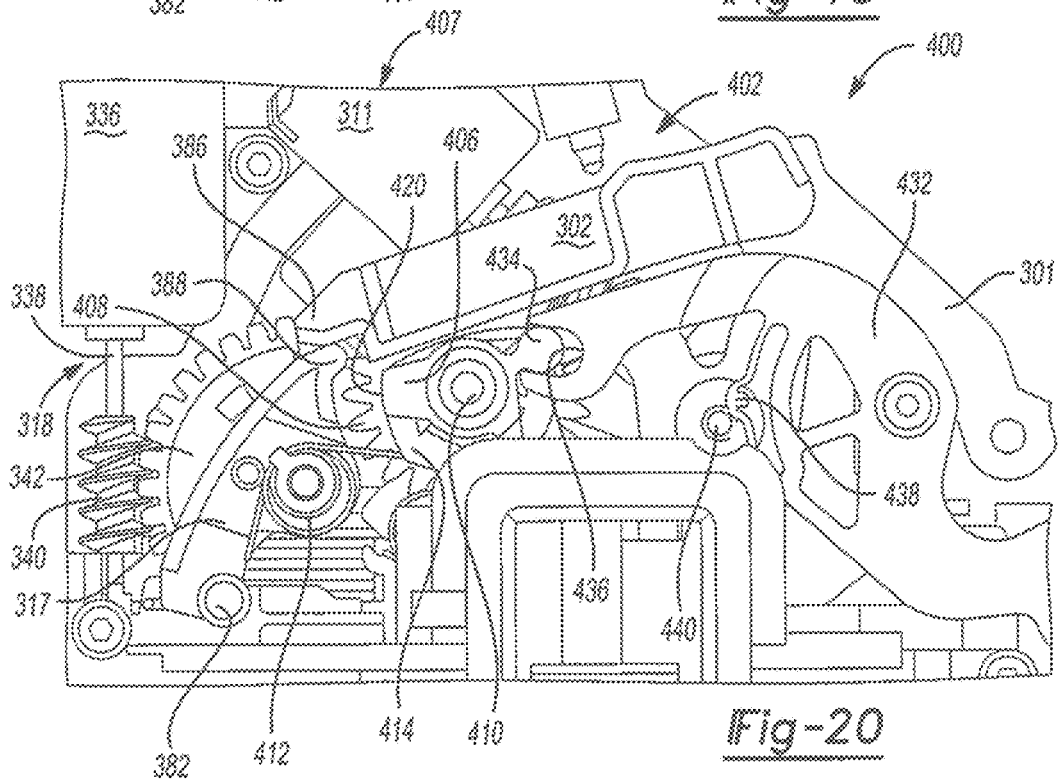
FIG. 20 illustrates the components of the closure latch assembly shown in FIG. 19 when the child lock mechanism is operating in a child-lock "OFF" state.

Referring to FIGS. 19 and 20, closure latch assembly 400 of FIGS. 12-28 is further shown to now incorporate a mechanical child lock mechanism 430 having a two-position child lock cam 432. In FIG. 19, child lock cam 432 is shown located in a first or child lock "ON" position when PL gear 408 is located in either of its first locked or unlocked positions. With cam 432 in this ON position, a lug 434 on lock cam 406 is retained in a lock seat 436 formed in child lock cam 432 for physically holding lock cam 406 in its lock position so as to hold lock link 302 in its lock position. In contrast, FIG. 20 illustrates child lock cam 432 moved to a second or child lock "OFF" position wherein cam 432 has moved lock cam 406 to its unlock position due to engagement of lug 434 within lock seat 436. Thus, with lock cam 406 held in its unlock position, lock link 302 is permitted to move into its unlock position to permit actuation of pawl release lever 317 via actuation of inside release lever 301. A toggle spring segment 438 of child lock cam 432 provides the two-position retention feature with respect to a locator pin 440 extending from release lever 301.

Referring now to FIGS. 21 through 31B, another embodiment of a closure latch assembly 500 is shown. Closure latch assembly 500 is generally configured as an alternative version of closure latch assembly 400 of FIGS. 12-18, but is now equipped with a modified power-operated lock mechanism 502. Power lock mechanism 502 includes many components of power lock mechanism 402 and therefore provides many, if not all, of the same functions. Reference can be made to FIGS. 5-10 and FIGS. 12-18 to identify common components associated with the latch mechanism and the inside and outside release mechanism, as well as the power release mechanism 318.

Figure 21:
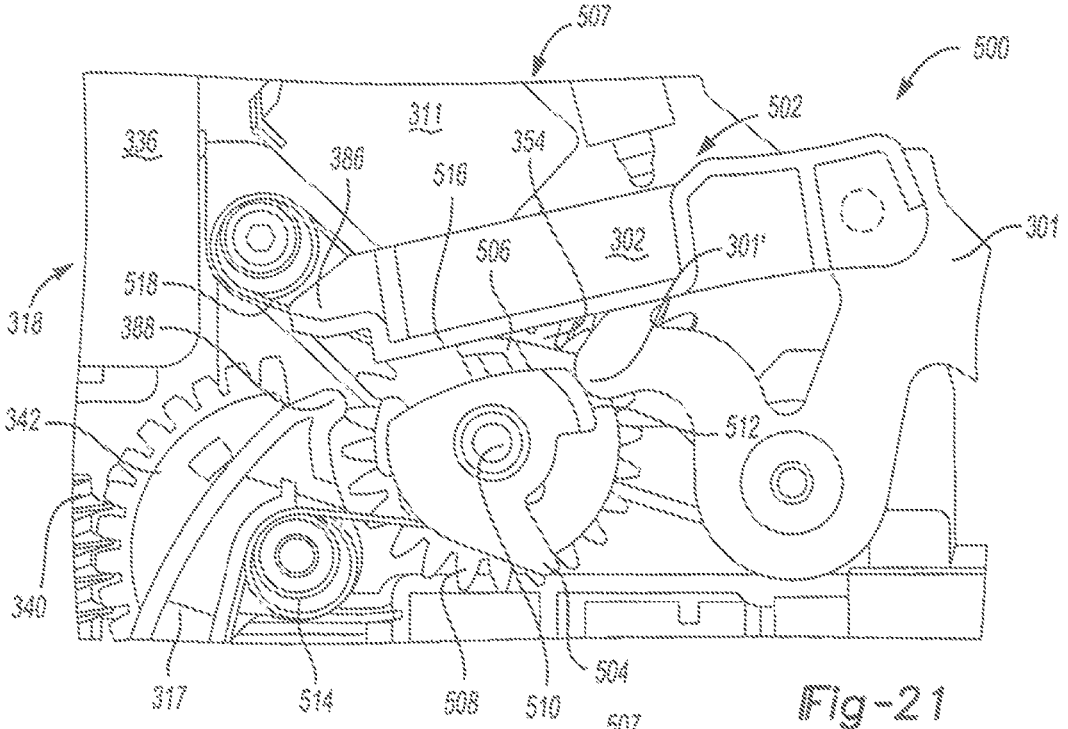
FIG. 21 is an elevational view of a seventh embodiment of a closure latch assembly constructed according to the present disclosure and equipped with a power-operated lock mechanism having a PL gear and dual cam arrangement.

FIG. 21 is an elevational view of the components of closure latch assembly 500 illustrating pawl release lever 317 moveable between its home and pawl release positions, lock link 302 moveable between its lock and unlock positions, and inside release lever 301 moveable between its home and actuated positions. Power release mechanism 318 is again configured to have PL motor 336 drive PR gear 342 between its home and pawl release positions for controlling movement of pawl 315 to its ratchet release position so as to release the latch mechanism.

Power lock mechanism 502 is shown in FIG. 21 to include, among other things, lock link 302, a dual cam arrangement having a lock cam 504 and a child-lock cam 506, and a power lock actuator 507. Lock link 302 is pivotably mounted to inside release lever 301 and is moveable between its unlock and lock positions. Lock link 302 is operable in its unlock position to operatively connect inside release lever 301 to pawl 315 via pawl release lever 317. Lock link 302 is operable in its lock position to operatively disconnect insider release lever 301 from pawl release lever 317. Power lock actuator 507 generally includes lock motor 311 driving worm 354 which, in turn, rotatably drives a power lock (PL) gear 508 about a post 510. PL gear 508 is rotatable between three (3) distinct gear positions including a first locked position, an intermediate unlocked position, and a second (i.e. child-locked) locked position. Lock motor 311 drives PL gear 508 between its first and second locked positions.

Lock cam 504 is also mounted on post 510 for rotation between a lock position and an unlock position. Lock cam 504 is operable in its lock position to have its raised cam edge 512 engage and hold lock link 302 in its lock position and is further operable in its unlock position to disengage cam edge 512 from lock link 302. A lock cam toggle spring 514 acts on lock cam 504 and functions to positively locate and hold lock cam 504 in one of its two distinct positions.

Child-lock cam 506 is also mounted on post 510 for rotation between a first or child-lock ON position and a second or child-lock OFF position. Child-lock cam 506 is operable in its child-lock ON position to have its cam edge 516 engage and hold lock link 302 in its lock position and is further operable in its child-lock OFF position to disengage cam edge 516 from lock link 302. A child-lock cam toggle spring 518 acts on child-lock cam 506 and functions to positively locate and hold child-lock cam 506 in one of its two distinct positions.

Figure 22:
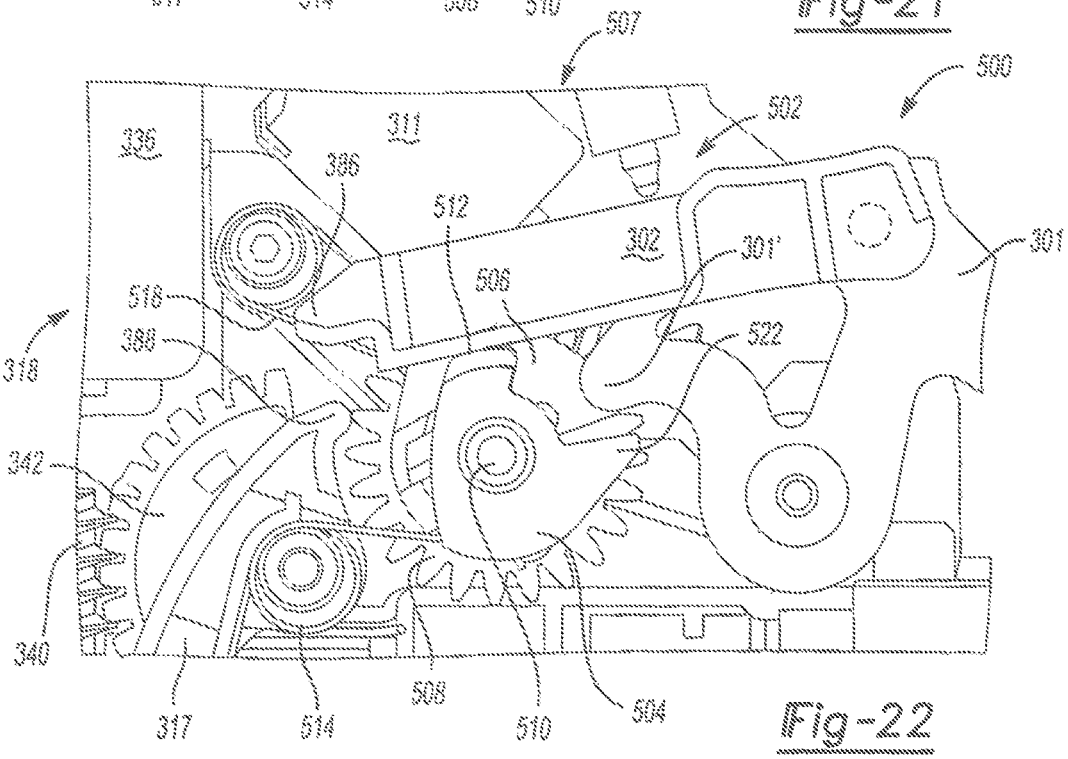
FIG. 22 is an elevational view, similar to FIG. 21, illustrating the orientation of the components when the lock mechanism establishes a first locked state of the closure latch assembly.
Figure 23A:
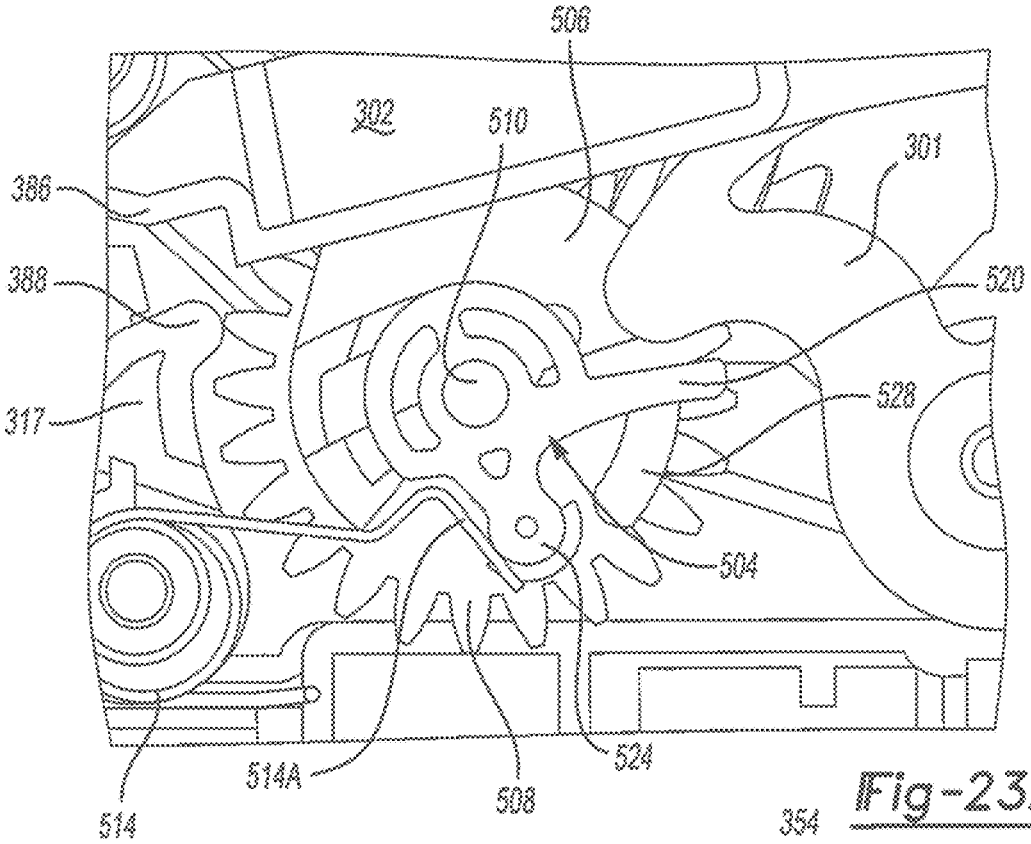
FIGS. 23A and 23B illustrate additional views of a lock cam and a child-lock cam associated with the dual cam arrangement shown in FIG. 22.
Figure 23B:
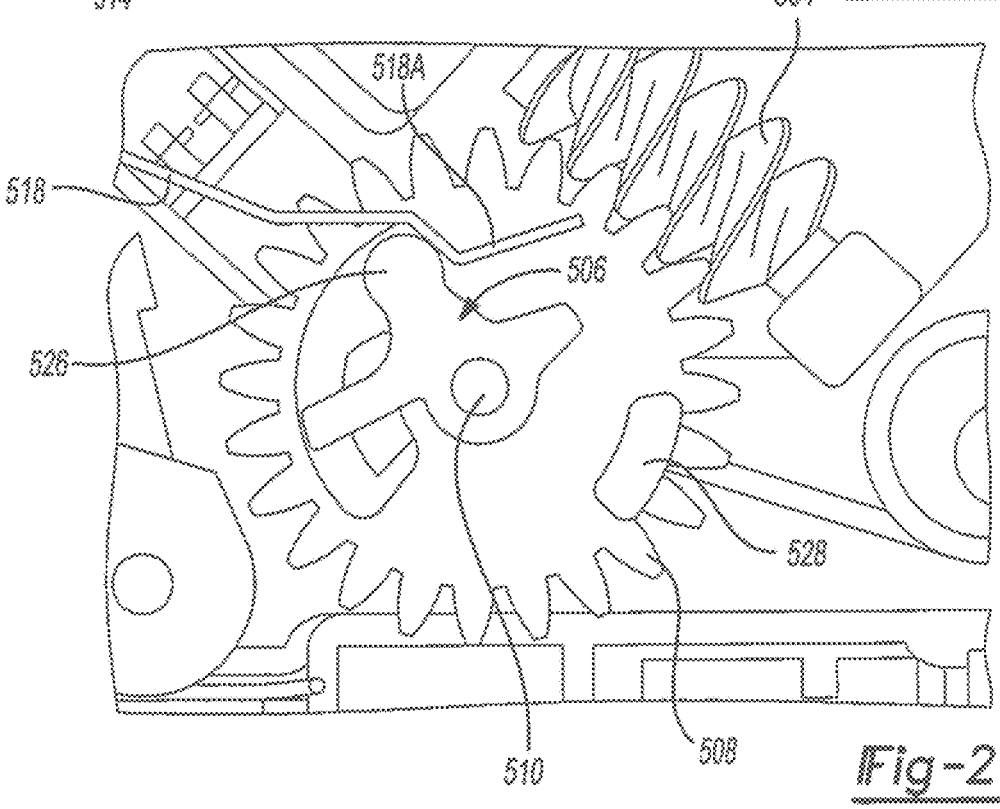

Referring to FIG. 22, power lock mechanism 502 is shown operating in a first locked state with inside release lever 301 in its home position, pawl release lever 317 in its home position, PL gear 508 located in its locked position, lock cam 504 located in its lock position, and child-lock cam 506 located in its child-lock OFF position. As such, raised edge cam 512 on lock cam 504 engages and holds lock link 302 in its lock position. FIG. 23A illustrates a sectioned view of lock cam 504 in its lock position and configured to include a drive lug segment 520 extending from an override arm 522 and a toggle lug segment 524 engaging a bent end segment 514A of lock cam toggle spring 514 for positively locating lock cam 504 in its lock position. FIG. 23B illustrates a sectioned view of child-lock cam 506 in its child-lock OFF position and having a toggle lug segment 526 engaging a bent end segment 518A of toggle spring 518 for positively locating child-lock cam 506 in its child-lock OFF position. To rotate PL gear 508 into its first locked position from either of its other two gear positions, PL motor 311 is actuated to rotate PL gear 508 in a first (i.e. counterclockwise) direction. Such rotation of PL gear 508 causes a drive cam segment 528 formed on PL gear 508 to act on drive lug segment 520 and forcibly rotate lock cam 504 from its unlock position into its lock position.

Figure 24:
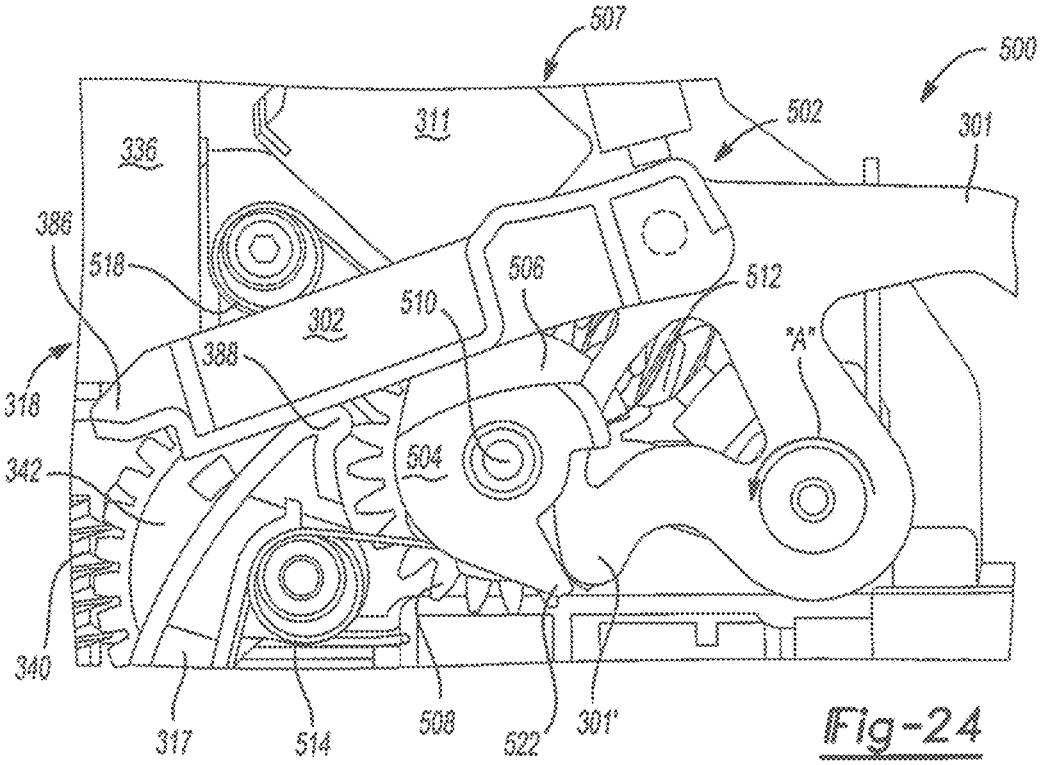
FIG. 24 is an elevational view, similar to FIG. 21, but now showing the orientation of the components when the lock mechanism maintains the closure latch assembly in the first locked state following a first pull of the inside door handle.
Figure 25A:
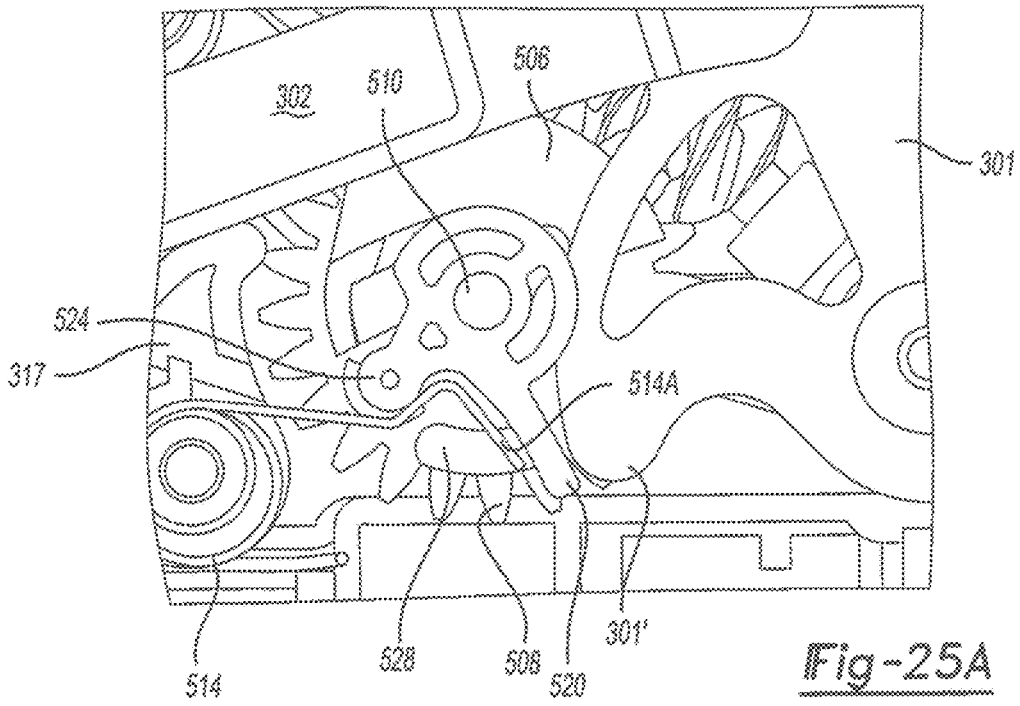
FIGS. 25A and 25B illustrate additional views of the lock cam and the child-lock cam associated with the dual cam arrangement shown in FIG. 24.
Figure 25B:
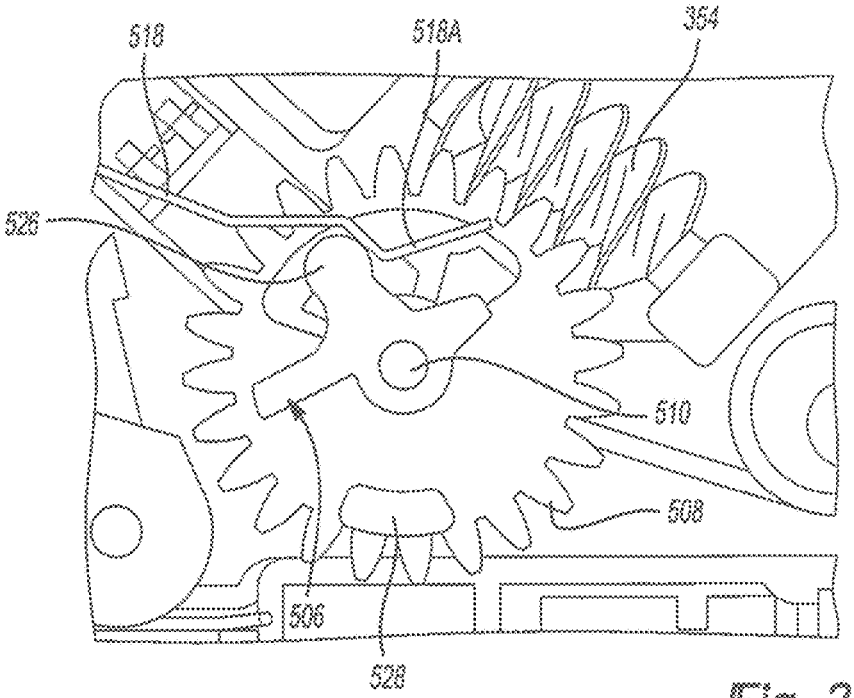

FIG. 24 illustrates a first pull of a double pull manual release operation for mechanically shifting power lock mechanism 502 from its first locked operating state into an unlocked operating state. As seen, inside release lever 301 has been pivoted (via actuation of inside door handle 395) from its home position (FIG. 22) into its actuated position, as indicated by arrow "A". This rotation of inside release lever 301 results in lock link 302 moving in a translational path over the top of pawl release lever 317 which is maintained in its home position. Concurrently, such rotation of inside release lever 301 causes its actuation leg 301' to engage override arm 522 and forcibly rotate lock cam 504 from its lock position (FIG. 22) to its unlock position (FIG. 24). FIG. 25A illustrates that such movement of lock cam 504 to its unlock position causes drive lug segment 520 to engage drive cam segment 528 and backdrive PL gear 508 in a second (i.e. clockwise) direction into its unlocked position. Such action also results in toggle lug segment 524 on lock cam 504 to deflect bent end segment 514A of toggle spring 514 for locating and holding lock cam 504 in its unlock position. Note from FIG. 25B that rotation of PL gear 508 from its locked position to its unlocked position does not affect child-lock cam 506, as it is maintained in its child-lock OFF position.

Figure 26:
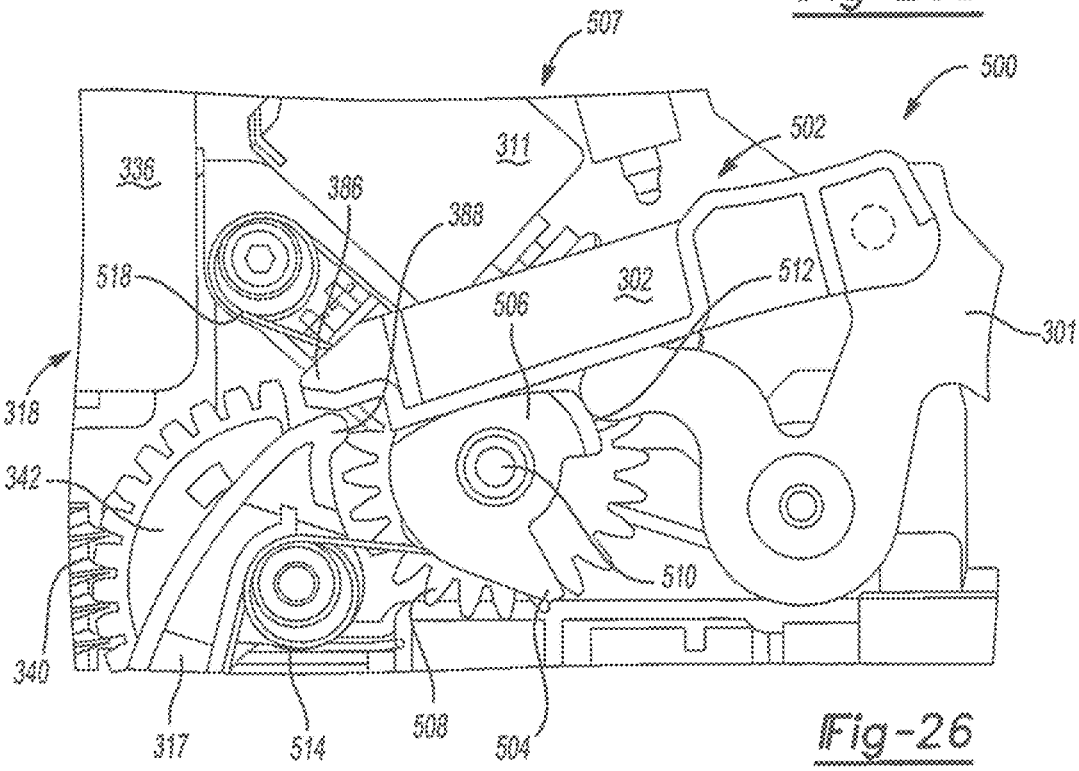
FIG. 26 is an elevational view, similar to FIG. 21, but now illustrating the orientation of the components when the lock mechanism establishes a mechanical unlocked state for the closure latch assembly.
Figure 27A:
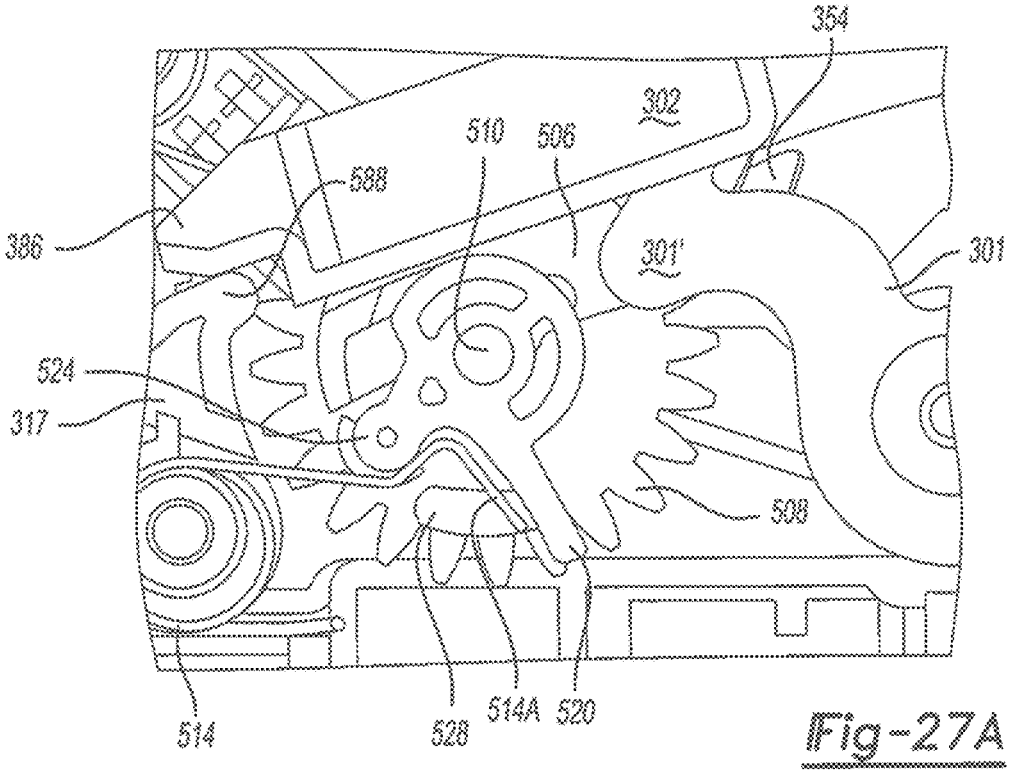
FIGS. 27A and 27B illustrate additional views of the lock cam and the child-lock cam associated with the dual cam arrangement shown in FIG. 26.
Figure 27B:
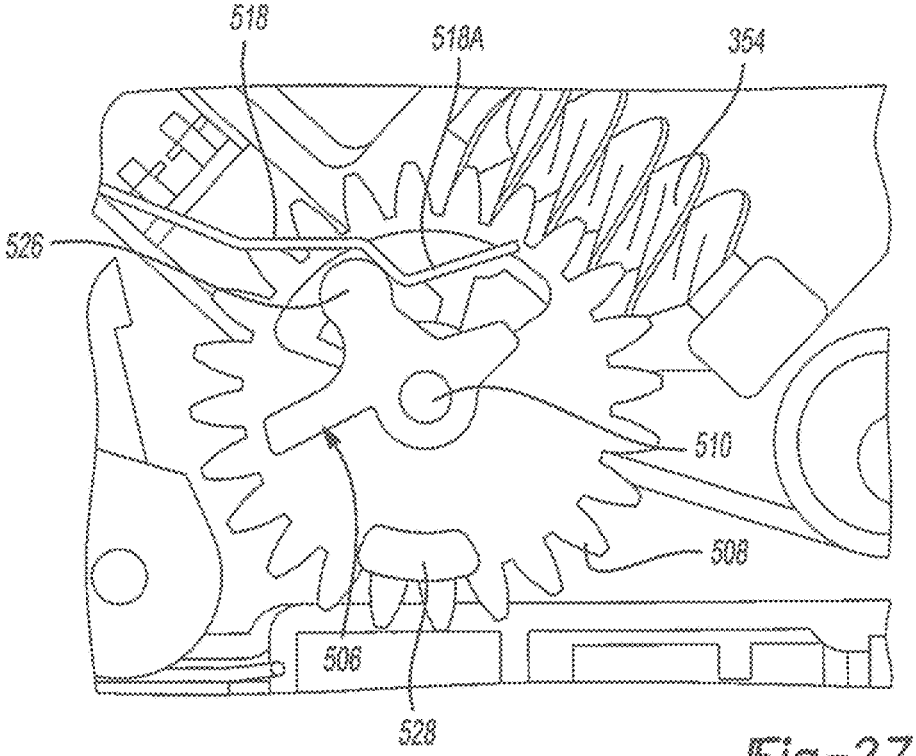

Referring to FIG. 26, inside release lever 301 is shown returned to its home position following completion of the first pull operation. As seen, rotation of lock cam 504 to its unlock position while child-lock cam 506 is maintained in its child-lock OFF position permits lock link 302 to pivot into unlock position upon return of inside release lever 301 to the home position. PL gear 508 is retained in its unlocked position. Thus, upon a subsequent second pull on the inside door handle, rotation of inside release lever 301 to its actuated position causes lock link 302 to forcibly pivot pawl release lever 317 from its home position into its pawl release position to release the latch mechanism, thereby shifting power lock mechanism 502 into its unlocked operating state. FIGS. 27A and 27B illustrate the orientation of lock cam 504 and child-lock cam 506 during this mechanical unlocking via the double pull operation.

Figure 28:
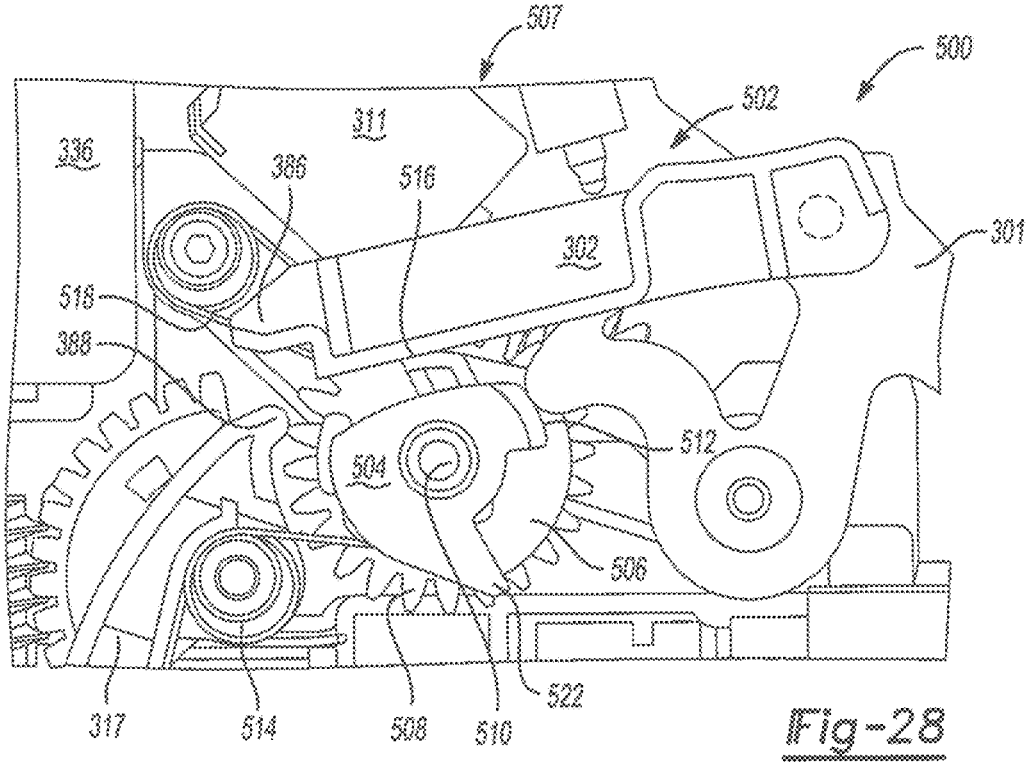
FIG. 28 illustrates the orientation of the components when the lock mechanism establishes a second or child-locked state for the closure latch assembly.
Figure 29A:
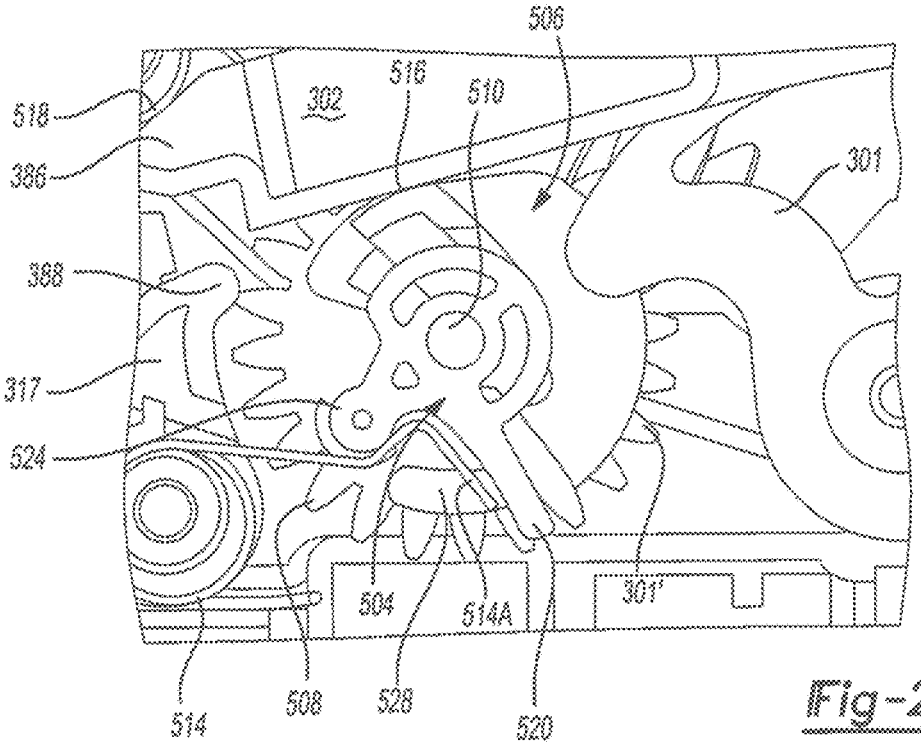
FIGS. 29A and 29B illustrate additional views of the lock cam and child-lock cam associated with the dual cam arrangement shown in FIG. 28.
Figure 29B:
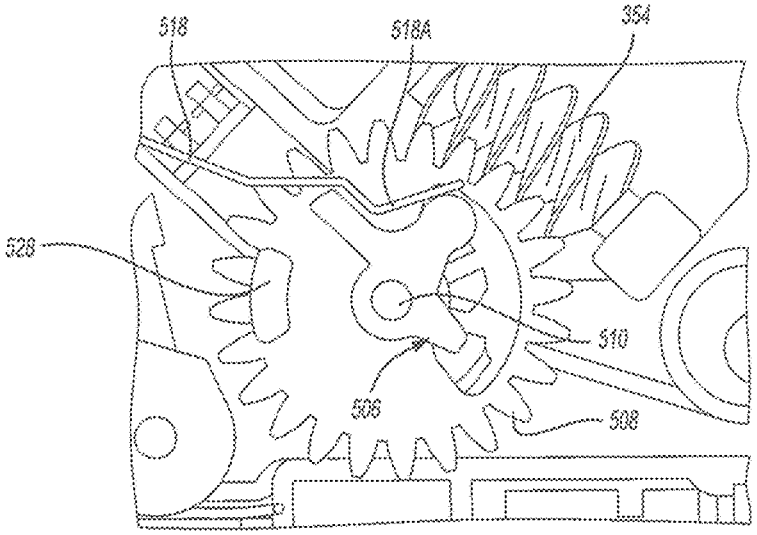

FIG. 28 illustrates PL motor 311 rotating PL gear 508 in the second direction for locating PL gear in its second locked position, there shifting power lock mechanism 502 into a second locked or child-locked operating state. Such rotation of PL gear 508 results in corresponding rotation of child-lock cam 506 from its child-lock OFF position into its child-lock ON position with its cam edge 516 engaging and holding lock link 302 in its lock position while lock cam 504 is maintained in its unlock position. FIGS. 27A and 29B illustrate toggle spring 514 holding lock cam 504 in its unlock position while toggle spring 518 retains child-lock cam 506 in its child-lock ON position.

Figure 30:
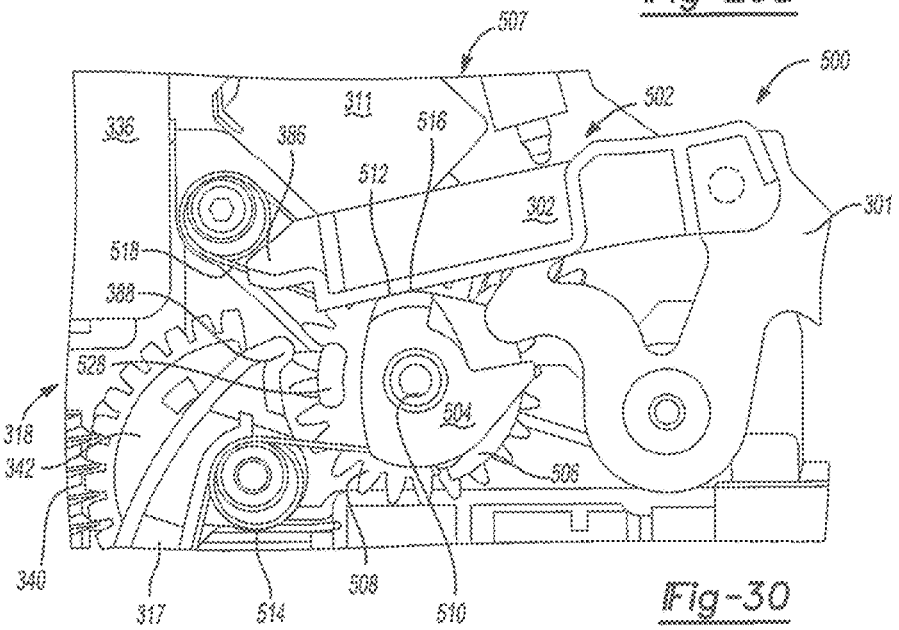
FIG. 30 illustrates the orientation of the components lock mechanism establishes a third or double child-locked state of the closure latch assembly.
Figure 31A:
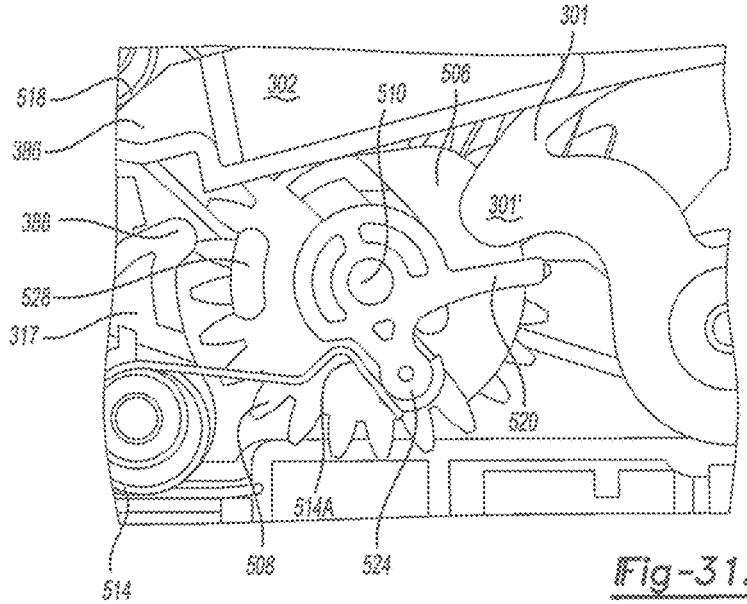
FIGS. 31A and 31B illustrate additional view of the lock cam and the child-lock cam associated with the dual cam arrangement shown in FIG. 30.
Figure 31B:
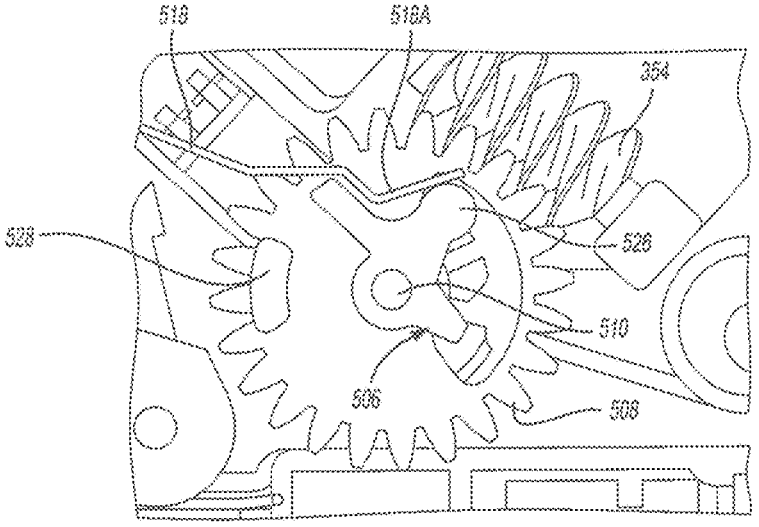

FIG. 30 illustrates PL motor 311 rotating PL gear 508 in the second direction for locating PL gear 508 in its second locked position while lock cam 504 is positioned in its lock position so as to cause child-lock cam 506 to rotate from its child-lock OFF position into its child-lock ON position. This action results in shifting of power lock mechanism 502 into a third locked or double locked operating state. FIGS. 31A and 31B illustrate toggle spring 514 retaining lock cam 504 in its lock position while toggle spring 518 retains child-lock cam 506 in its child-lock ON position. FIGS. 28 and 30 illustrate that power lock mechanism 302 can be shifted into its power child locking feature before or after a first pull of a double pull release operation.

Power lock mechanism 502 provides closure latch assembly 500 with a multi-piece camming arrangement operatively connected to PL gear 508 for independent rotation therewith so as to provide a uni-directional locking feature. Specifically, rotation of lock cam 504 with PL gear 508 in the first (counterclockwise) direction results in establishing the first locked operating state while rotation of child-lock cam 506 with PL gear 508 in the second (clockwise) direction results in establishing the second and third locking states. More importantly, this dual cam arrangement prevents unintended release of the latch engagement when PL gear is rotated between its first and second locked positions. When operating in the first locked state, rotation of PL gear 508 and child-lock cam 506 in the second direction permits shifting into either of the second and third child-locking states while lock cam 504 remains in its corresponding unlock or lock positions. When operating in the unlocked mode, PL gear 508 can be rotated in the first direction for driving the lock cam 504 to its lock position for re-establishing the first locked state. When operating in the third locked state, PL gear 508 can be rotated in the first direction to drive child-lock cam 506 to its child-lock OFF position and drive lock cam 504 to its lock position to re-establish the first locked state.

Those skilled in the art will understand and appreciate the structural and functional arrangement provided by the closure latch components shown in FIGS. 12-18 and FIGS. 21-30 for the power child lock versions and in FIGS. 19 and 20 for the non-powered (mechanical) child lock version. Specifically, the three (3) position gear arrangement shown each function to provide a double pull inside release type of release system in association with a single-motor power lock arrangement.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A closure latch assembly for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a latch release mechanism including a pawl release lever moveable between a home position whereat the pawl is maintained in its ratchet holding position and a pawl release position whereat the pawl release lever moves the pawl to its ratchet releasing position;

an inside door release mechanism including an inside release lever operatively connectable to the pawl release lever for selectively moving the pawl release lever from its home position to its pawl release position;

a lock mechanism including, a lock link that is pivotable between an unlock position whereat the lock link operatively connects the inside release lever to the pawl release lever and a lock position whereat the lock link operatively disconnects the inside release lever from the pawl release lever, a lock link biasing member for biasing the lock link toward its unlock position, and a dual cam arrangement having a first cam and a second cam, the first cam being rotatable about a post between an unlock position whereat the first cam permits the lock link to pivot into its unlock position and a lock position whereat the first cam engages and pivots the lock link into its lock position, the second cam being rotatable about the post between a child unlock position whereat the second cam is displaced from engagement with the lock link and a child lock position whereat the second cam engages and pivots the lock link into its lock position, wherein the lock mechanism is operable in a first locked state, an unlocked state and a second locked state, the first locked state being established when the first cam is located in its lock position and the second cam is located in its child unlock position, the unlocked state being established when the first cam is located in its unlock position and the second cam is located in its child unlock position, and the second locked state being established when the first cam is located in either of its lock position and its unlock position and the second cam is located in its child lock position; and wherein the lock mechanism further comprises a power lock actuator including an electric motor operable for rotatably driving a power lock gear about the post through a range of motion defined between a first locked position and a second locked position, wherein the power lock gear is operable in its first locked position to locate the first cam in its lock position and locate the second cam in its child unlock position for establishing the first locked state, and wherein the power lock gear is operable in its second locked position to locate the second cam in its child lock position for establishing the second locked state.

2. The closure latch assembly of claim 1, wherein the first cam includes an override member and wherein movement of the inside release lever from a home position to an actuated position causes the inside release lever to engage and move the first cam from its lock position into its unlock position for shifting the lock mechanism from the first locked state into the unlocked state.

3. The closure latch assembly of claim 2, wherein the power lock gear includes a drive cam segment engageable with the override member on the first cam such that movement of the first cam from its lock position to its unlock position in response to movement of the inside release lever to its actuated position causes the override member to engage the drive cam segment and rotate the power lock gear from its first locked position to an unlocked position, and wherein driven rotation of the power lock gear from one of its second locked position and its unlocked position to its first locked position causes the drive cam segment to engage the override member and drive the first cam from its unlock position to its lock position.

4. The closure latch assembly of claim 3, wherein the second cam is fixed for rotation with the power lock gear such that rotation of the power lock gear between its first and second locked positions causes corresponding movement of the second cam between its child unlock and child lock positions.

5. The closure latch assembly of claim 4, wherein the first cam is rotatable relative to the power lock gear, and wherein a cam toggle spring is operable to locate the first cam in one of its unlock and lock positions.

6. The closure latch assembly of claim 3, wherein the first cam and the second cam are rotatable relative to the power lock gear, wherein a first cam toggle spring is operable to locate the first cam in one of its lock position and its unlock position during rotation of the power lock gear, and wherein a second cam toggle spring is operable to locate the second cam in one of its child lock position and its child unlock position during rotation of the power lock gear.

7. The closure latch assembly of claim 1 further comprising a power release actuator operatively connected to the pawl release lever for moving the pawl release lever to its pawl release position when the lock mechanism is in one of its first locked state and its unlocked state.

8. A closure latch assembly for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

an inside door release mechanism including an inside release lever operatively connectable to the pawl for selectively moving the pawl from its ratchet holding position to its ratchet releasing position;

a lock mechanism including a lock link that is pivotable between an unlock position whereat the lock link operatively connects the inside release lever to the pawl and a lock position whereat the lock link operatively disconnects the inside release lever from the pawl, a lock link biasing member for biasing the lock link toward its unlock position, and a dual cam arrangement having a first cam and a second cam, the first cam being rotatable between an unlock position whereat the first cam permits the lock link to pivot into its unlock position and a lock position whereat the first cam engages and pivots the lock link into its lock position, the second cam being rotatable between a child unlock position whereat the second cam is displaced from engagement with the lock link and a child lock position whereat the second cam engages and pivots the lock link into its lock position, wherein the lock mechanism is operable in a first locked state, an unlocked state and a second locked state, the first locked state being established when the first cam is located in its lock position and the second cam is located in its child unlock position, the unlocked state being established when the first cam is located in its unlock position and the second cam is located in its child unlock position, and the second locked state being established when the first cam is located in either of its lock position and its unlock position and the second cam is located in its child lock position;

wherein the lock mechanism further comprises a power lock actuator including an electric motor operable for rotatably driving a power lock gear through a range of motion defined between a first locked position and a second locked position, wherein the power lock gear is operable in its first locked position to locate the first cam in its lock position and locate the second cam in its child unlock position for establishing the first locked state, and wherein the power lock gear is operable in its second locked position to locate the second cam in its child lock position for establishing the second locked state, wherein the first cam and the second cam are rotatable relative to the power lock gear, wherein the first cam includes an override member, wherein movement of the inside release lever from a home position to an actuated position causes the inside release lever to engage and move the first cam from its lock position into its unlock position for shifting the lock mechanism from the first locked state into the unlocked state, and wherein the power lock gear includes a drive cam segment engageable with the override member on the first cam such that movement of the first cam from its lock position to its unlock position in response to movement of the inside release lever to its actuated position causes the override member to engage the drive cam segment and rotate the power lock gear from its first locked position to an unlocked position, and wherein driven rotation of the power lock gear from one of its second locked position and its unlocked position to its first locked position causes the drive cam segment to engage the override member and drive the first cam from its unlock position to its lock position.

9. The closure latch assembly of claim 8, wherein a first cam toggle spring is operable to locate the first cam in one of its lock position and its unlock position during rotation of the power lock gear, and wherein a second cam toggle spring is operable to locate the second cam in one of its child lock position and its child unlock position during rotation of the power lock gear.

10. The closure latch assembly of claim 8 further comprising a power release actuator operatively connected to the pawl for moving the pawl to its ratchet releasing position when the lock mechanism is in one of its first locked state and its unlocked state.

11. A closure latch assembly for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a latch release mechanism including a pawl release lever moveable between a home position whereat the pawl is maintained in its ratchet holding position and a pawl release position whereat the pawl release lever moves the pawl to its ratchet releasing position;

an inside door release mechanism including an inside release lever operatively connectable to the pawl release lever for selectively moving the pawl release lever from its home position to its pawl release position;

a lock mechanism including a lock link that is pivotable between an unlock position whereat the lock link operatively connects the inside release lever to the pawl release lever and a lock position whereat the lock link operatively disconnects the inside release lever from the pawl release lever, a lock link biasing member for biasing the lock link toward its unlock position, a dual cam arrangement having a first cam and a second cam, wherein the first cam is rotatable between an unlock position whereat the first cam permits the lock link to pivot into its unlock position and a lock position whereat the first cam engages and pivots the lock link into its lock position, wherein the second cam is rotatable between a child unlock position whereat the second cam is displaced from engagement with the lock link and a child lock position whereat the second cam engages and pivots the lock link into its lock position; and a power lock actuator including an electric motor operable for rotatably driving a power lock gear between a first locked position and a second locked position, the power lock gear being operable in its first locked position to locate the first cam in its lock position and locate the second cam in its child unlock position, and the power lock gear being operable in its second locked position to locate the second cam in its child lock position;

wherein the lock mechanism is operable in a first locked state and a second locked state, the first locked state being established when the power lock gear is located in its first locked position and the second locked state being established when the power lock gear is located in its second locked position, wherein the first cam and the second cam are rotatable relative to the power lock gear and independently from the power lock gear, and wherein a first cam toggle spring is operable to locate the first cam in one of its lock position and its unlock position during rotation of the power lock gear, and wherein a second cam toggle spring is operable to locate the second cam in one of its child lock position and its child unlock position during rotation of the power lock gear.

12. The closure latch assembly of claim 11, wherein the first cam includes an override member, wherein movement of the inside release lever from a home position to an actuated position causes the inside release lever to engage and move the first cam from its lock position into its unlock position for shifting the lock mechanism from the first locked state into an unlocked state.

13. The closure latch assembly of claim 12, wherein the power lock gear includes a drive cam segment engageable with the override member on the first cam such that movement of the first cam from its lock position to its unlock position in response to movement of the inside release lever to its actuated position causes the override member to engage the drive cam segment and drive the power lock gear from its first locked position to an unlocked position.

14. A closure latch assembly for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

an inside door release mechanism including an inside release lever operatively connectable to the pawl for selectively moving the pawl from its ratchet holding position to its ratchet releasing position; and a lock mechanism including a lock link that is pivotable between an unlock position whereat the lock link operatively connects the inside release lever to the pawl and a lock position whereat the lock link operatively disconnects the inside release lever from the pawl, a lock link biasing member for biasing the lock link toward its unlock position, and a dual cam arrangement having a first cam and a second cam, the first cam being rotatable between an unlock position whereat the first cam permits the lock link to pivot into its unlock position and a lock position whereat the first cam engages and pivots the lock link into its lock position, the second cam being rotatable between a child unlock position whereat the second cam is displaced from engagement with the lock link and a child lock position whereat the second cam engages and pivots the lock link into its lock position, wherein the lock mechanism is operable in a first locked state, an unlocked state and a second locked state, the first locked state being established when the first cam is located in its lock position and the second cam is located in its child unlock position, the unlocked state being established when the first cam is located in its unlock position and the second cam is located in its child unlock position, and the second locked state being established when the first cam is located in either of its lock position and its unlock position and the second cam is located in its child lock position, wherein the lock mechanism further comprises a power lock actuator including an electric motor operable for rotatably driving a power lock gear through a range of motion defined between a first locked position and a second locked position, wherein the power lock gear is operable in its first locked position to locate the first cam in its lock position and locate the second cam in its child unlock position for establishing the first locked state, and wherein the power lock gear is operable in its second locked position to locate the second cam in its child lock position for establishing the second locked state, wherein the first cam and the second cam are rotatable relative to the power lock gear, wherein the first cam includes an override member, wherein movement of the inside release lever from a home position to an actuated position causes the inside release lever to engage and move the first cam from its lock position into its unlock position for shifting the lock mechanism from the first locked state into the unlocked state, and wherein a first cam toggle spring is operable to locate the first cam in one of its lock position and its unlock position during rotation of the power lock gear, and wherein a second cam toggle spring is operable to locate the second cam in one of its child lock position and its child unlock position during rotation of the power lock gear.

15. A closure latch assembly for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a latch release mechanism including a pawl release lever moveable between a home position whereat the pawl is maintained in its ratchet holding position and a pawl release position whereat the pawl release lever moves the pawl to its ratchet releasing position;

an inside door release mechanism including an inside release lever operatively connectable to the pawl release lever for selectively moving the pawl release lever from its home position to its pawl release position;

a lock mechanism including a lock link that is pivotable between an unlock position whereat the lock link operatively connects the inside release lever to the pawl release lever and a lock position whereat the lock link operatively disconnects the inside release lever from the pawl release lever, a lock link biasing member for biasing the lock link toward its unlock position, a dual cam arrangement having a first cam and a second cam, wherein the first cam is rotatable between an unlock position whereat the first cam permits the lock link to pivot into its unlock position and a lock position whereat the first cam engages and pivots the lock link into its lock position, wherein the second cam is rotatable between a child unlock position whereat the second cam is displaced from engagement with the lock link and a child lock position whereat the second cam engages and pivots the lock link into its lock position; and a power lock actuator including an electric motor operable for rotatably driving a power lock gear between a first locked position and a second locked position, the power lock gear being operable in its first locked position to locate the first cam in its lock position and locate the second cam in its child unlock position, and the power lock gear being operable in its second locked position to locate the second cam in its child lock position, wherein the lock mechanism is operable in a first locked state and a second locked state, the first locked state being established when the power lock gear is located in its first locked position and the second locked state being established when the power lock gear is located in its second locked position, wherein the first cam and the second cam are rotatable relative to the power lock gear and independently from the power lock gear, wherein the first cam includes an override member, wherein movement of the inside release lever from a home position to an actuated position causes the inside release lever to engage and move the first cam from its lock position into its unlock position for shifting the lock mechanism from the first locked state into an unlocked state, and wherein the power lock gear includes a drive cam segment engageable with the override member on the first cam such that movement of the first cam from its lock position to its unlock position in response to movement of the inside release lever to its actuated position causes the override member to engage the drive cam segment and drive the power lock gear from its first locked position to an unlocked position.

* * * * *